US012753681B2

(12) United States Patent
McFarland et al.

(10) Patent No.: US 12,753,681 B2
(45) Date of Patent: Oct. 6, 2026

(54) PERFORATING GUN AND BALLISTIC INTERRUPTER FOR SAME

(71) Applicant: Oso Perforating, LLC, Irving, TX (US)

(72) Inventors: Nathan McFarland, Euless, TX (US); Varun Garg, Dallas, TX (US); Jeremy Ursi, Frisco, TX (US); Kerron James, Fort Worth, TX (US); Peter Galligan, Grapevine, TX (US)

(73) Assignee: Oso Perforating, LLC, Irving, TX (US)

( * ) Notice: Subject to any disclaimer, the term of this patent is extended or adjusted under 35 U.S.C. 154(b) by 0 days.

(21) Appl. No.: 19/040,004

(22) Filed: Jan. 29, 2025

(65) Prior Publication Data

US 2025/0188821 A1 Jun. 12, 2025

Related U.S. Application Data

(63) Continuation of application No. 18/644,275, filed on Apr. 24, 2024, now Pat. No. 12,215,577.

(60) Provisional application No. 63/497,900, filed on Apr. 24, 2023.

(51) Int. Cl.
*E21B 43/1185* (2006.01)
*F42D 1/05* (2006.01)

(52) U.S. Cl.
CPC ..... *E21B 43/1185* (2013.01); *F42D 1/05* (2013.01)

(58) Field of Classification Search
None
See application file for complete search history.

(56) References Cited

U.S. PATENT DOCUMENTS

| | | | |
|---|---|---|---|
| 5,027,708 | A | 7/1991 | Gonzalez et al. |
| 8,695,506 | B2 | 4/2014 | Lanclos |
| 9,157,718 | B2 | 10/2015 | Ross |
| 10,077,641 | B2 | 9/2018 | Rogman et al. |
| 10,584,950 | B2 | 3/2020 | Saltarelli et al. |
| 11,174,712 | B2 | 11/2021 | Quattlebaum et al. |
| 11,460,281 | B2 | 10/2022 | LeClair et al. |
| 11,814,934 | B2 | 11/2023 | Wells et al. |
| 11,988,078 | B2 | 5/2024 | Knight et al. |
| 2023/0250710 | A1 | 8/2023 | Sullivan |

FOREIGN PATENT DOCUMENTS

| | | | |
|---|---|---|---|
| WO | 2022164924 | A1 | 8/2022 |

*Primary Examiner* — Reginald S Tillman, Jr.
(74) *Attorney, Agent, or Firm* — HAYNES AND BOONE, LLP

(57) ABSTRACT

A perforating gun used in oil and gas completions operations, the perforating gun including a ballistic interrupter actuable from a disarmed state or configuration, in which ballistic communication between a detonator and a detonation cord is impeded, to an armed state or configuration, in which ballistic communication between the detonator and the detonating cord is permitted. A gun string includes the perforating gun and one or more additional perforating guns substantially identical to the perforating gun.

29 Claims, 54 Drawing Sheets

PERFORATING GUN AND BALLISTIC INTERRUPTER FOR SAME

CROSS-REFERENCE TO RELATED APPLICATIONS

This application is a continuation of U.S. patent application Ser. No. 18/644,275 ("the '275 Application"), filed Apr. 24, 2024, which claims the benefit of the filing date of, and priority to, U.S. Patent Application No. 63/497,900, filed Apr. 24, 2023, the entire disclosures of which are hereby incorporated herein by reference.

The '275 application is also related to U.S. patent application Ser. No. 17/869,320 ("the '320 Application"), filed Jul. 20, 2022 bearing, now issued as U.S. Pat. No. 11,649,684, which claims the benefit of the filing date of, and priority to, U.S. Patent Application No. 62/224,338, filed Jul. 21, 2021 bearing, and U.S. Patent Application No. 63/355,440, filed Jun. 24, 2022 bearing, the entire disclosures of which are hereby incorporated herein by reference.

TECHNICAL FIELD

The present disclosure relates generally to perforating guns used in oil and gas completions operations, and, more particularly, to a perforating gun with a ballistic interrupter.

BRIEF DESCRIPTION OF THE DRAWINGS

FIG. 17B-1 is a cross-sectional view of the ballistic interrupter and the end cap including the detonation housing of FIG. 14 in a second state or configuration, according to one or more embodiments of the present disclosure.

FIG. 17B-2 is an enlarged cross-sectional view of the ballistic interrupter and the end cap including the detonation housing in the second state or configuration of FIG. 17B-1, according to one or more embodiments of the present disclosure.

FIG. 17C-1 is a cross-sectional view of the ballistic interrupter including the key and the end cap including the detonation housing of FIG. 14 in a third state or configuration, according to one or more embodiments of the present disclosure.

FIG. 17C-2 is an enlarged cross-sectional view of the ballistic interrupter including the key and the end cap including the detonation housing in the third state or configuration of FIG. 17C-1, according to one or more embodiments of the present disclosure.

FIG. 17D-1 is a cross-sectional view of the ballistic interrupter including the key and the end cap including the detonation housing of FIG. 14 in a fourth state or configuration, according to one or more embodiments of the present disclosure.

FIG. 17D-2 is an enlarged cross-sectional view of the ballistic interrupter including the key and the end cap including the detonation housing in the fourth state or configuration of FIG. 17D-1, according to one or more embodiments of the present disclosure.

FIG. 17E-1 is a cross-sectional view of the ballistic interrupter including the key and the end cap including the detonation housing of FIG. 14 in a fifth state or configuration, according to one or more embodiments of the present disclosure.

FIG. 17E-2 is an enlarged cross-sectional view of the ballistic interrupter including the key and the end cap including the detonation housing in the fifth state or configuration of FIG. 17E-1, according to one or more embodiments of the present disclosure.

FIG. 17F-1 is a cross-sectional view of the ballistic interrupter including the key and the end cap including the detonation housing of FIG. 14 in a sixth state or configuration, according to one or more embodiments of the present disclosure.

FIG. 17F-2 is an enlarged cross-sectional view of the ballistic interrupter including the key and the end cap including the detonation housing in the sixth state or configuration of FIG. 17F-1, according to one or more embodiments of the present disclosure.

DETAILED DESCRIPTION

Figure 1:
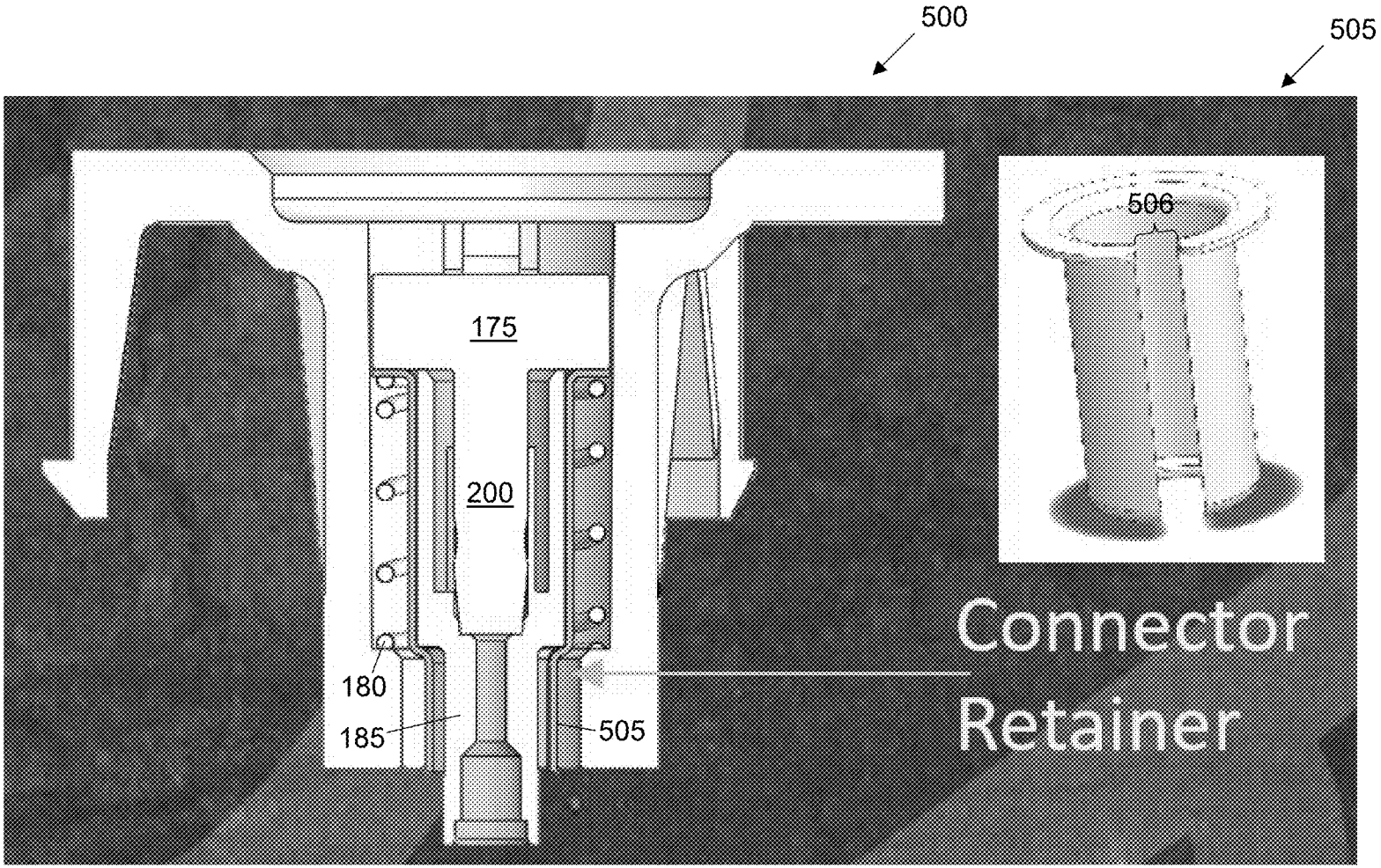
FIG. 1 is a cross-sectional view of a cap assembly, according to one or more embodiments of the present disclosure.

Referring to FIG. 1, in an embodiment, a cap assembly is generally referred to by the reference numeral 500. One or more of the cap assemblies (125*a*/125*b*, 390*a*/390*b*) shown and described in the '320 Application may be omitted in favor of the cap assembly 500, which cap assembly 500 includes features and/or components substantially identical to corresponding features and/or components of said cap assemblies (125*a*/125*b*, 390*a*/390*b*); at least some of these substantially identical features and/or components are referred to herein by the same reference numerals as those set forth in the '320 Application, which published as U.S. Patent Application Publication No. 2023/0029249 (attached hereto as an Appendix). In addition to said substantially identical features and/or components, the cap assembly 500 includes a connector retainer 505. The connector retainer 505 is adapted to retain the electrical connector 185 on the reduced-diameter end portion 200 of the conductor body 175. More particularly, the connector retainer 505 effectively traps the electrical connector 185, biasing the electrical connector 185 toward reduced-diameter end portion 200 of the conductor body 175 using the biasing member 180 (e.g., a spring). A slot 506 is defined in the connector retainer 505 to allow the connector retainer to be slipped over a wire connected to the electrical connector 185, even if the electrical connector 185 is already mated to the reduced-diameter end portion 200 of the conductor body 175. In one or more embodiments, the connector retainer 505 increases the pull force required to separate the electrical connector 185 from the reduced-diameter end portion 200 of the conductor body (i.e., from approximately 4 lbs. (+/−10%) to 20 lbs. (or more)), thereby ensuring the reliability of the connection post blast.

Figure 2:
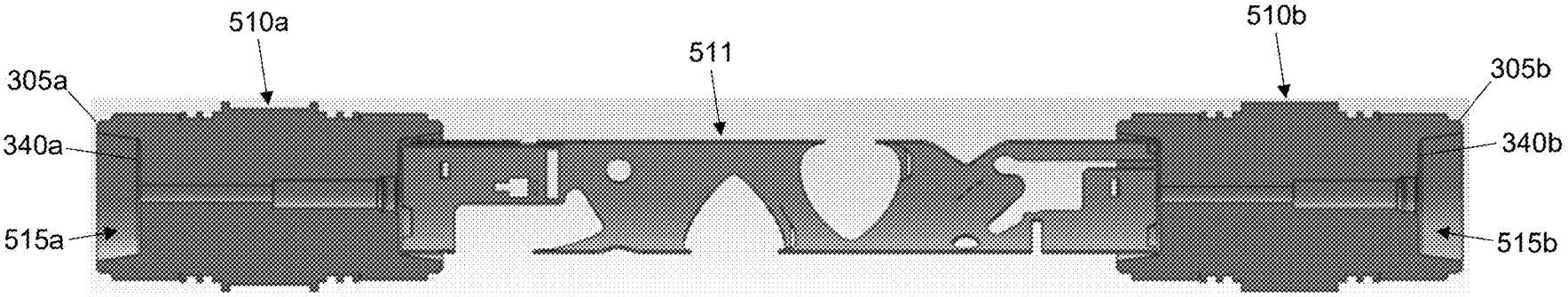
FIG. 2 is a cross-sectional view of a pair of conductor subs and a charge tube of a perforating gun, according to one or more embodiments of the present disclosure.
Figure 3A:
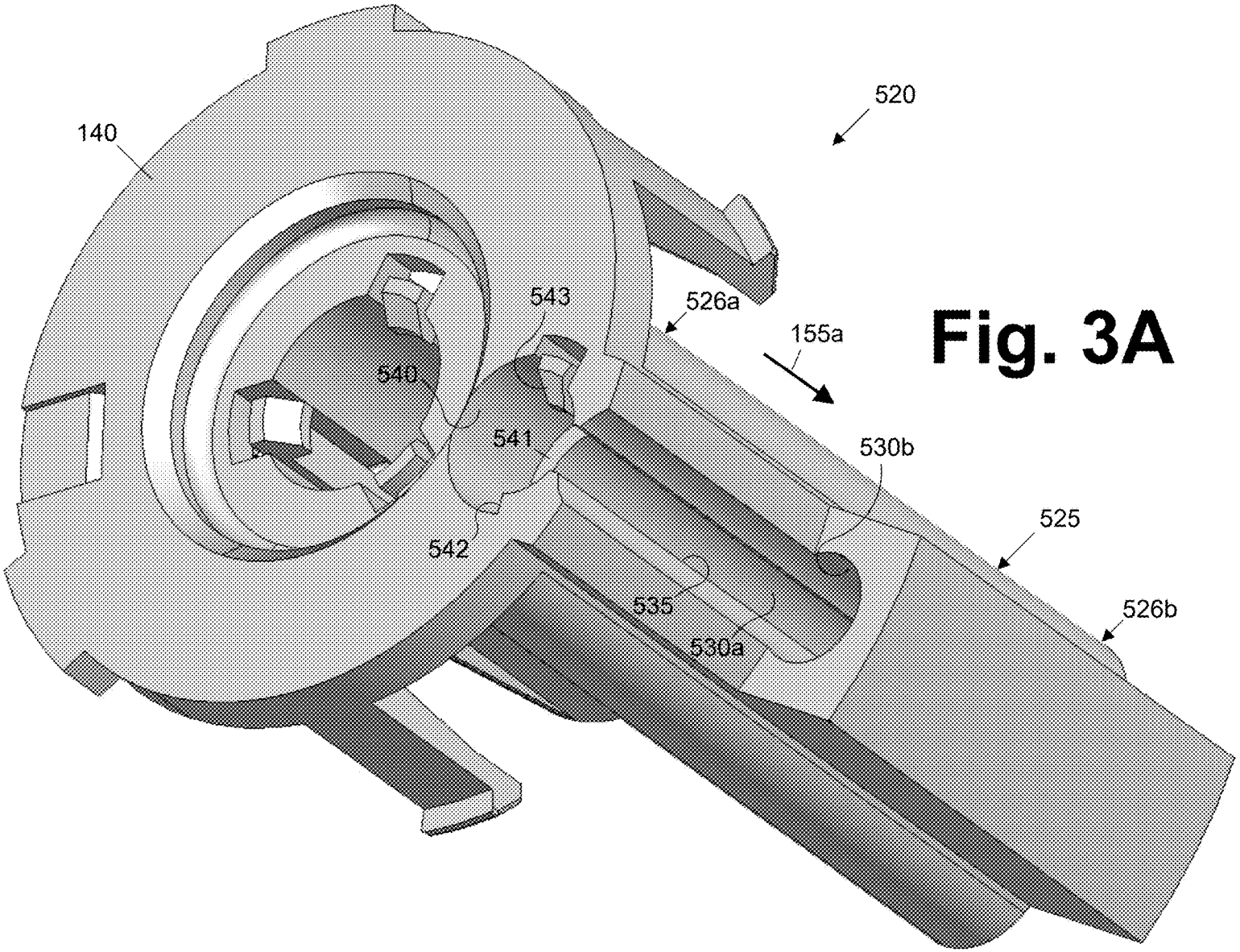
FIG. 3A is a perspective view of an end cap of a charge cartridge of a perforating gun, which charge cartridge also includes a charge tube (not shown) into which the end cap is received when the charge cartridge is assembled, said end cap including a detonation housing, according to one or more embodiments of the present disclosure.
Figure 3B:
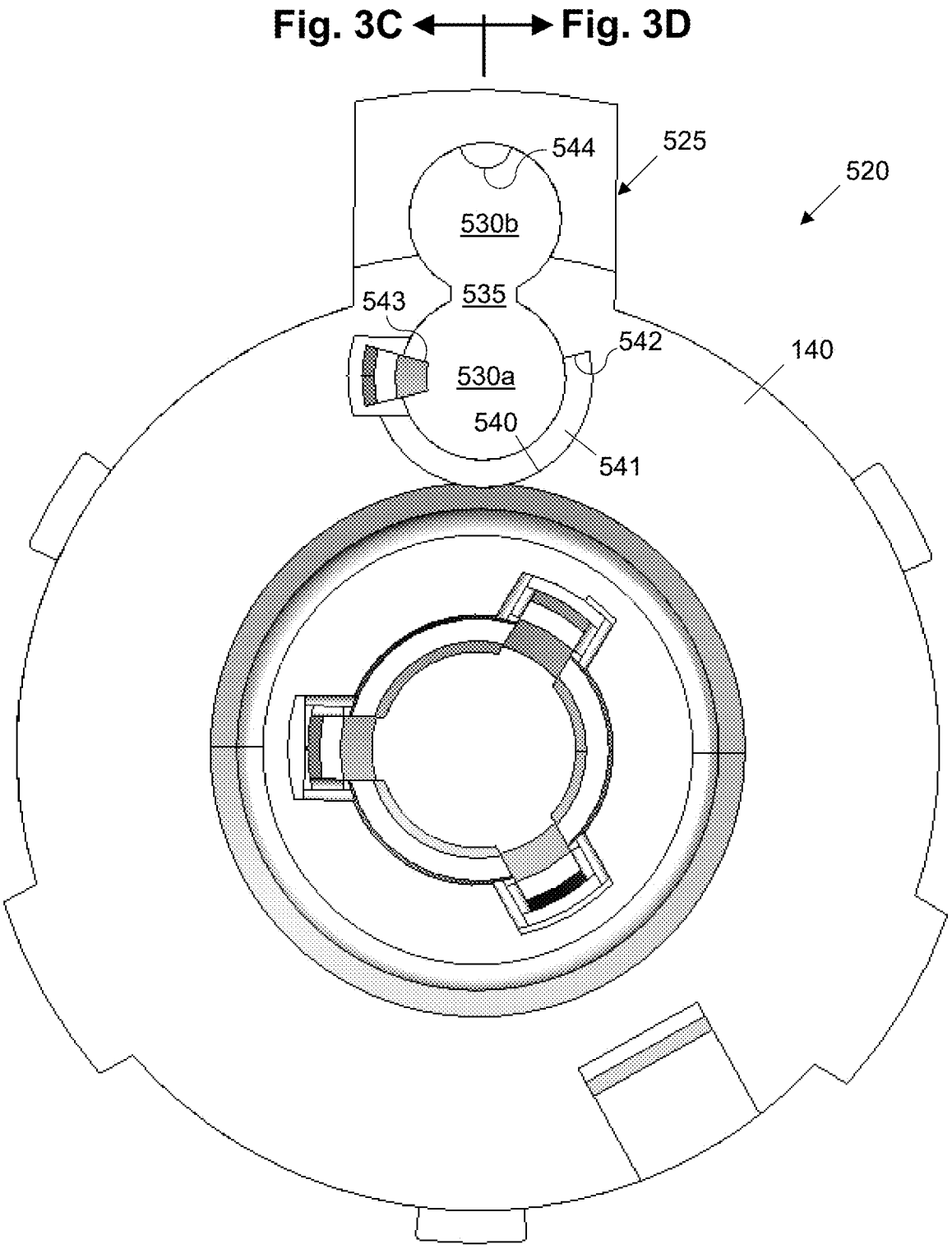
FIG. 3B is a top view of the end cap of FIG. 3A, according to one or more embodiments of the present disclosure.
Figure 3C:
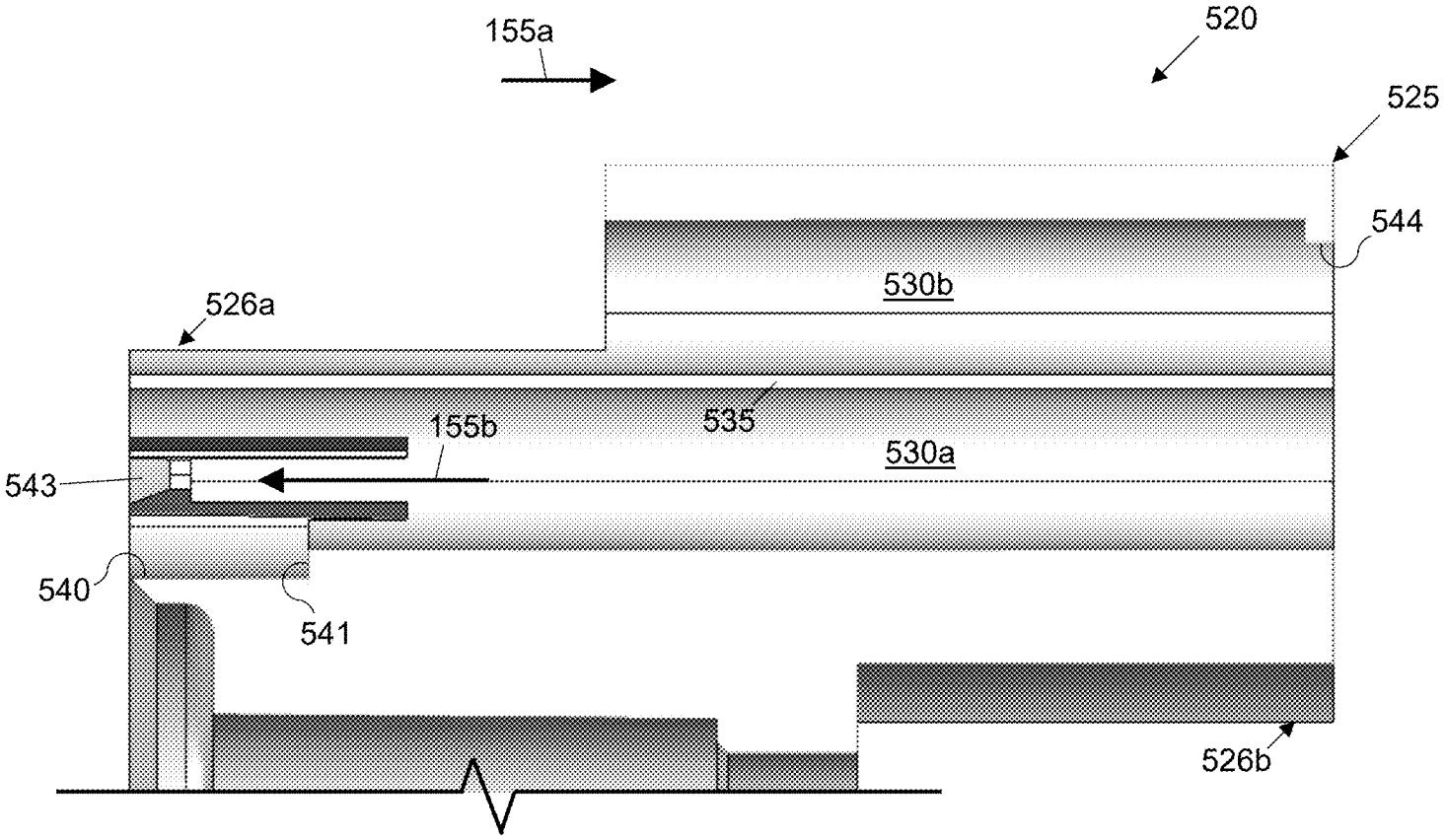
FIG. 3C is a cross-sectional view of the detonation housing of the end cap of FIG. 3A taken along the line 3C-3C of FIG. 3B, according to one or more embodiments of the present disclosure.
Figure 3D:
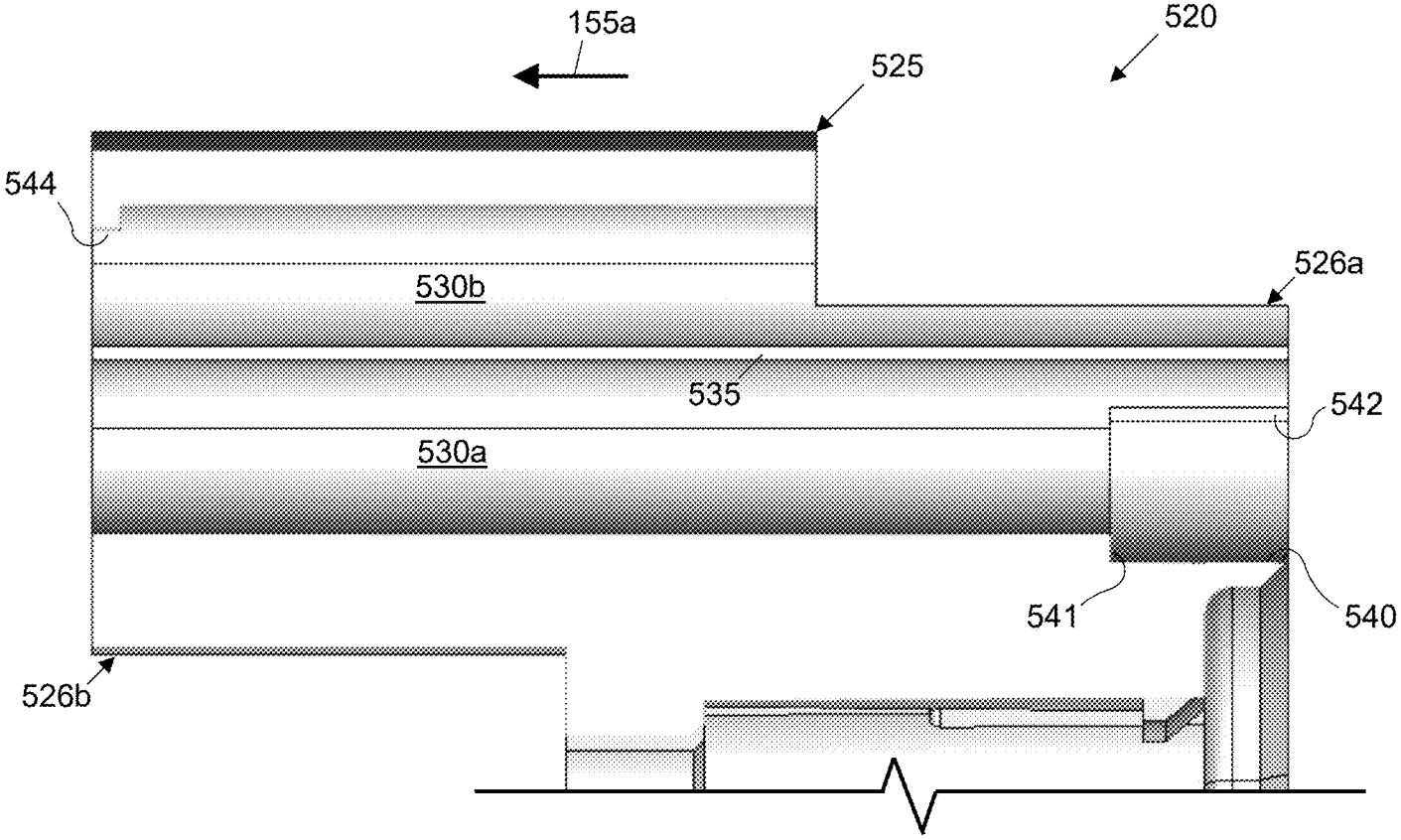
FIG. 3D is a cross-sectional view of the detonation housing of the end cap of FIG. 3A taken along the line 3D-3D of FIG. 3B, according to one or more embodiments of the present disclosure.
Figure 4A:
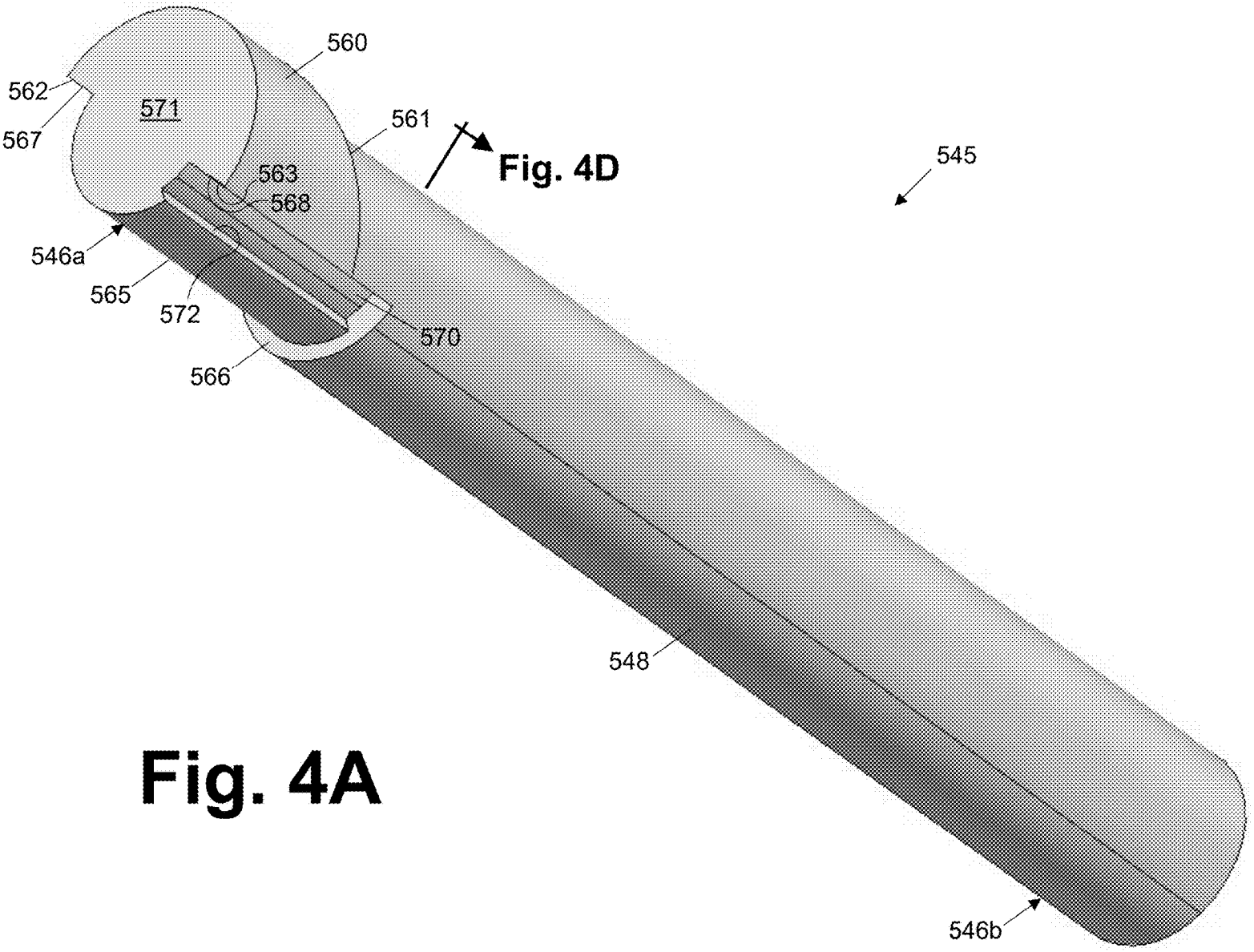
FIG. 4A is a perspective view of a ballistic interrupter receivable within the detonation housing shown in FIGS. 3A-3D, according to one or more embodiments of the present disclosure.
Figure 4B:
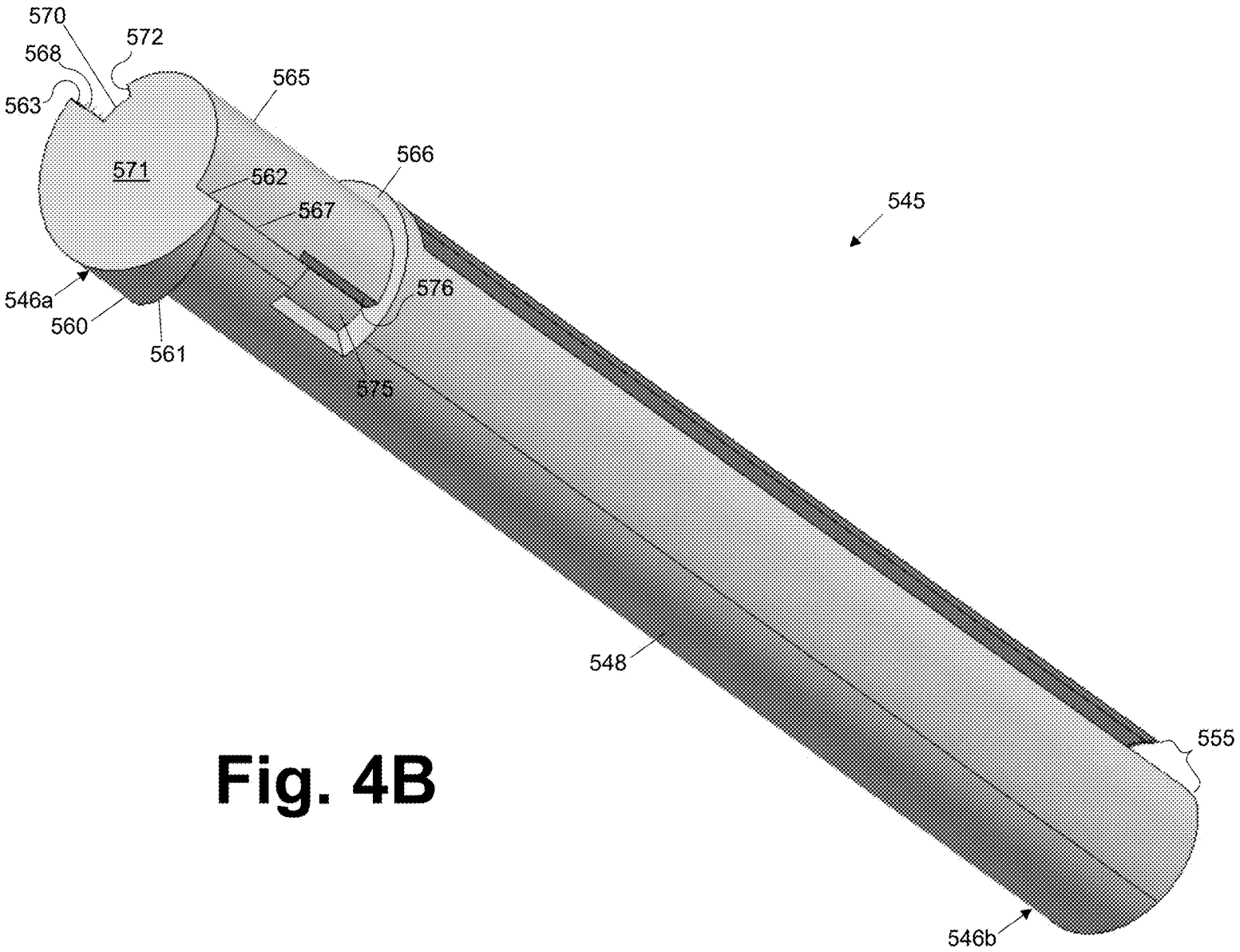
FIG. 4B is another perspective view of the ballistic interrupter of FIG. 4A, according to one or more embodiments of the present disclosure.
Figure 4C:
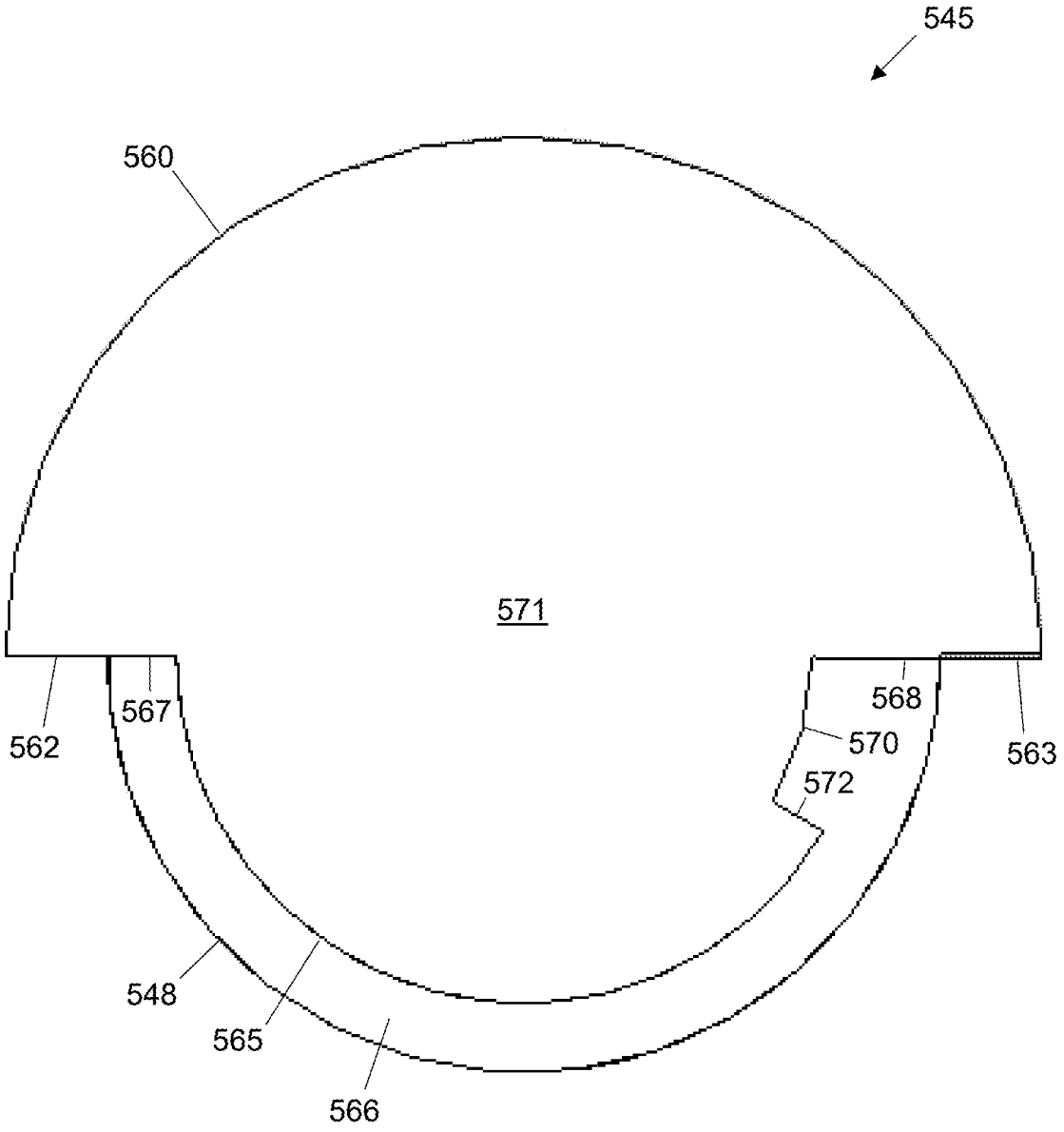
FIG. 4C is a top view of the ballistic interrupter of FIG. 4A, according to one or more embodiments of the present disclosure.
Figure 4D:
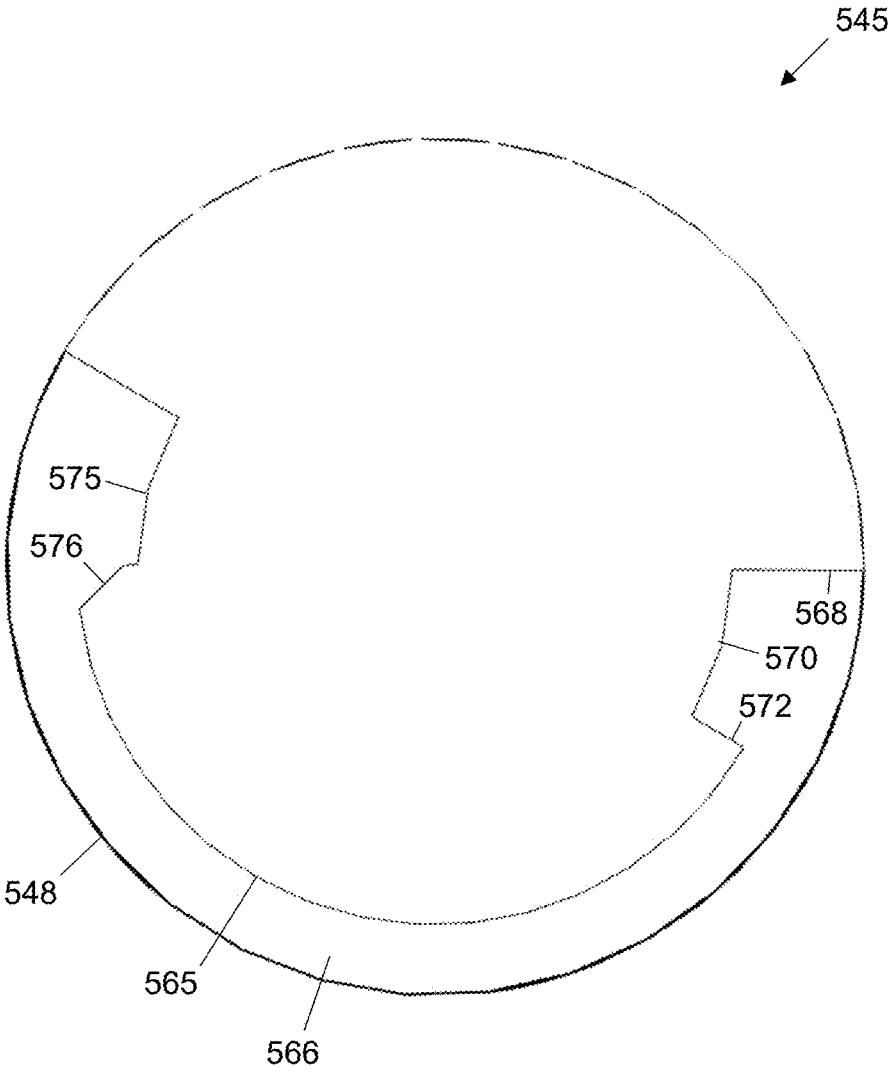
FIG. 4D is a cross-sectional view of the ballistic interrupter of FIG. 4A taken along the line 4D-4D of FIG. 4A, according to one or more embodiments of the present disclosure.
Figure 4E:
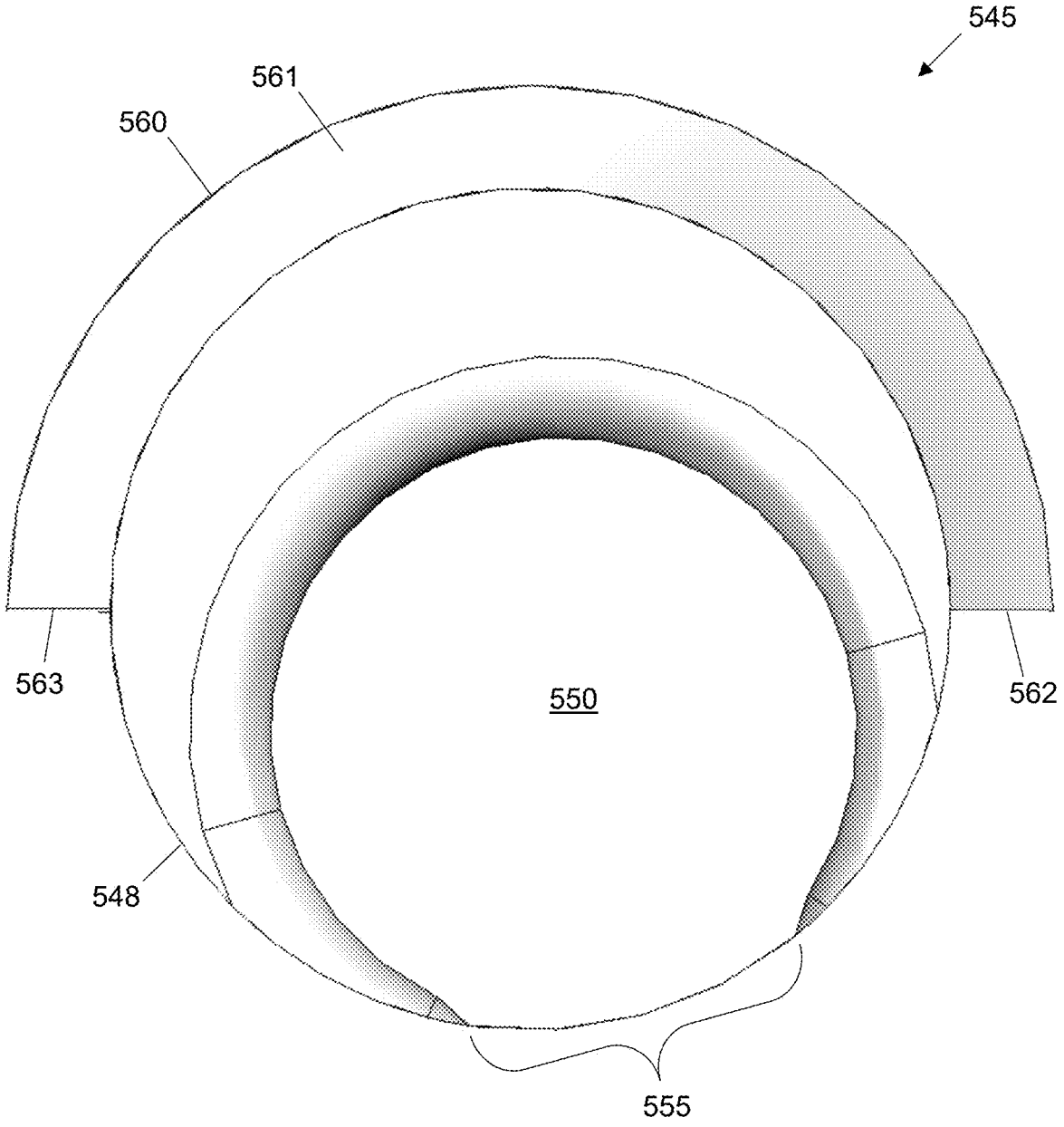
FIG. 4E is a bottom view of the ballistic interrupter of FIG. 4A, according to one or more embodiments of the present disclosure.

Referring to FIG. 2, in an embodiment, a pair of conductor subs are each generally referred to by the reference numerals 510*a-b,* and are illustrated together with a charge tube 511 of a perforating gun. One or more of the conductor subs (115, 380) shown and described in the '320 Application may be omitted in favor of the conductor sub(s) 510*a-b,* which conductor subs 510*a-b* each include features and/or components substantially identical to corresponding features and/or components of said conductor subs (115, 380); at least some of these substantially identical features and/or components are referred to herein by the same reference numerals as those set forth in the '320 Application. In addition to said substantially identical features and/or components, the conductor subs 510*a-b* each include opposing axial recesses 515*a-b.* The opposing axial recesses 515*a-b* are each tapered outwardly from the corresponding internal face (340*a,* 340*b*) to the corresponding end portion (305*a,* 305*b*). This outward tapering of the opposing axial recesses 515*a-b* decreases the likelihood that the charge tube 511 will get stuck inside the conductor subs 510*a-b,* making disassembly easier, cleaner, less time-consuming, and less expensive (i.e., at least by reducing the likelihood of damage to the conductor subs 510*a-b*). In one or more embodiments, the opposing axial recesses 515*a-b* are also each "shallower" than the corresponding axial recesses of the conductor subs (115, 380) shown and described in the '320 Application.

Referring to FIGS. 3A-3D, in an embodiment, an end cap is generally referred to by the reference numeral 520. One or more of the end caps (135) shown and described in the '320 Application may be omitted in favor of the end cap 520, which end cap 520 includes features and/or components substantially identical to corresponding features and/or components of said end caps (135); at least some of these substantially identical features and/or components are referred to herein by the same reference numerals as those set forth in the '320 Application. In addition to said substantially identical features and/or components, the end cap 520 includes a detonation housing 525, which is or includes a body portion forming a part of, connected to, integrally formed with, or any combination of the foregoing with respect to, the remainder of the end cap 520. The detonation housing 525 extends axially from an end portion 526*a* (at the outer periphery of the end plate 140 of the end cap 520) to an end portion 526*b* (in the direction 155*a*). The detonation housing 525 defines a pair of bores 530*a-b.* In one or more embodiments, the bores 530*a-b* extend in a parallel relation, intersecting to define a slot 535 therealong in the detonation housing 525.

The bore 530*a* extends from the end portion 526*a* to the end portion 526*b* of the detonation housing 525, and includes a radially-enlarged portion 540 formed into the detonation housing 525 at the end portion 526*a*. The radially-enlarged portion 540 of the bore 530*a* defines an axially-facing shoulder 541 in the detonation housing 525, and extends circumferentially from a circumferentially-facing shoulder 542 (proximate one side of the slot 535) to a latching feature 543 (proximate the other side of the slot 535). The latching feature 543 extends axially from the detonation housing 525 (in the direction 155*b*). In one or more embodiments, the latching feature 543 is located along, or proximate, a circumference of the radially-enlarged portion 540. In one or more embodiments, the latching feature 543 is radially-inwardly-facing. The bore 530*b* may be shorter than the bore 530*a,* extending from the end portion 526*b* of the detonation housing 525 toward the end portion 526*a*. The detonation housing 525 further includes a retaining feature 544 associated with the bore 530*b* at or near the end portion 526*b*.

Figure 11:
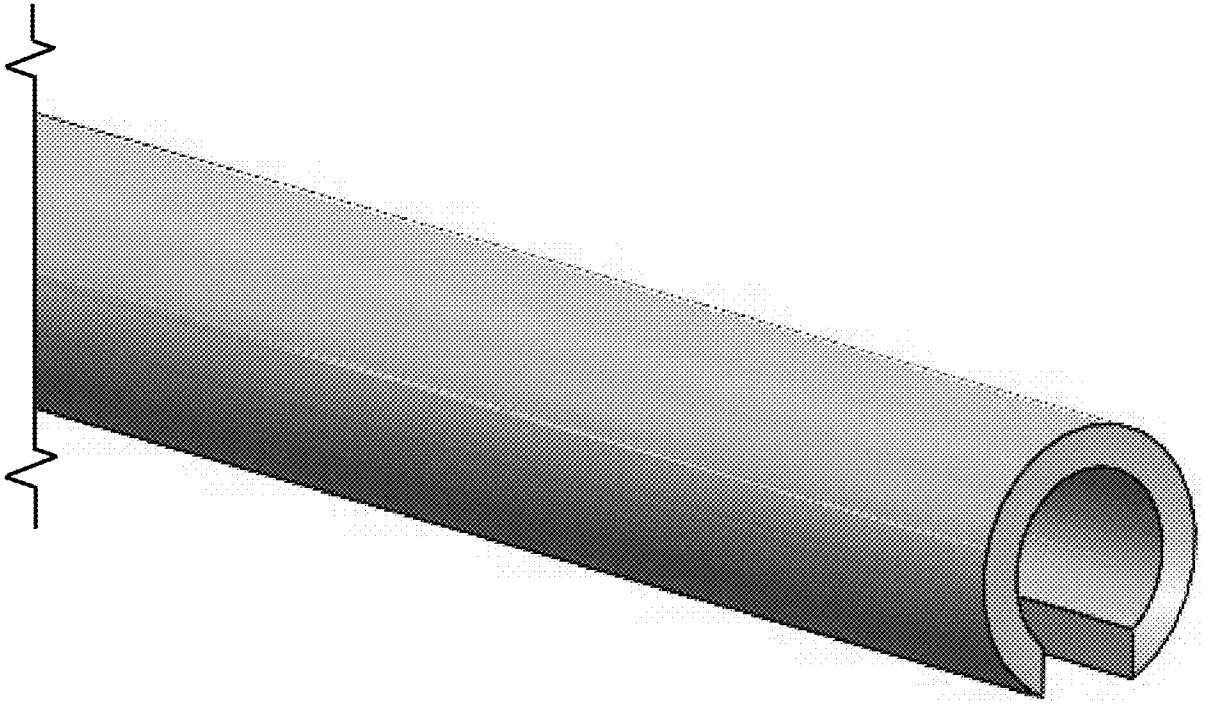
FIG. 11 is a truncated perspective view of yet another ballistic interrupter, according to one or more embodiments of the present disclosure.

Referring to FIGS. 4A-4E, in an embodiment, a ballistic interrupter (or "switch"; or "shunt") is generally referred to by the reference numeral 545. In one or more embodiments, the ballistic interrupter 545 includes an elongated body, which may be generally cylindrical in shape. However, in other embodiments, the ballistic interrupter 545 may be (or include) another generally non-cylindrical shape (e.g., ovular prism, square prism, rectangular prism, trapezoidal prism, pentagonal prism, hexagonal prism, etc.). In any case, the ballistic interrupter 545 acts as a mechanical barrier rotatably actuable to a "disarmed" state or configuration to impede a detonator's output, thereby preventing initiation/detonation of a detonating cord. In one or more embodiments, the ballistic interrupter 545 may be represented diagrammatically as a block labeled "BALLISTIC INTERRUPTER" extending between the block labeled "DETONATOR" and the block labeled "BALLISTIC(S)" in FIG. 13 of the '320 Application. The elongated body of the ballistic interrupter 545 defines opposing end portions 546*a-b* and an exterior surface 548 extending from the end portion 546*b* toward the end portion 546*a*. In one or more embodiments, the exterior surface 548 is cylindrical in shape. A bore 550 is formed in the elongated body of the ballistic interrupter 545, extending from the end portion 546*b* toward the end portion 546*a,* intersecting the exterior surface 548 to define a slot 555 therealong in the ballistic interrupter 545. In one or more embodiments, as in FIGS. 4A-4E, the bore 550 extends along a central axis that is offset from a corresponding central axis of the ballistic interrupter 545 (e.g., a central axis of the exterior surface 548, which, as discussed above, may be cylindrical or non-cylindrical in shape). Alternatively, in one or more other embodiments, the bore 550 extends along a central axis that is generally co-axial with the corresponding central axis of the ballistic interrupter 545, as shown in FIG. 11.

Figure 9A:
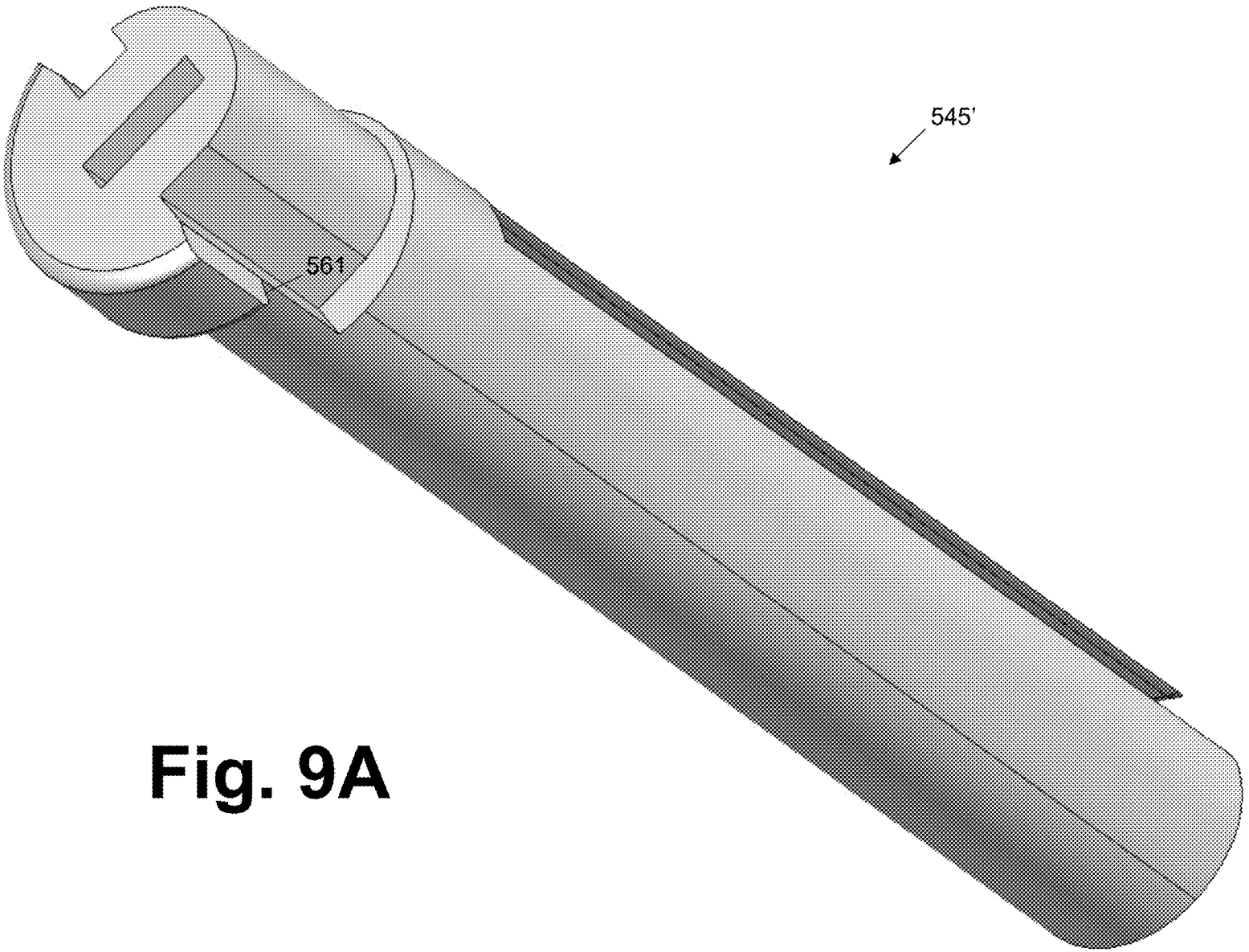
FIG. 9A is a perspective view of another ballistic interrupter receivable within the detonation housing shown in FIGS. 3A-3D, according to one or more embodiments of the present disclosure.
Figure 9B:
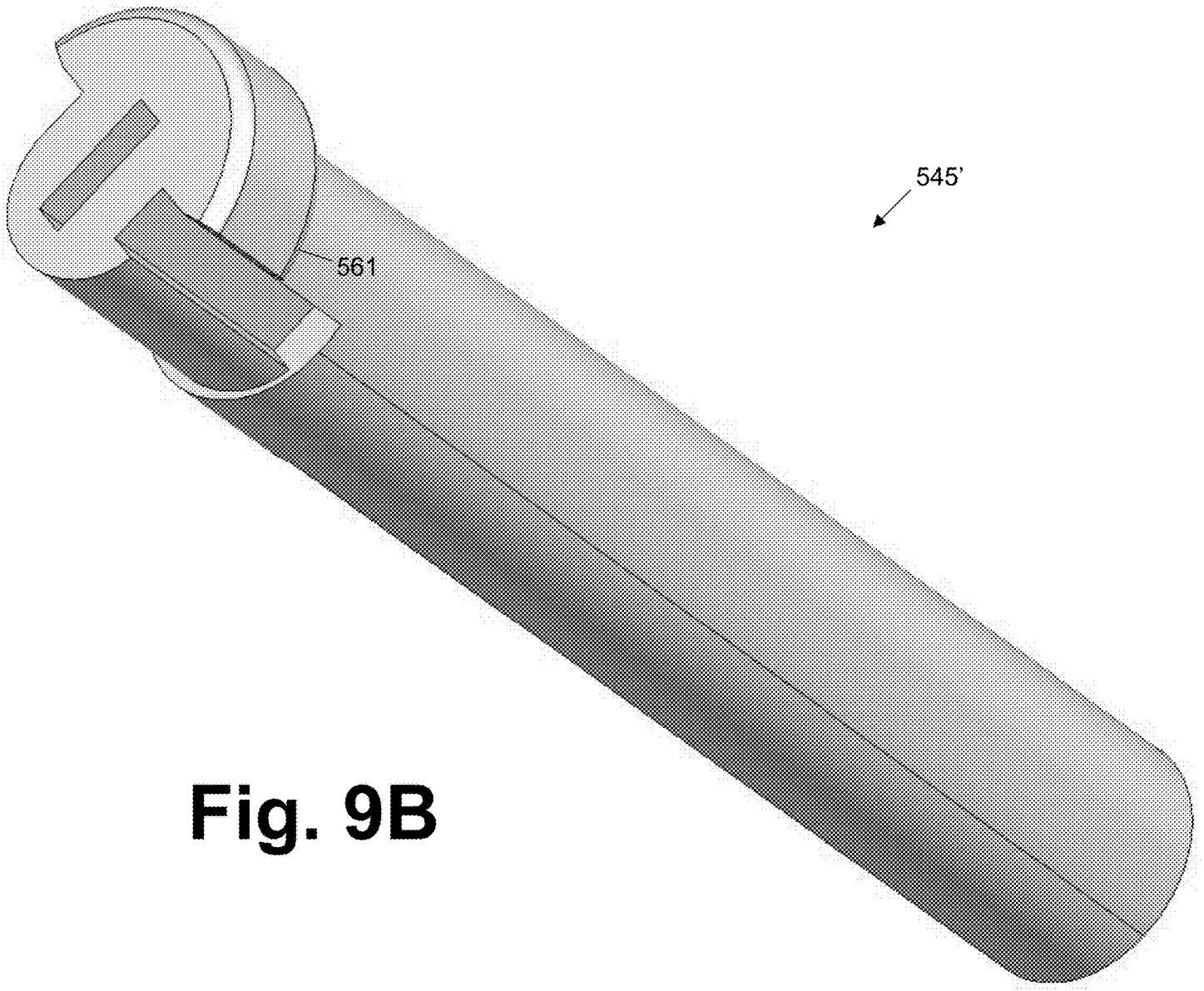
FIG. 9B is another perspective view of the another ballistic interrupter of FIG. 9A, according to one or more embodiments of the present disclosure.
Figure 9C:
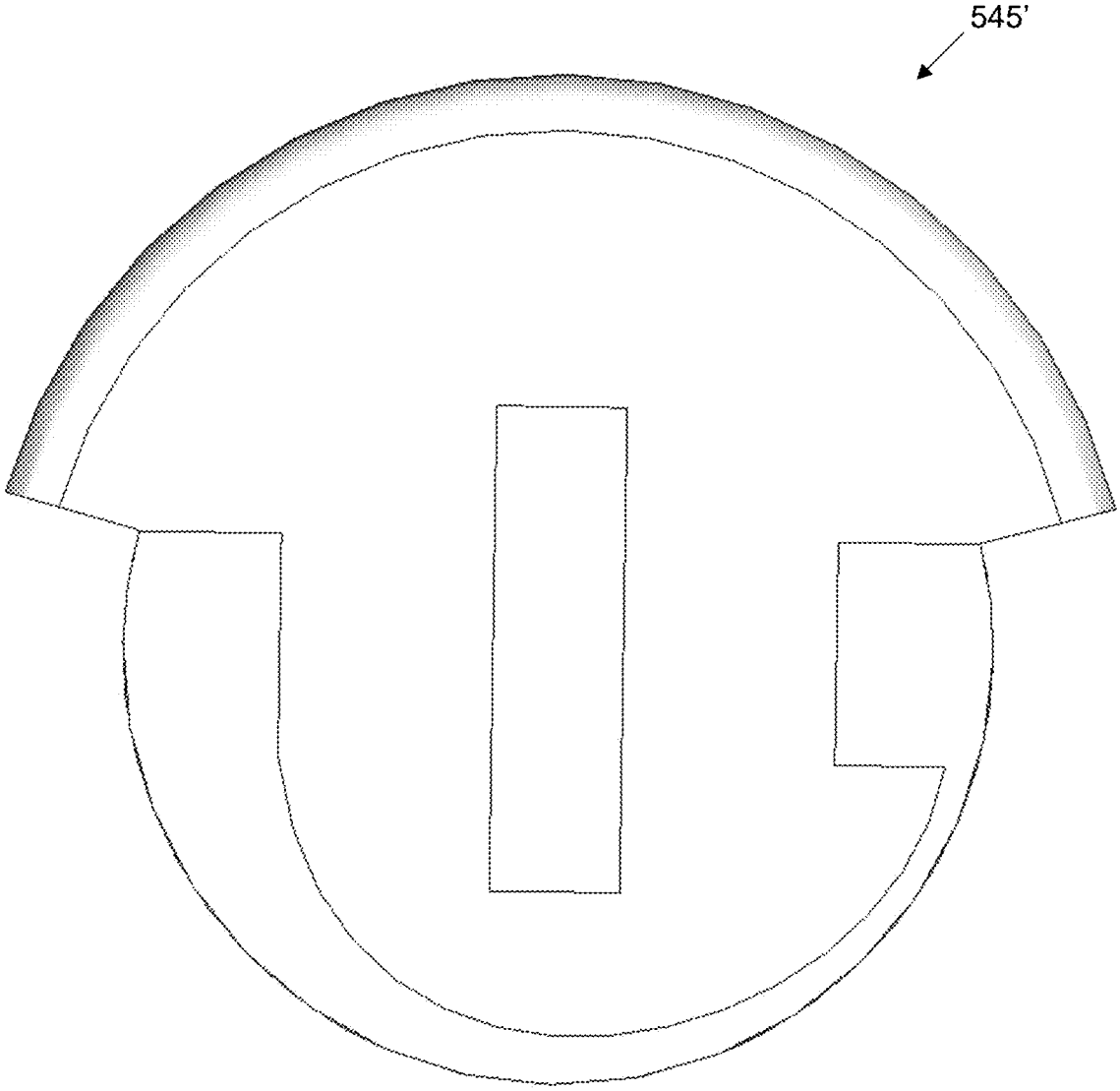
FIG. 9C is a top view of the ballistic interrupter of FIG. 9A, according to one or more embodiments of the present disclosure.

The ballistic interrupter 545 includes a radially-enlarged portion 560 at the end portion 546*a*. Although shown extending along a central axis that is generally co-axial with a corresponding central axis of the ballistic interrupter 545 (e.g., the central axis of the exterior surface 548), the radially-enlarged portion 560 may instead extend along a central axis that is offset from the corresponding central axis of the ballistic interrupter 545. In such embodiments, rotation of the radially-enlarged portion 560 of the ballistic interrupter 545 within the radially-enlarged portion 540 of the bore 530*a* causes the corresponding central axis of the ballistic interrupter 545 to move towards (or away from) the bore 530*b*. The radially-enlarged portion 560 defines an axially-facing shoulder 561 in the ballistic interrupter 545, extending circumferentially from a circumferentially-facing shoulder 562 (proximate one side of the slot 555) to a circumferentially-facing shoulder 563 (proximate the other side of the slot 555). In one or more embodiments, the axially-facing shoulder 561 extends helically (toward the end portion 546*b*) from the circumferentially-facing shoulder 562 to the circumferentially-facing shoulder 563. However, in other embodiments, the axially-facing shoulder 561 does not extend helically (as shown in FIGS. 9A-9C).

The ballistic interrupter 545 also includes a radially-reduced portion 565 at the end portion 546*a*. The radially-reduced portion 565 defines an axially-facing shoulder 566 in the ballistic interrupter 545, extending circumferentially from a circumferentially-facing shoulder 567 (which is circumferentially aligned with the circumferentially-facing shoulder 562) to a circumferentially-facing shoulder 568 (which is circumferentially aligned with the circumferentially-facing shoulder 563). A radial recess 570 is formed into the ballistic interrupter 545, adjacent the circumferentially-facing shoulder 568. In one or more embodiments, the radial recess extends axially from the axially-facing shoulder 566 to an end face 571 of the ballistic interrupter 545. The radial recess 570 defines a circumferentially-facing shoulder 572 in the ballistic interrupter 545, adjacent the radially-reduced portion 565 and opposite the circumferentially-facing shoulder 568. Likewise, a radial recess 575 is formed into the ballistic interrupter 545, proximate the circumferentially-facing shoulder 567. In one or more embodiments, the radial recess 575 extends axially from the axially-facing shoulder 566 toward the end portion 546*a*, terminating before reaching the end face 571 of the ballistic interrupter 545. Moreover, the radial recess 575 defines a ramped surface 576 in the ballistic interrupter 545, adjacent the radially-reduced portion 565. However, in those embodiment(s) in which the axially-facing shoulder 561 does not extend helically, the radial recess 575 may extend axially from the axially-facing shoulder 566 to the end face 571 of the ballistic interrupter 545 (as shown in FIGS. 9A-9C).

Figure 5:
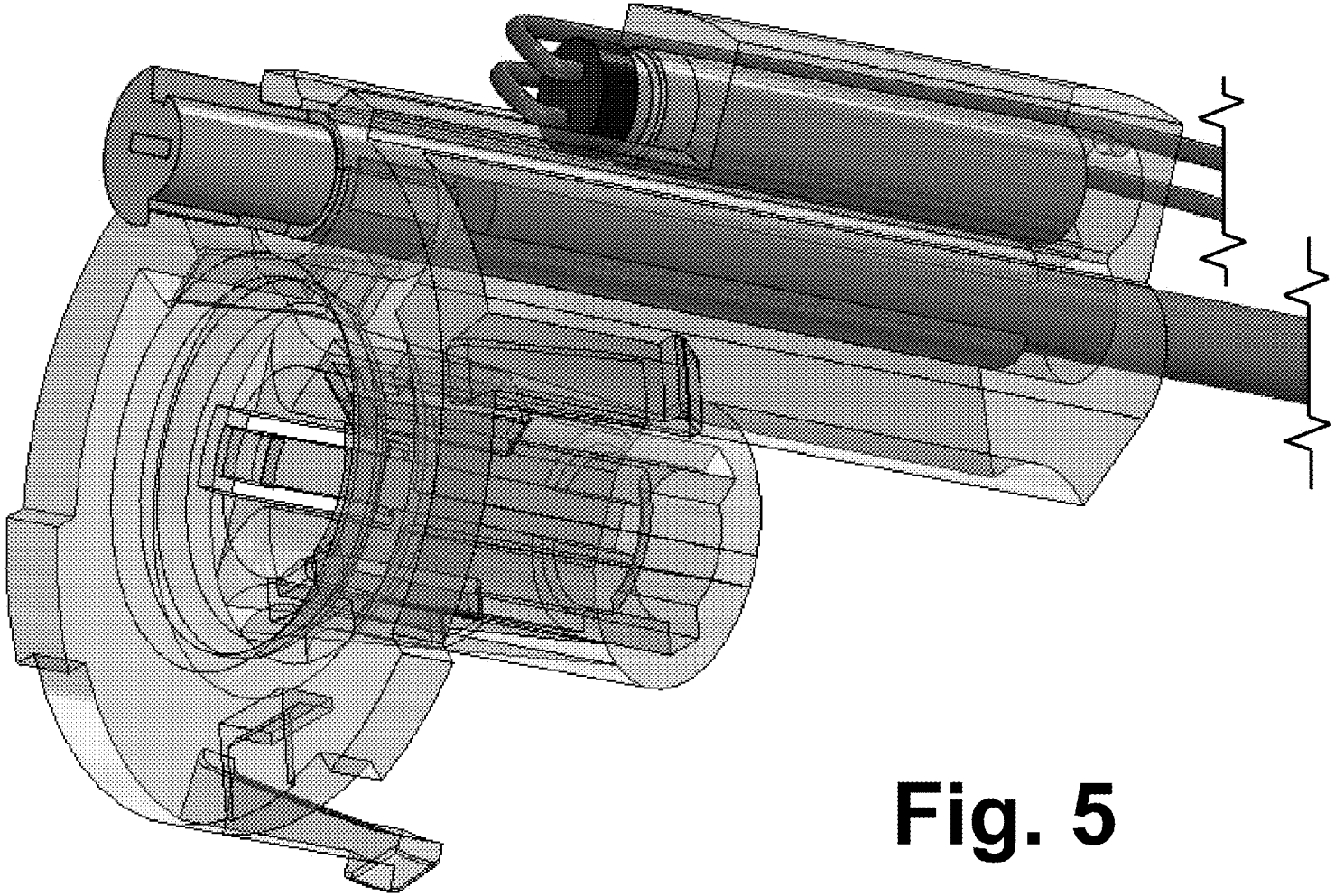
FIG. 5 is a perspective view of the end cap of FIGS. 3A-3D (shown in a semitransparent state) and the ballistic interrupter of FIGS. 4A-4E assembled together with a detonator and a detonating cord, according to one or more embodiments of the present disclosure.
Figure 6A:
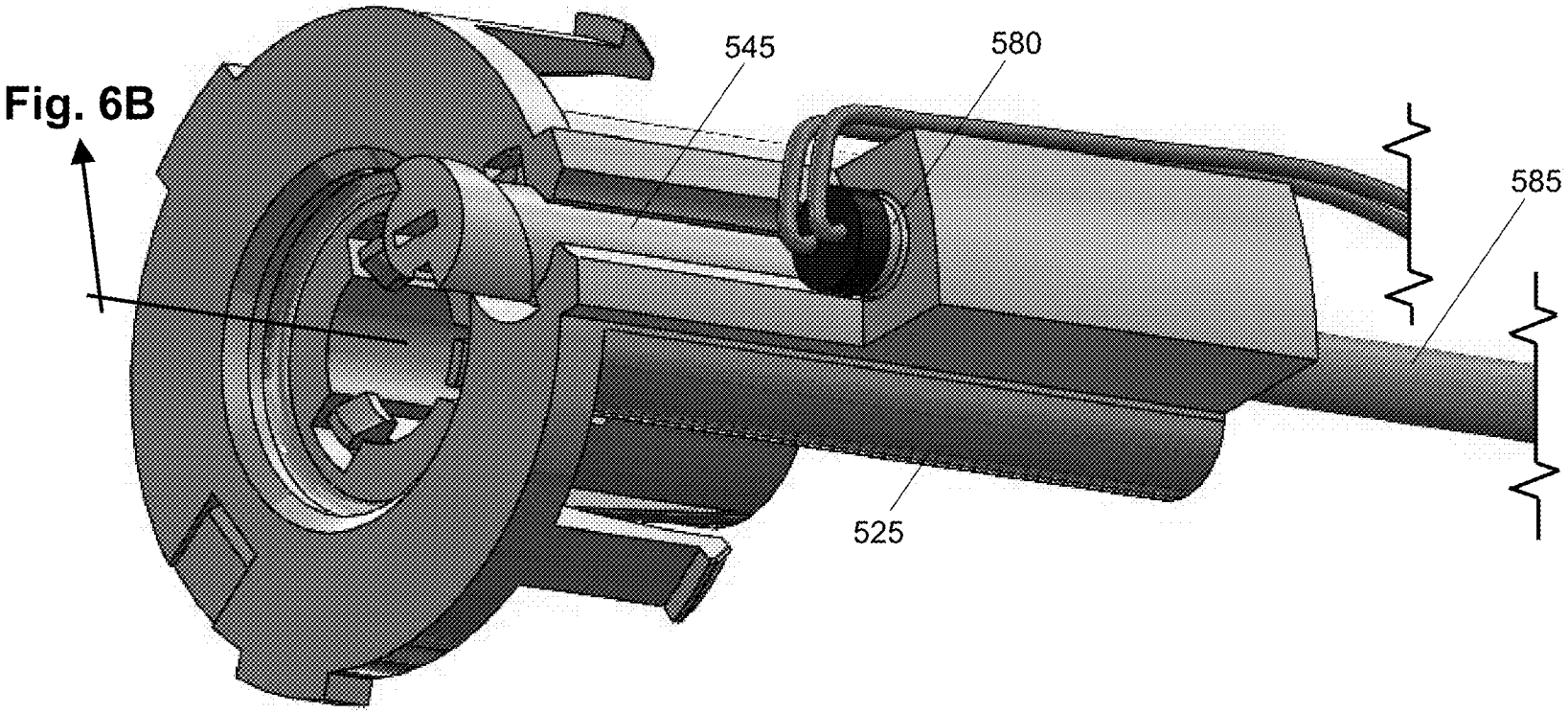
FIG. 6A is a perspective view of the assembly of FIG. 5 in a disarmed state or configuration, according to one or more embodiments of the present disclosure.
Figure 6B:
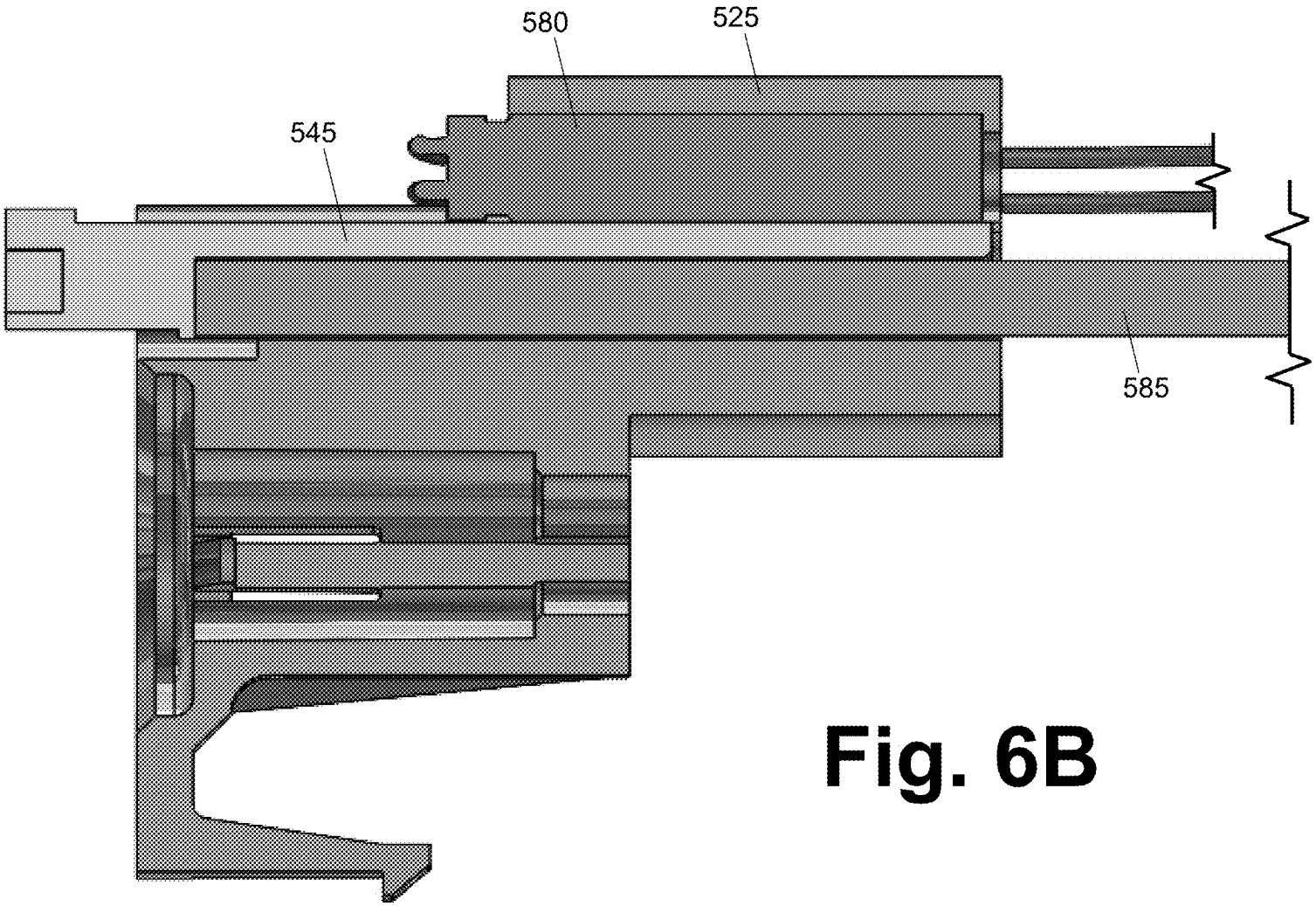
FIG. 6B is a cross-sectional view of the assembly of FIG. 5 in the disarmed state or configuration of FIG. 6A (taken along the line 6B-6B of FIG. 6A), according to one or more embodiments of the present disclosure.
Figure 6C:
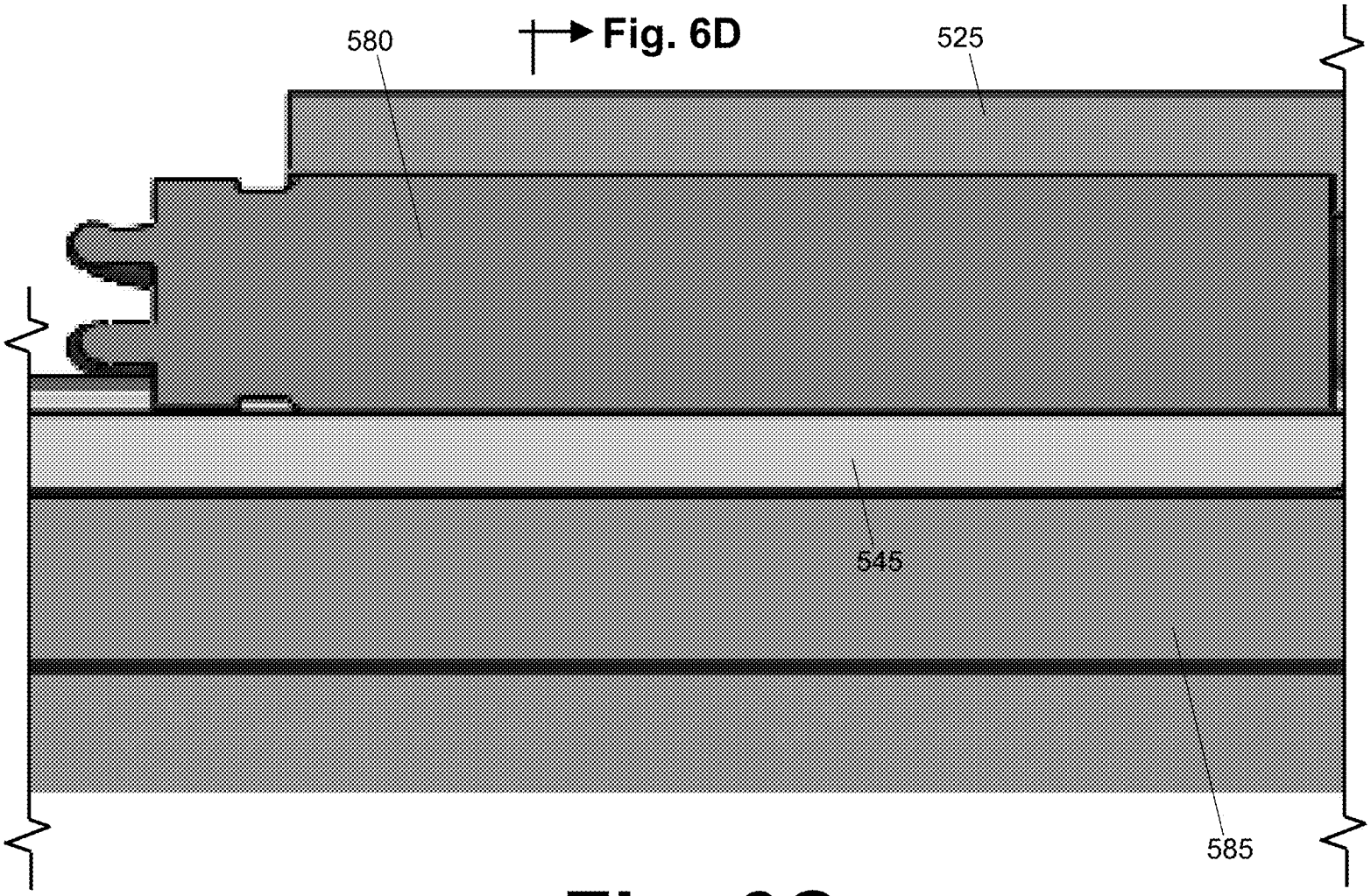
FIG. 6C is an enlarged cross-sectional view of assembly of FIG. 6B in the disarmed state or configuration, according to one or more embodiments of the present disclosure.
Figure 6D:
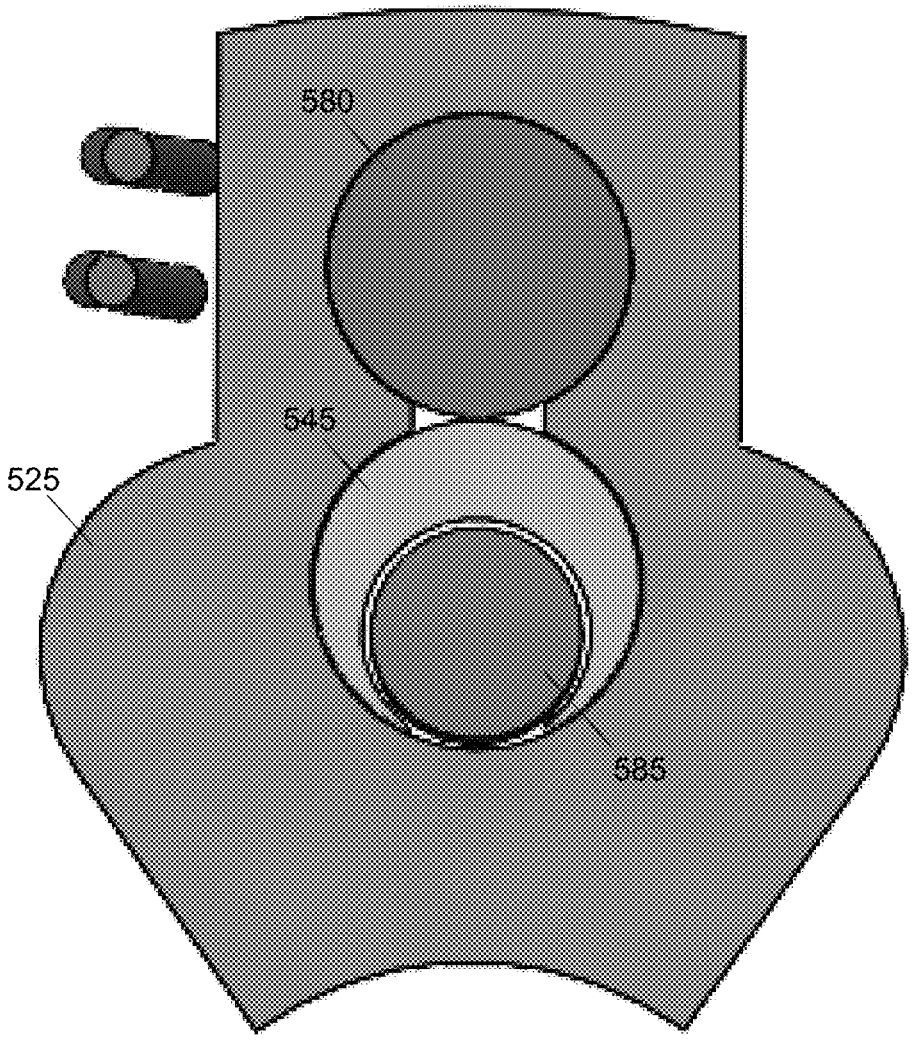
FIG. 6D is a cross-sectional view of the assembly of FIG. 6C (taken along the line 6D-6D of FIG. 6C) in the disarmed state or configuration, according to one or more embodiments of the present disclosure.
Figure 7A:
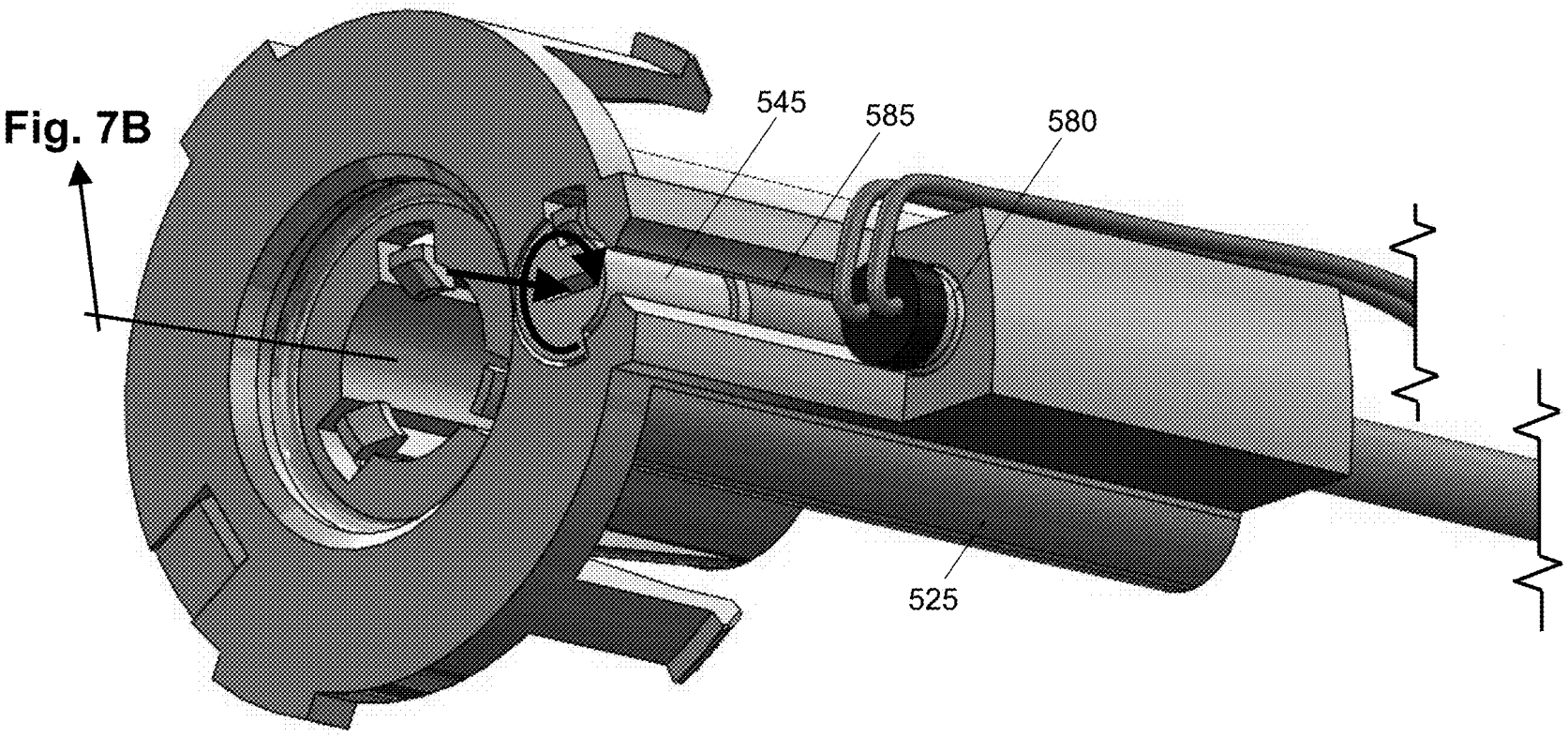
FIG. 7A is a perspective view of the assembly of FIG. 5 in an armed state or configuration, according to one or more embodiments of the present disclosure.
Figure 7B:
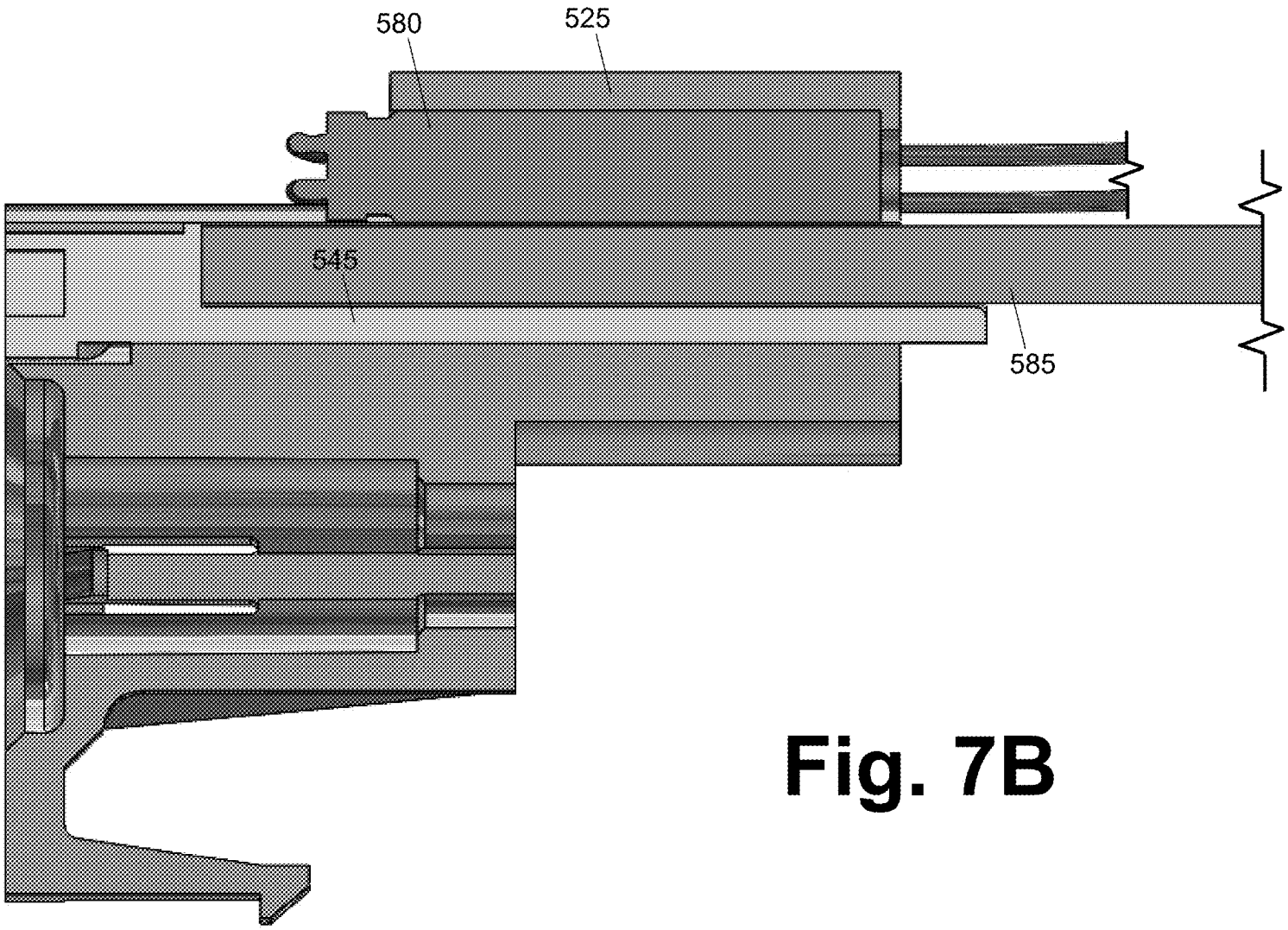
FIG. 7B is a cross-sectional view of the assembly of FIG. 5 in the armed state or configuration of FIG. 7A (taken along the line 7B-7B of FIG. 7A), according to one or more embodiments of the present disclosure.
Figure 7C:
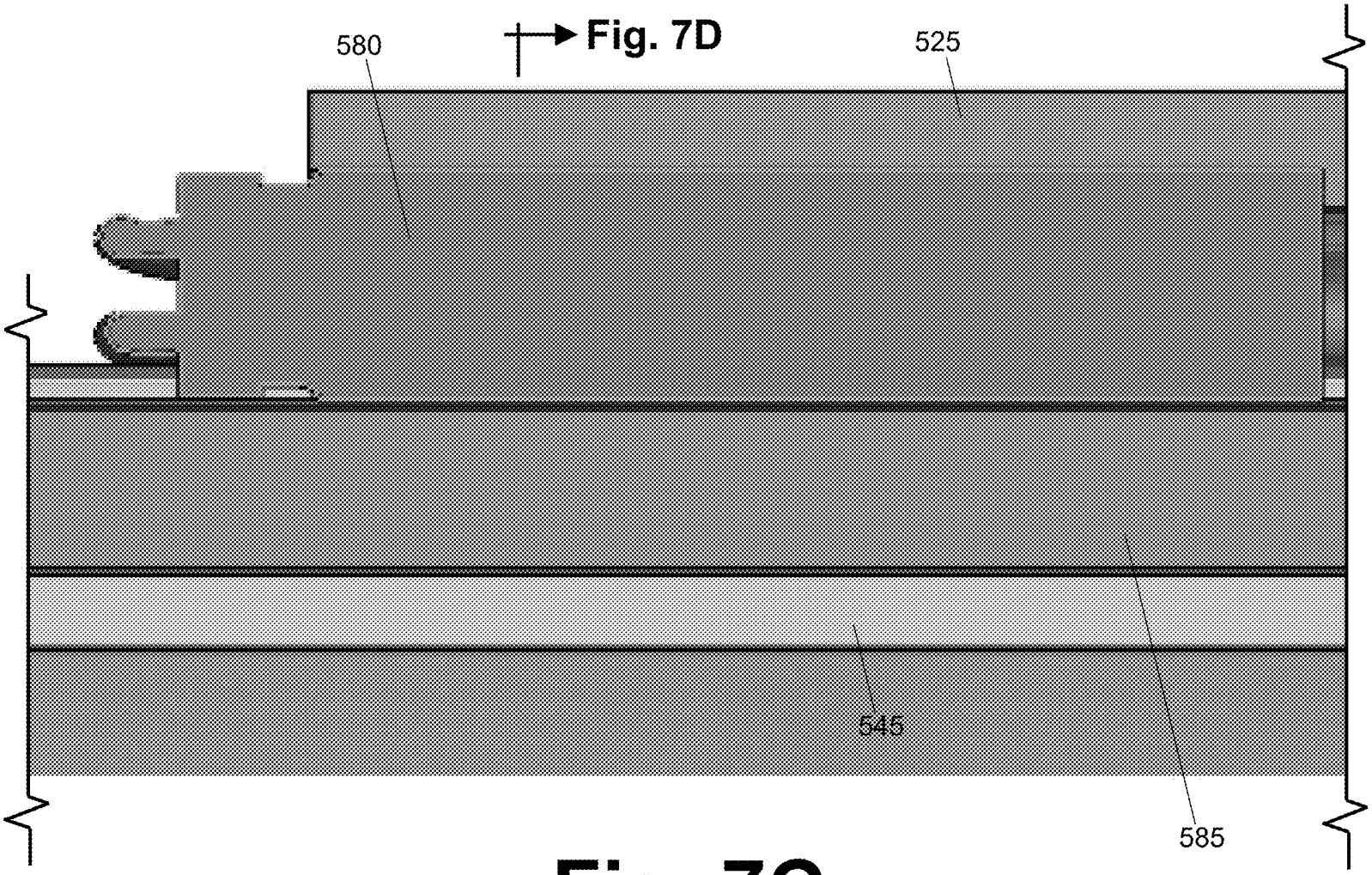
FIG. 7C is an enlarged cross-sectional view of assembly of FIG. 7B in the armed state or configuration, according to one or more embodiments of the present disclosure.
Figure 7D:
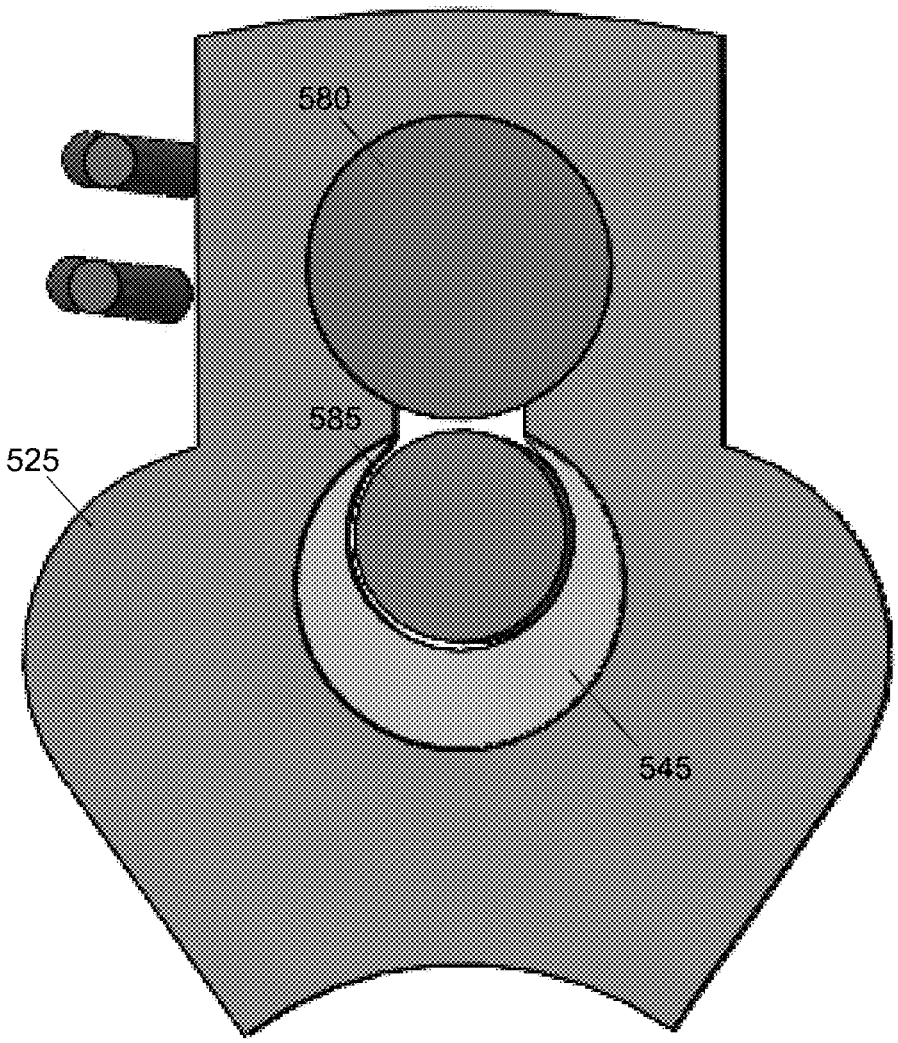
FIG. 7D is a cross-sectional view of the assembly of FIG. 7C (taken along the line 7D-7D of FIG. 7C) in the armed state or configuration, according to one or more embodiments of the present disclosure.

Referring to FIG. 5, in an embodiment, the end cap 520 (shown in a semitransparent state) and the ballistic interrupter 545 are assembled together with a detonator 580 and a detonating cord 585. More particularly, the detonating cord 585 is received in the bore 550 of the ballistic interrupter 545, which ballistic interrupter 545 is itself received in the bore 530*a* of the detonation housing 525. The detonator 580, in turn, is received in the bore 530*b* of the detonation housing 525.

Referring to FIGS. 6A-6D, in an embodiment, the assembly of FIG. 5 is rotatably actuable to a disarmed state or configuration, in which the ballistic interrupter 545 is adapted to interrupt ballistic communication between the detonator 580 and the detonating cord 585. Specifically, in the disarmed state or configuration, the slot 555 in the exterior surface 548 of the ballistic interrupter 545 is rotationally oriented away from the slot 535 between the bores 530*a-b* of the detonation housing 525. As a result of this rotational orientation, the ballistic interrupter 545 obstructs ballistic communication between the detonator 580 and the detonating cord 585. Moreover, the latching feature 543 extends into the radial recess 575 to retain the ballistic interrupter 545 in the disarmed state or configuration. Alternatively, in one or more other embodiments, the latching feature 543 and/or the radial recess 575 may be omitted.

Referring to FIGS. 7A-7D, in an embodiment, the assembly of FIG. 5 is rotatably actuable to an armed state or configuration, in which the ballistic interrupter 545 is adapted to permit ballistic communication between the detonator 580 and the detonating cord 585. Specifically, in the armed state or configuration, the slot 555 in the exterior surface 548 of the ballistic interrupter 545 is rotationally oriented toward the slot 535 between the bores 530*a-b* of the detonation housing 525. As a result of this rotational orientation, the ballistic interrupter 545 permits ballistic communication between the detonator 580 and the detonating cord 585. Moreover, the latching feature 543 extends into the radial recess 570 to retain the ballistic interrupter 545 in the armed state or configuration. In those embodiment(s) in which the axially-facing shoulder 561 extends helically, the ballistic interrupter 545 is actuable from the first configuration to the second configuration by exerting an axial force (and, optionally, a torsional force) against the ballistic interrupter (as shown by the arrows in FIG. 7A), causing: the axially-facing shoulder 561 of the ballistic interrupter 545 to ride along the circumferentially-facing shoulder 542 of the detonation housing 525; the latching feature 543 to ride up the ramped surface 576 and out of the radial recess 575; and the latching feature 543 to snap into the radial recess 570. Alternatively, in one or more other embodiments, the latching feature 543 and/or the radial recess 570 may be omitted.

Figure 8A:
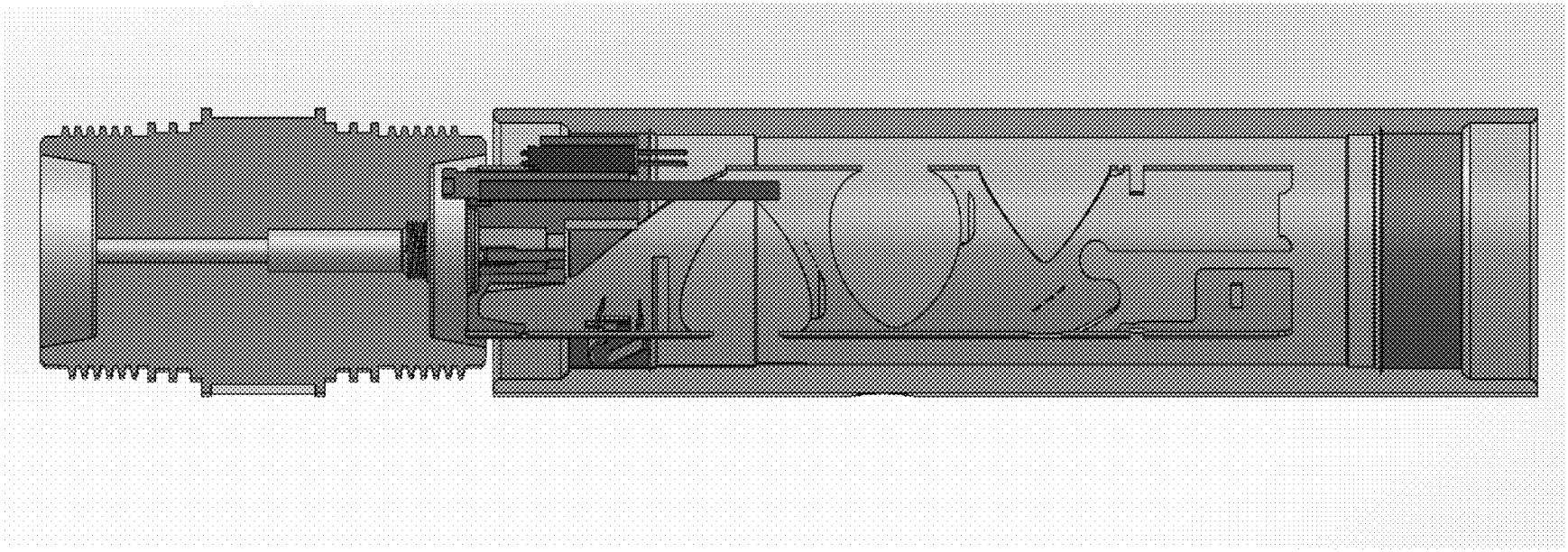
FIG. 8A is a cross-sectional view of the assembly of FIG. 5 in the disarmed state or configuration of FIGS. 6A-6D being assembled into a carrier tube to which a conductor sub is to be coupled, according to one or more embodiments of the present disclosure.
Figure 8B:
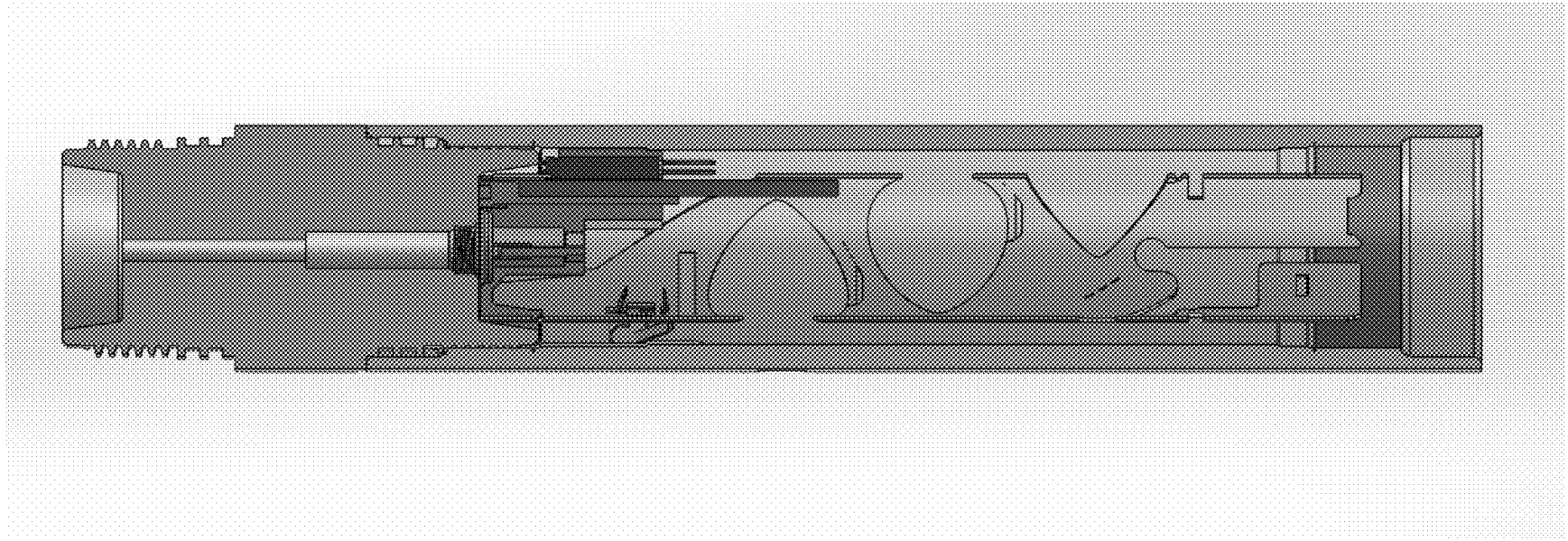
FIG. 8B is a cross-sectional view of the assembly of FIG. 5 in the armed state or configuration of FIGS. 7A-7D assembled into the carrier tube with the conductor sub coupled to the carrier tube, according to one or more embodiments of the present disclosure.

Referring to FIGS. 8A-8B, in an embodiment, the assembly of FIG. 5 is shown in the disarmed state or configuration as part of a charge cartridge (which charge cartridge also includes a charge tube into which the assembly of FIG. 5 is received) being assembled into a carrier tube to which a conductor sub is to be coupled (as shown in FIG. 8A), and in the armed state or configuration assembled into the carrier tube with the conductor sub coupled to the carrier tube (as shown in FIG. 8B). In one or more embodiments, assembling the charge cartridge into the carrier tube and coupling the conductor sub to the carrier tube provides the axial force necessary to actuate the ballistic interrupter 545 from the disarmed state or configuration to the armed state or configuration. Additionally, or alternatively, the ballistic interrupter 545 may be actuated manually (with or without a separate tool) from the disarmed state or configuration to the armed state or configuration.

Referring to FIGS. 9A-9C, in an embodiment, the ballistic interrupter 545 is omitted in favor of a ballistic interrupter 545' receivable into the detonation housing 525. The ballistic interrupter 545' is substantially identical to the ballistic interrupter 545, except that the axially-facing shoulder 561 of the ballistic interrupter 545' does not extend helically.

Figure 10:
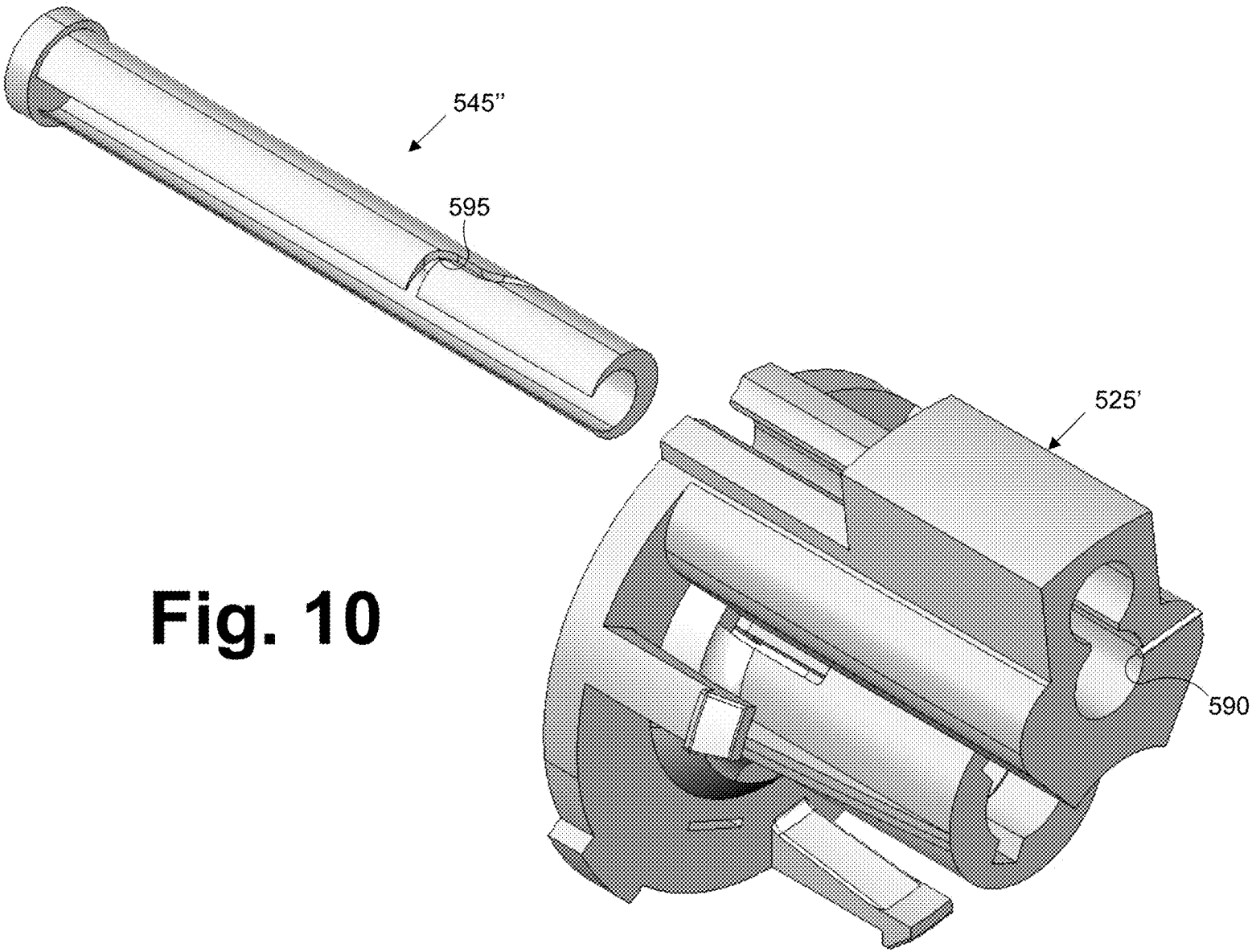
FIG. 10 is an exploded perspective view of yet another ballistic interrupter receivable within another detonation housing, according to one or more embodiments of the present disclosure.

Referring to FIG. 10, in an embodiment, the detonation housing 525 is omitted in favor of a detonation housing 525' and the ballistic interrupter 545 is omitted in favor of a ballistic interrupter 545" receivable into the detonation housing 525'. The detonation housing 525' includes a pin 590 overlapping the bore 530*a* at the end portion 526*b*. The ballistic interrupter 545" includes a groove 595 extending from the slot 555 and through the exterior surface 548 to guide the ballistic interrupter between the disarmed state or configuration and the armed state or configuration. Although not shown in FIG. 10, in one or more other embodiments, the detonation housing 525' may include the latching feature 543 (or another latching feature) adapted to interact with corresponding feature(s) of the ballistic interrupter 545" to retain the ballistic interrupter 545" in the disarmed state or configuration, the armed state or configuration, or both.

Referring to FIG. 11, in an embodiment, the ballistic interrupter 545 is modified or omitted in favor of a ballistic interrupter having a uniform wall thickness, which ballistic interrupter may or may not include any end feature(s), such as those shown in FIGS. 4A-4E, 9A-9C, or 10.

Figure 12A:
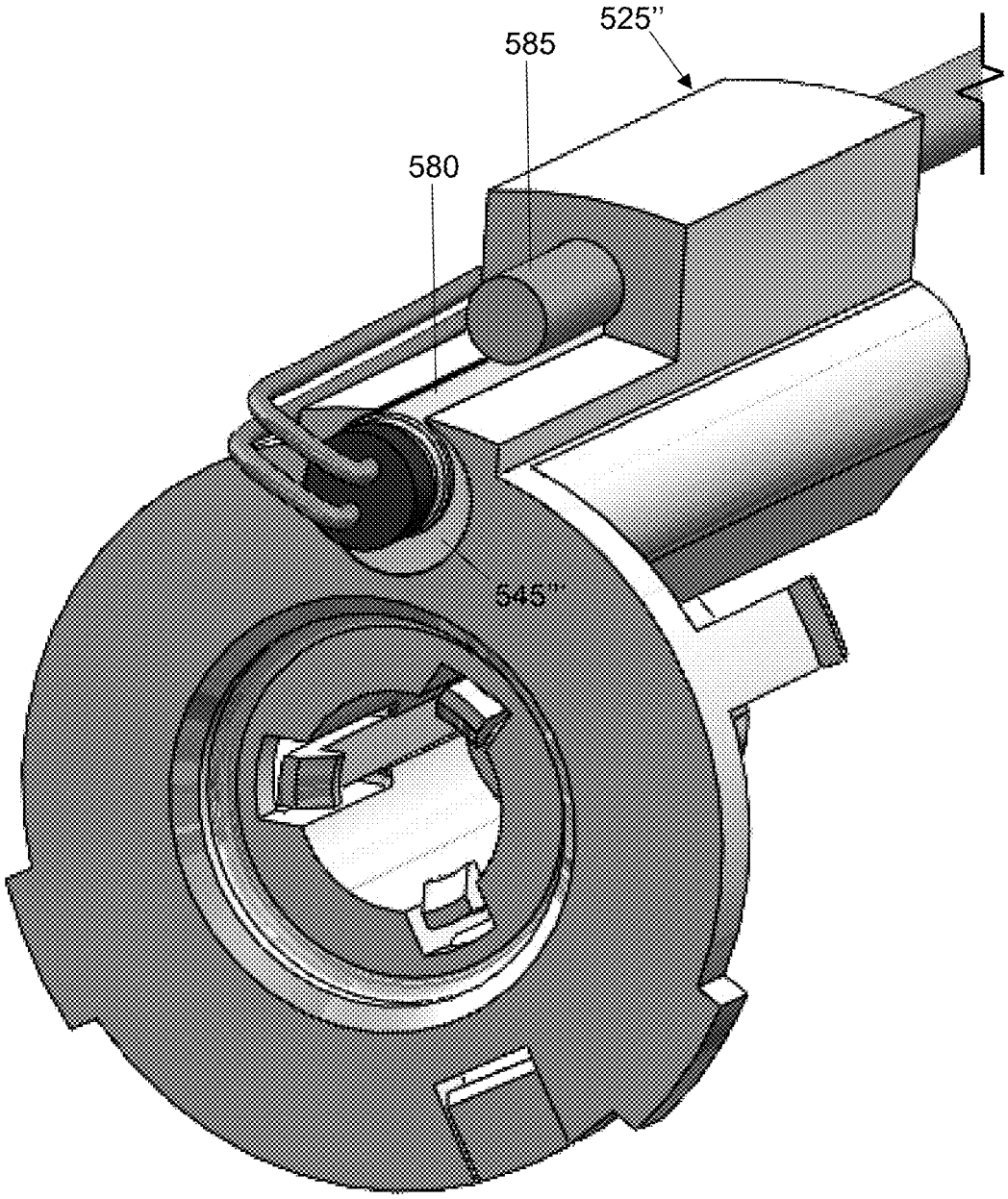
FIG. 12A is a perspective view of yet another detonation housing and yet another ballistic interrupter assembled together with a detonator and a detonating cord in an armed state or configuration, according to one or more embodiments of the present disclosure.
Figure 12B:
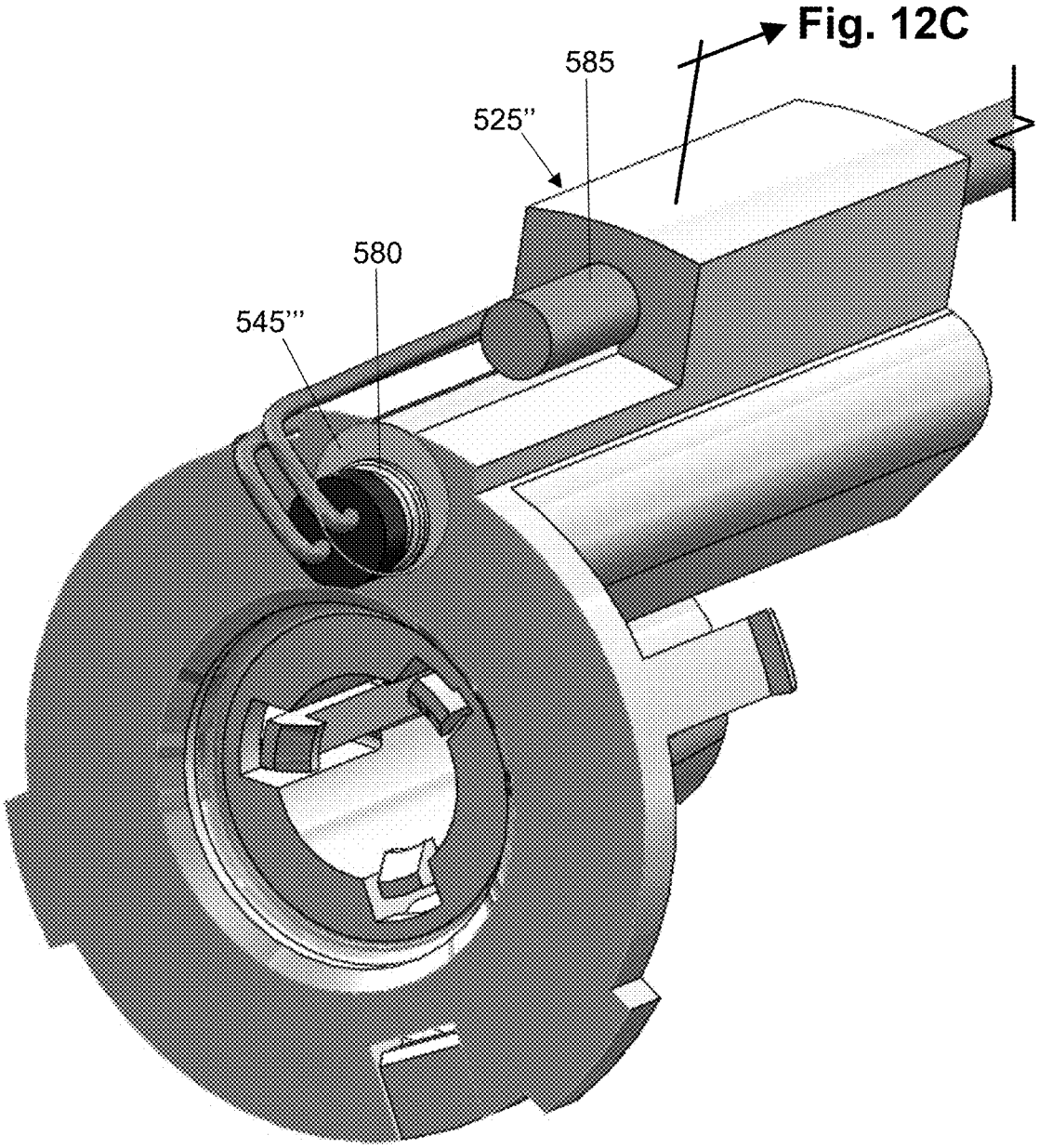
FIG. 12B is a perspective view of the assembly of FIG. 12A in a disarmed state or configuration, according to one or more embodiments of the present disclosure.
Figure 12C:
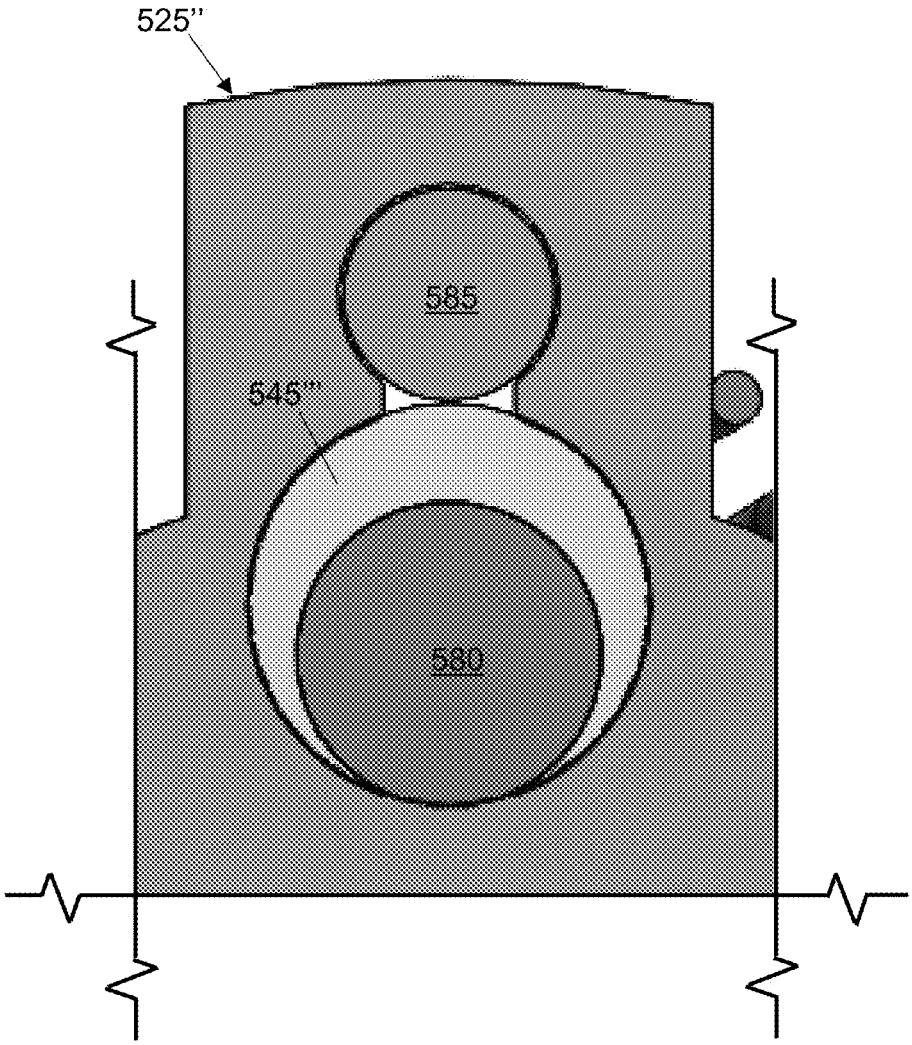
FIG. 12C is a cross-sectional view of the assembly of FIG. 12B (in the disarmed state or configuration) taken along the line 12C-12C of FIG. 12B, according to one or more embodiments of the present disclosure.

Referring to FIGS. 12A-12C, in an embodiment, the detonation housing 525 is omitted in favor of a detonation housing 525" and the ballistic interrupter 545 is omitted in favor of a ballistic interrupter 545'''. The ballistic interrupter 545''' may or may not include any end feature(s), such as those shown in FIGS. 4A-4E, 9A-9C, or 10. The detonator 580 is received in the bore 550 of the ballistic interrupter 545''', which ballistic interrupter 545 is itself received in the bore 530*a* of the detonation housing 525". The detonating cord 585, in turn, is received in the bore 530*b* of the detonation housing 525". FIG. 12A illustrates an armed configuration. FIGS. 12B-C illustrate a disarmed configuration. Although not shown in FIGS. 12A-12C, in one or more other embodiments, the detonation housing 525" may include the latching feature 543 (or another latching feature) adapted to interact with corresponding feature(s) of the ballistic interrupter 545''' to retain the ballistic interrupter 545''' in the disarmed state or configuration, the armed state or configuration, or both.

Figure 13:
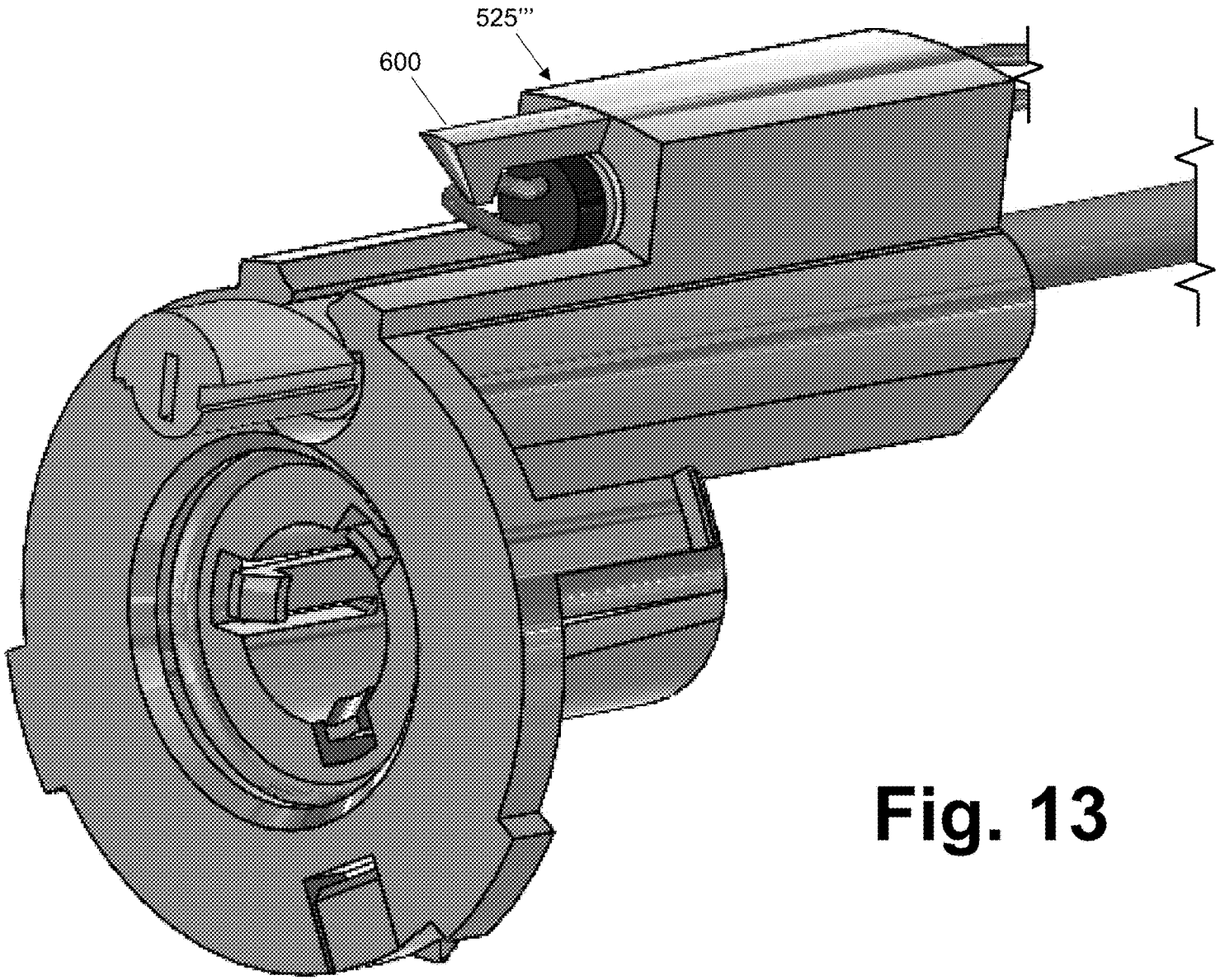
FIG. 13 is a perspective view of yet another detonation housing including a latching feature adapted to retain a detonator, assembled together with the ballistic interrupter of FIGS. 4A-4E, the detonator, and a detonating cord, according to one or more embodiments of the present disclosure.

Referring to FIG. 13, in an embodiment, the detonation housing 525 is omitted in favor of a detonation housing 525''', which detonation housing 525''' is substantially identical to the detonation housing 525, except that the detonation housing 525''' includes a latching feature 600 extending axially therefrom adjacent the bore 530*b*. In one or more embodiments, the latching feature 600 (in combination with the retaining feature 544 shown in FIGS. 3B-3D) is adapted to retain the detonator 580 at least partially within the bore 530*b*. Alternatively, at least for embodiment(s) similar to that illustrated in FIGS. 12A-12C, rather than extending adjacent the bore 530*b*, the latching feature 600 may instead extend adjacent the bore 530*a*, and be adapted to retain the detonator 580 at least partially within the bore 530*a*.

Figure 14:
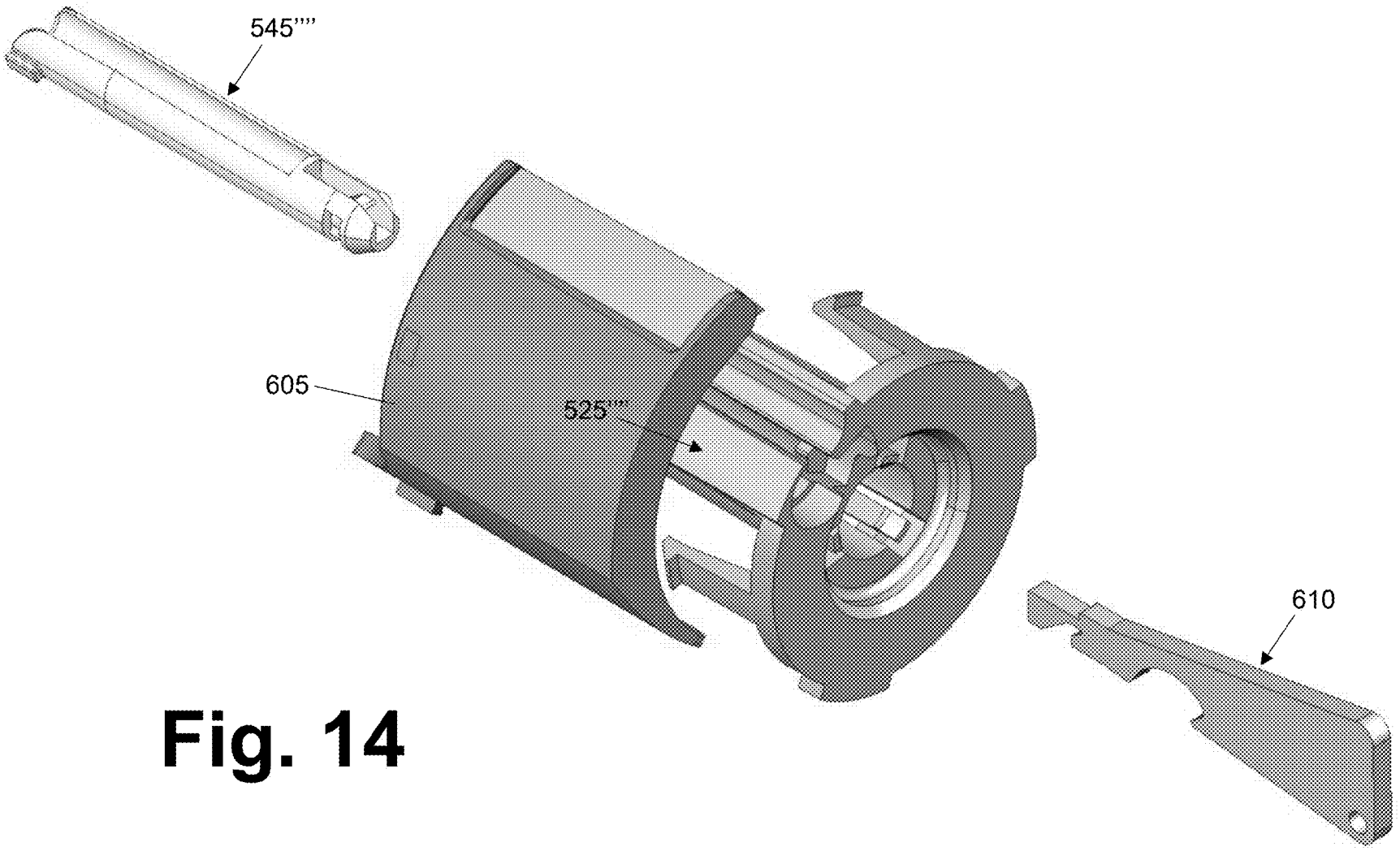
FIG. 14 is an exploded perspective view of an end cap assembly of a charge cartridge of a perforating gun, which charge cartridge also includes a charge tube (not shown) into which the end cap assembly is received when the charge cartridge is assembled, said end cap including a detonation housing and a ballistic interrupter, according to one or more embodiments of the present disclosure.
Figure 15A:
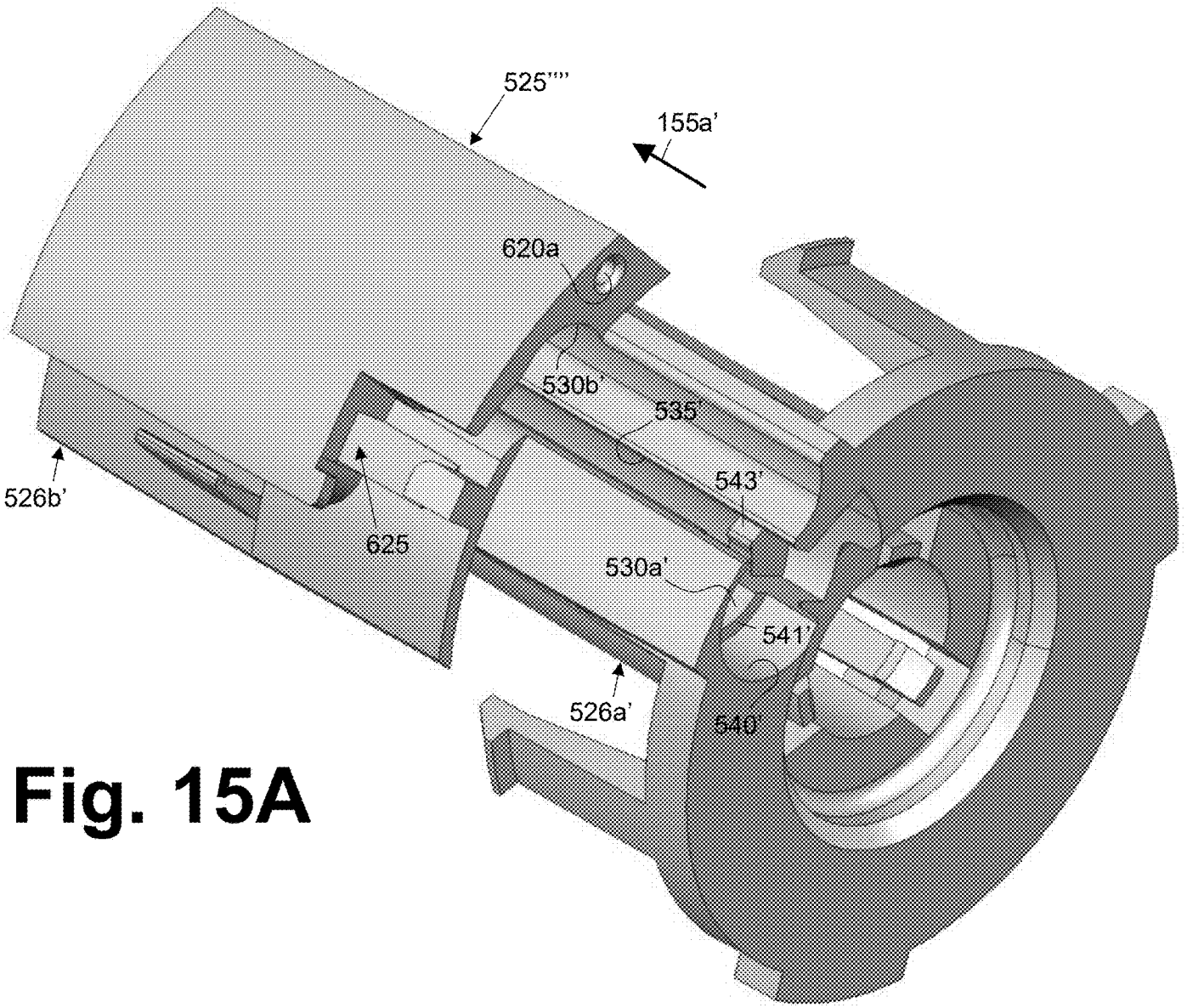
FIG. 15A is a perspective view of an end cap including the detonation housing of FIG. 14, according to one or more embodiments of the present disclosure.
Figure 15B:
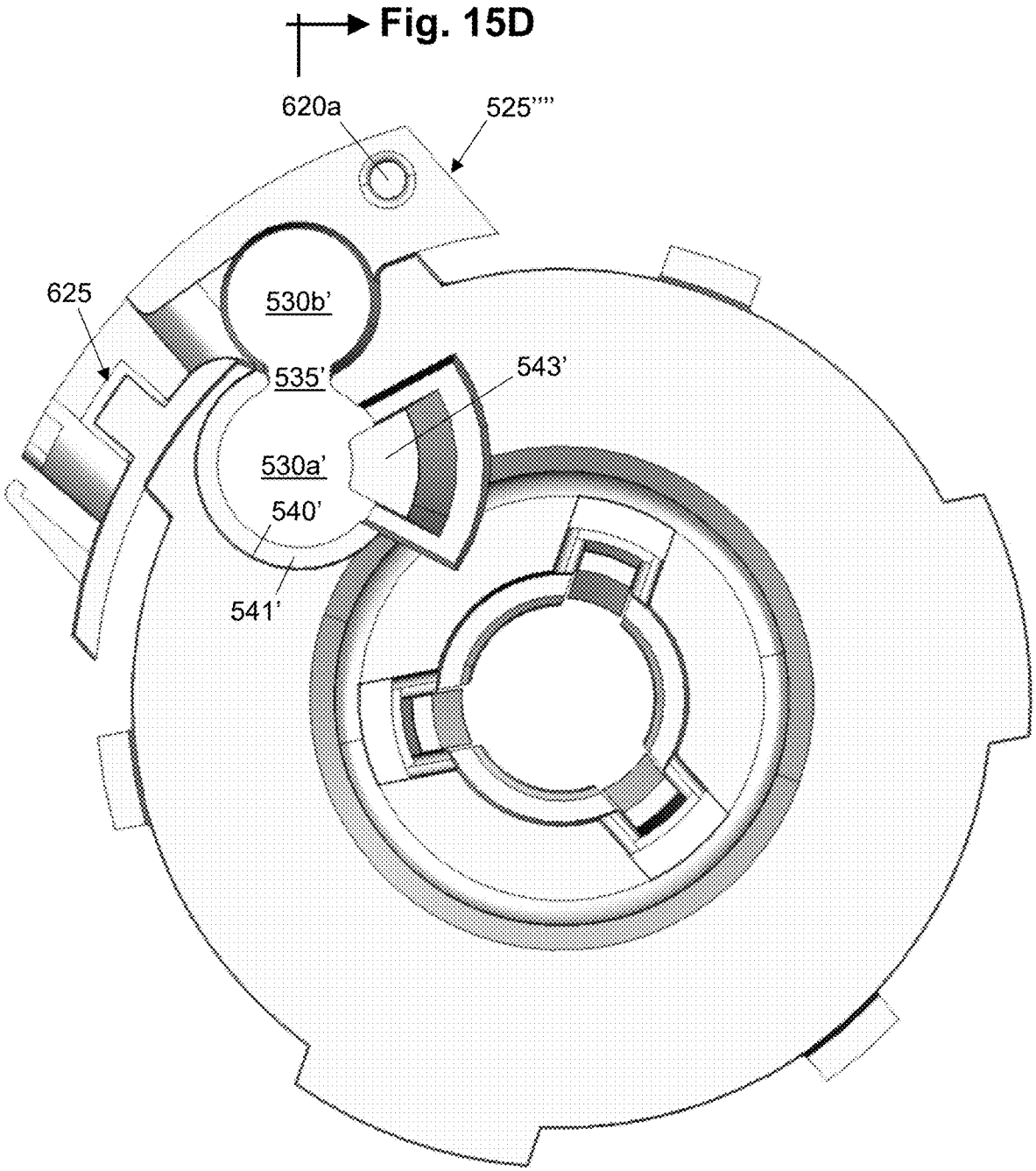
FIG. 15B is a top view of the end cap including the detonation housing of FIG. 15A, according to one or more embodiments of the present disclosure.
Figure 15C:
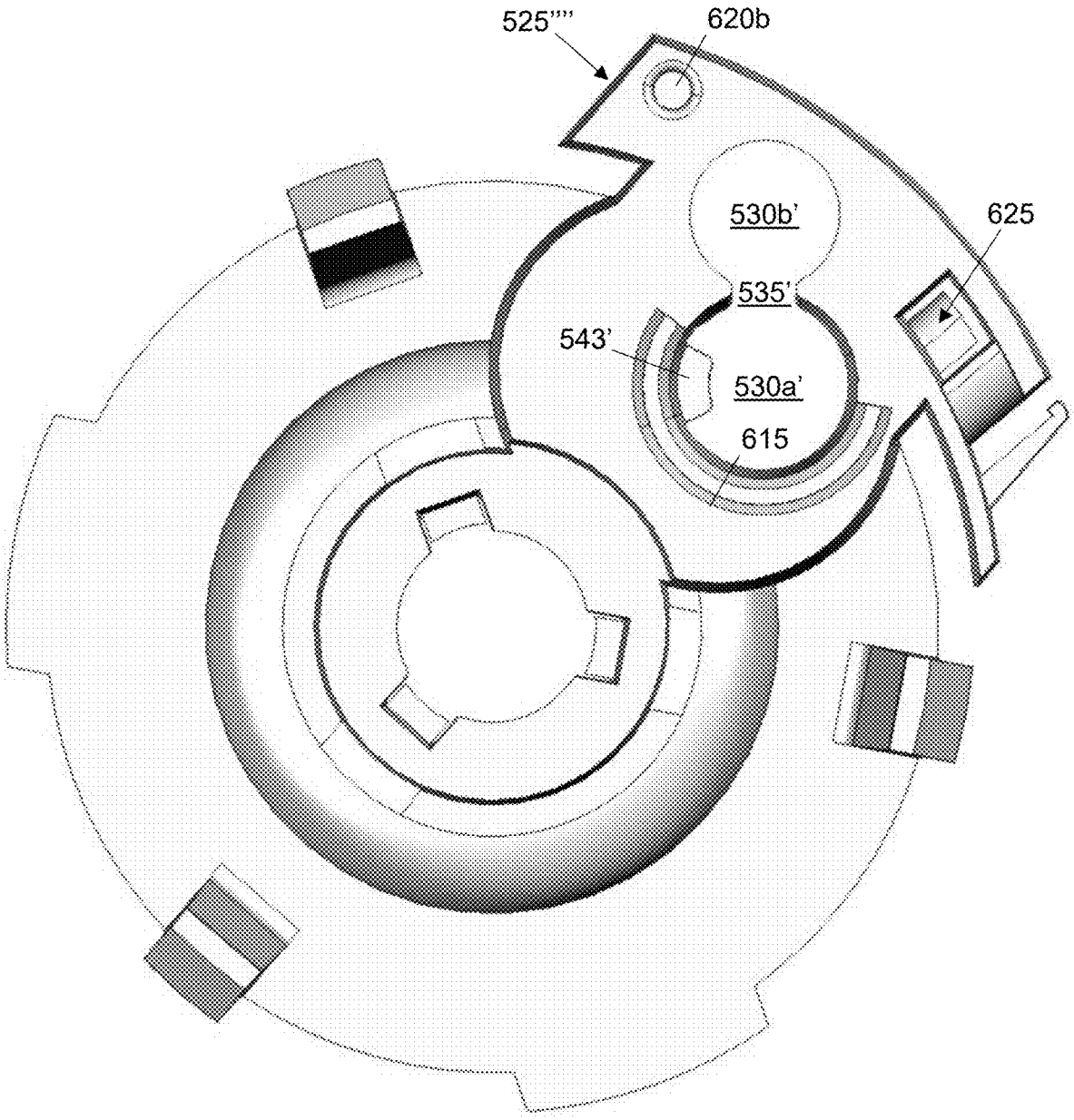
FIG. 15C is a bottom view of the end cap including the detonation housing of FIG. 15A, according to one or more embodiments of the present disclosure.
Figure 15D:
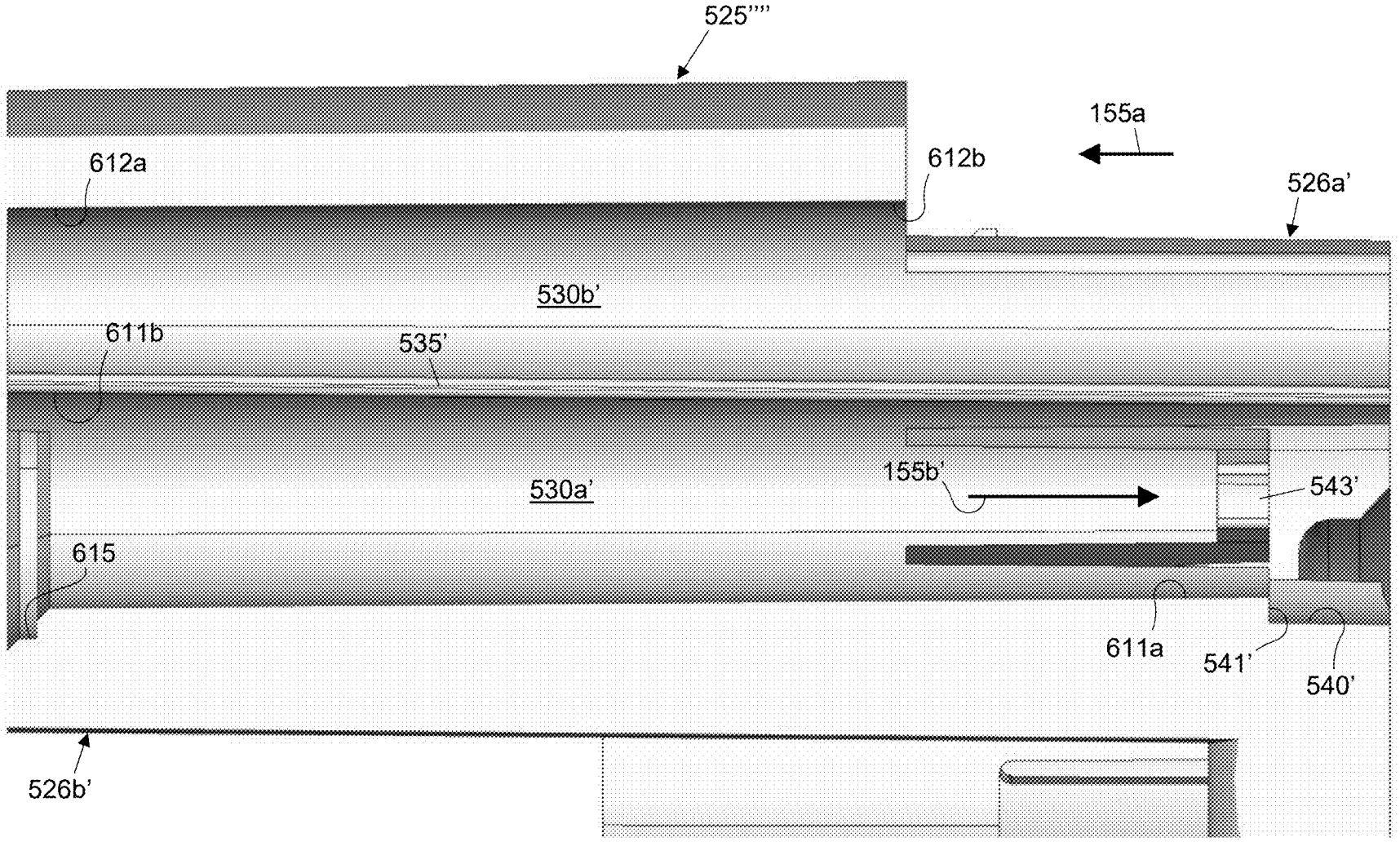
FIG. 15D is a cross-sectional view of the detonation housing of the end cap of FIG. 15A taken along the line 15D-15D of FIG. 15B, according to one or more embodiments of the present disclosure.
Figures 16A, 16B:
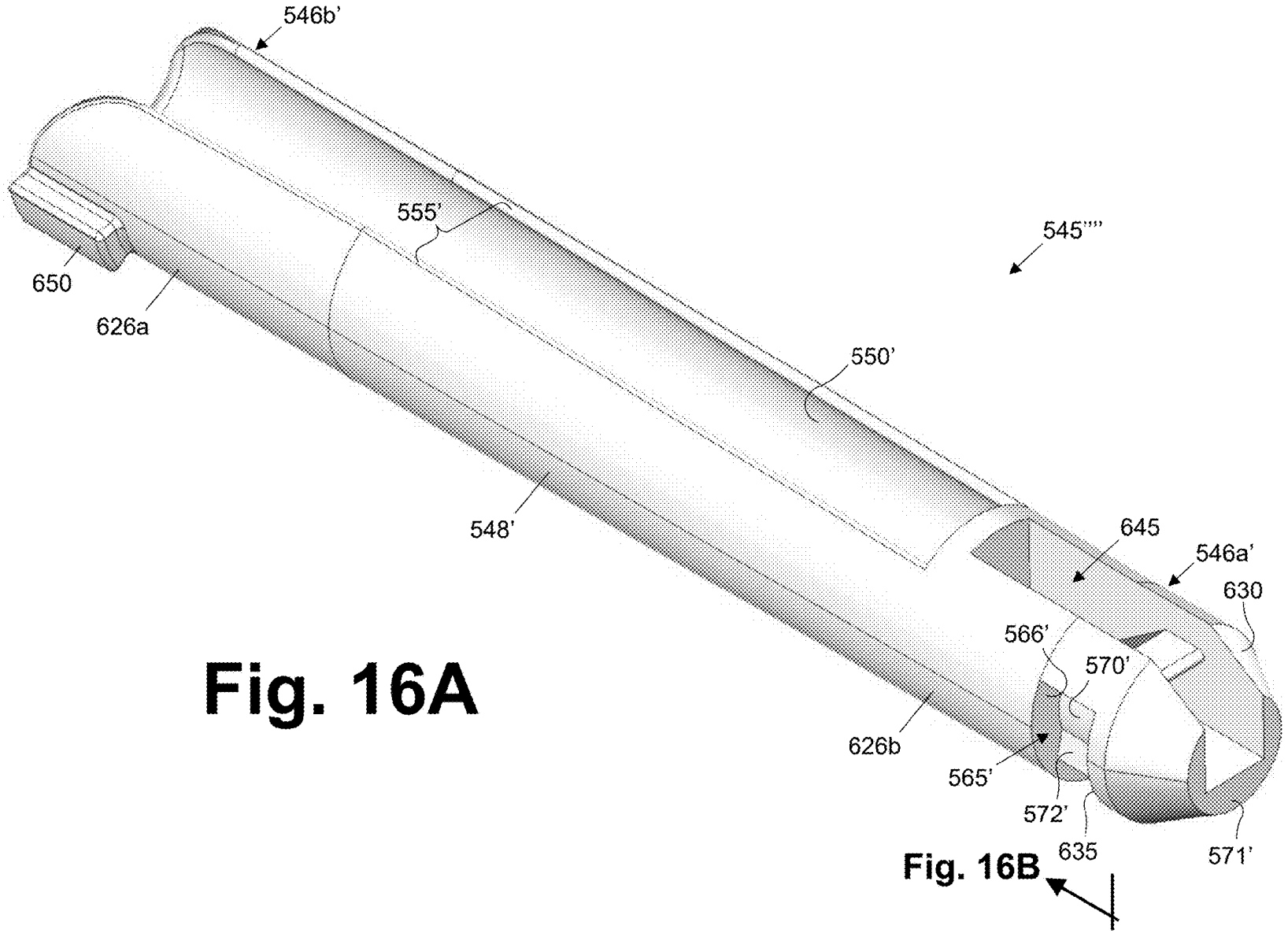
FIG. 16A is a perspective view of the ballistic interrupter of the end cap assembly of FIG. 14, according to one or more embodiments of the present disclosure.
FIG. 16B is a cross-sectional view of the ballistic interrupter of the end cap assembly of FIG. 14 taken along the line 16B-16B of FIG. 16A, according to one or more embodiments of the present disclosure.
Figure 16B:
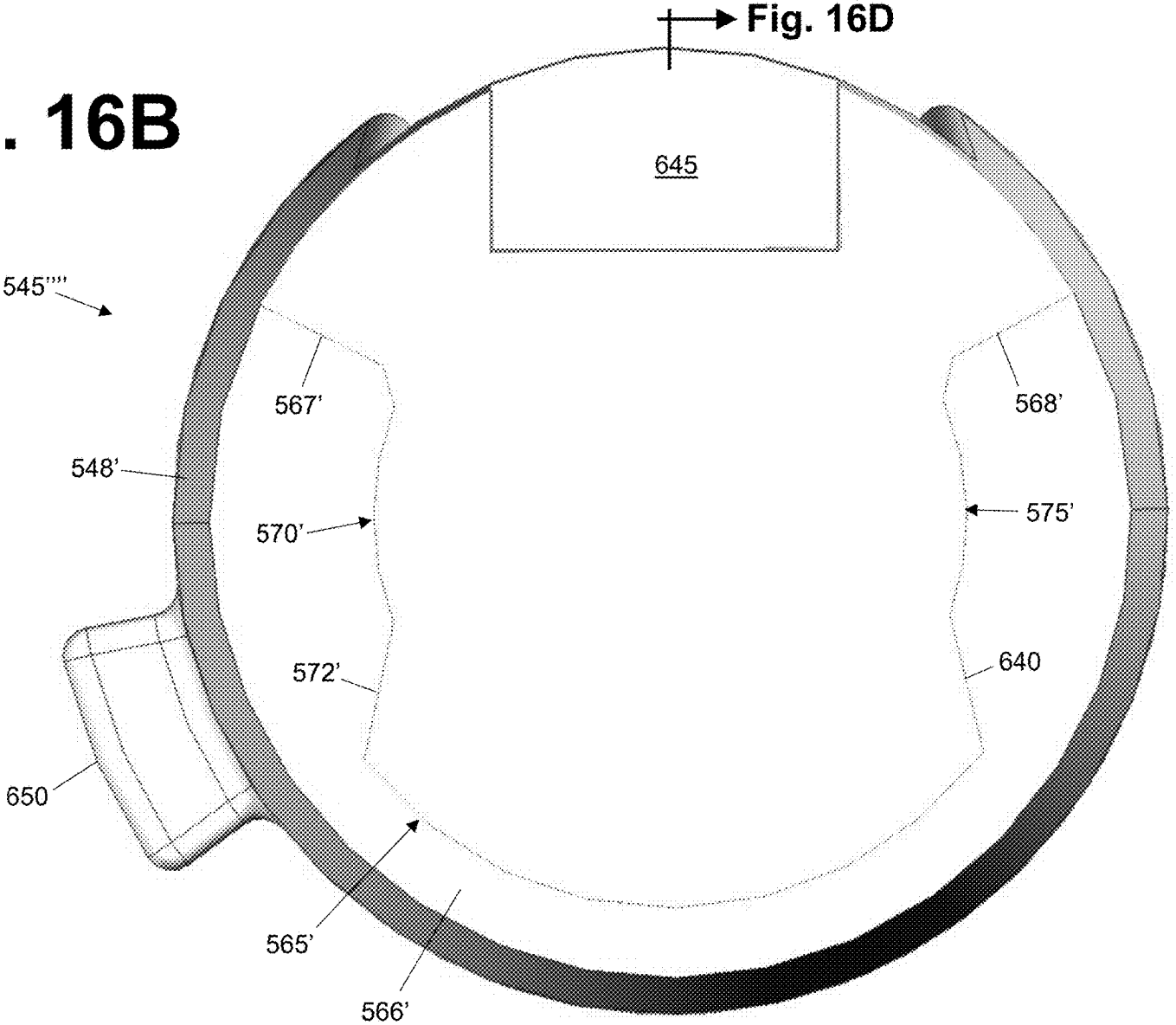
Figure 16C:
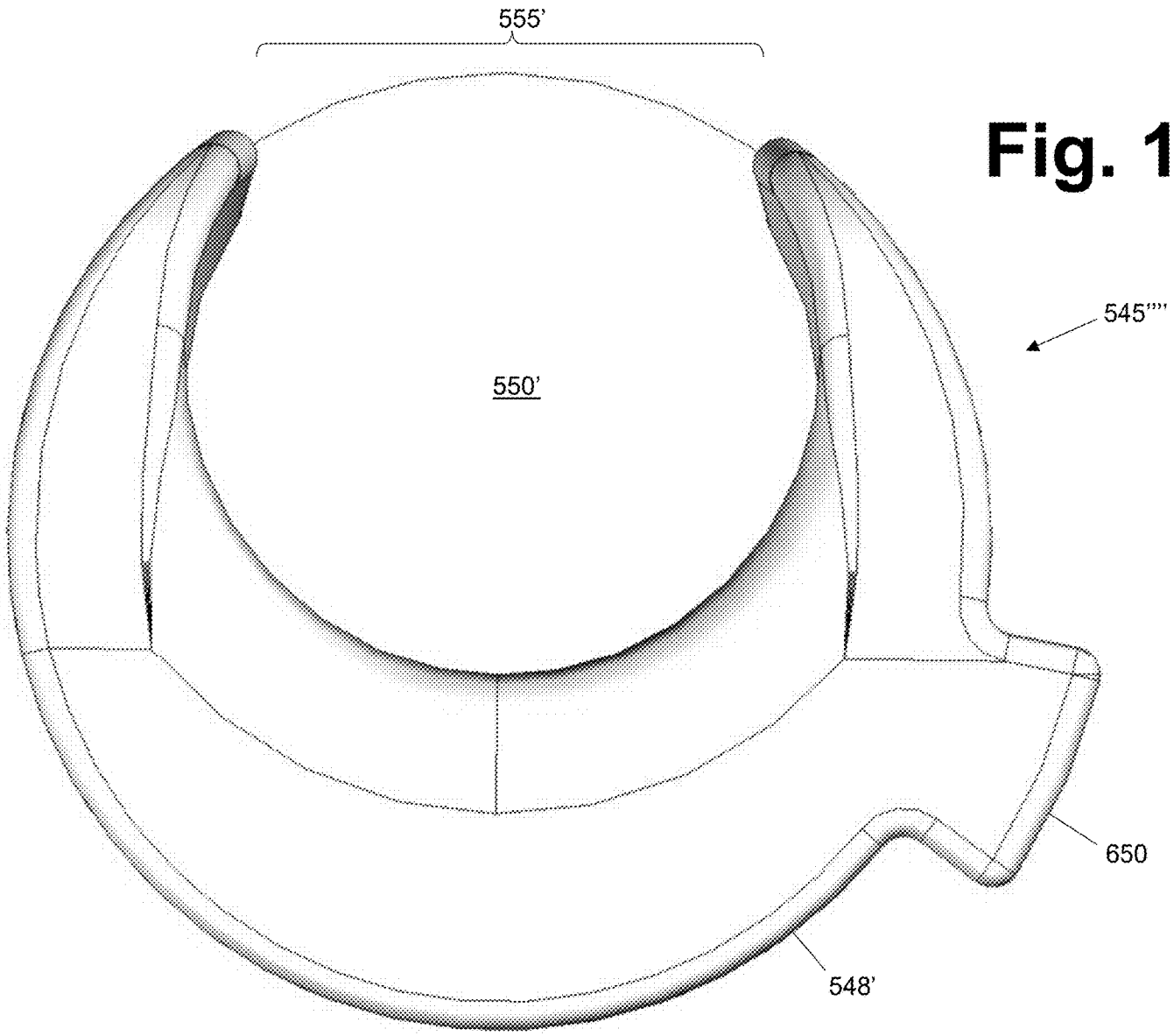
FIG. 16C is a bottom view of the ballistic interrupter of the end cap assembly of FIG. 14, according to one or more embodiments of the present disclosure.
Figure 16D:
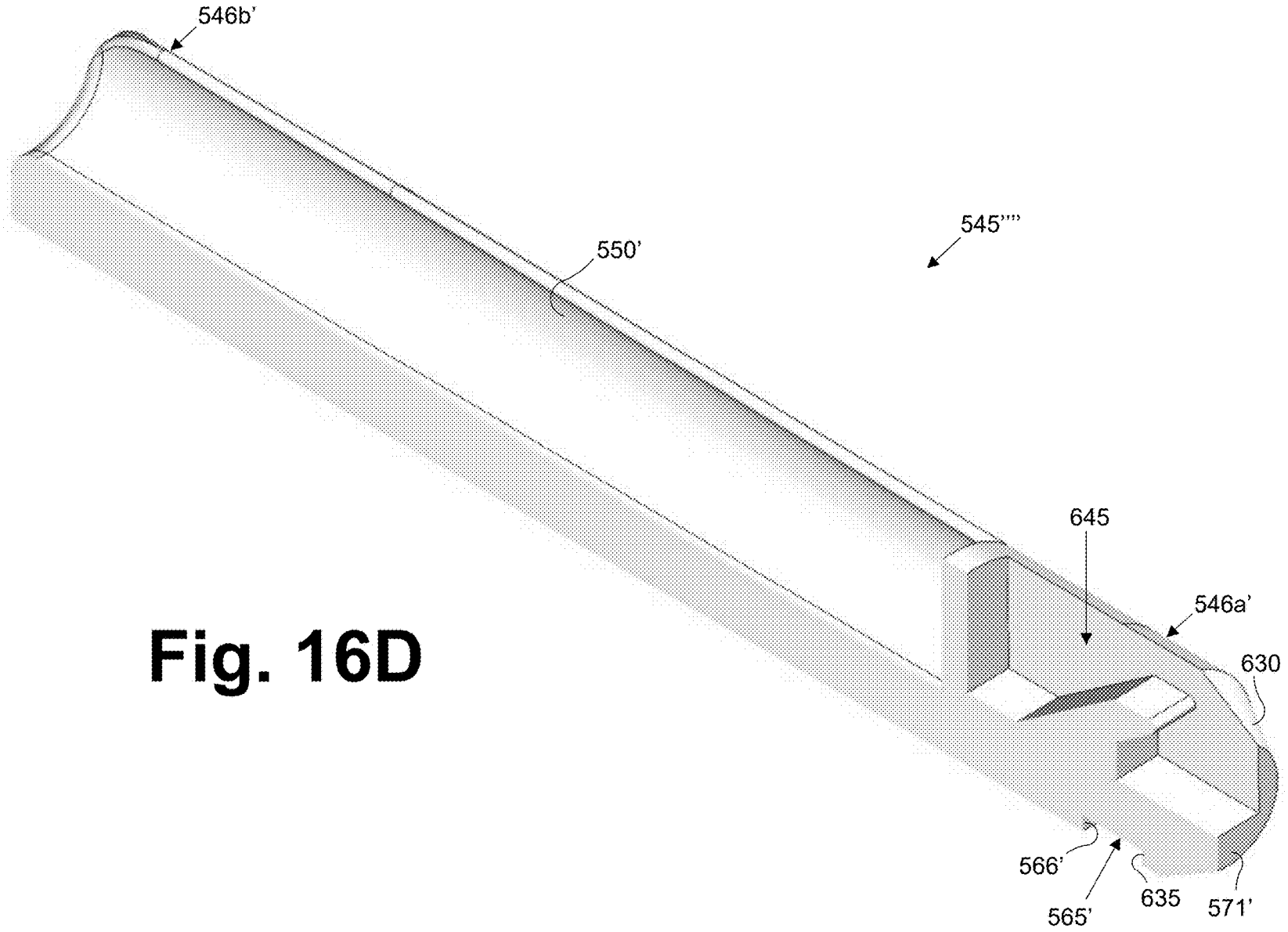
FIG. 16D is a cross-sectional view of the ballistic interrupter of the end cap assembly of FIG. 14 taken along the line 16D-16D of FIG. 16B, according to one or more embodiments of the present disclosure.

Referring to FIG. 14, in an embodiment, the detonation housing 525 is omitted in favor of a detonation housing 525'''' and the ballistic interrupter 545 is omitted in favor of a ballistic interrupter 545'''' receivable into the detonation housing 525''''. The detonation housing 525'''' includes a cover 605 to retain the detonator 580 (and to protect any exposed wires). The cover 605 is hinged to open and close for inserting the detonator 580 and/or attaching the detonator leads to a switch (not shown; e.g., an addressable switch). A key 610 is used to rotate the ballistic interrupter 545'''' between the disarmed state or configuration and the armed state or configuration. In one or more embodiments, the key 610 is, includes, or is part of the ballistic interrupter 545''''.

Referring to FIGS. 15A through 15D, in an embodiment, the detonation housing 525'''' includes various features/components that are substantially identical (or at least similar) to corresponding features/components of the detonation housing 525, which substantially identical (or at least similar) features/components are given the same reference numerals, except that a suffix "'" has been added to the corresponding features/components of the detonation housing 525''''. Thus, in connection with FIGS. 15A-15D, the detonation housing 525'''' extends axially from an end portion 526*a'* to an end portion 526*b'* (in the direction 155*a'*). The detonation housing 525'''' defines a pair of bores 530*a-b'*. In one or more embodiments, the bores 530*a-b'* extend in a parallel relation, intersecting to define a slot 535' therealong in the detonation housing 525''''.

The bore 530*a'* extends from the end portion 526*a'* to the end portion 526*b'* of the detonation housing 525''''. In one or more embodiments, as most clearly shown in FIG. 15D, the bore 530*a'* is tapered (or drafted) from a reduced-diameter portion 611*a* proximate the end portion 526*a'* to an enlarged-diameter portion 611*b* proximate the end portion 526*b'*. The bore 530*a'* includes a radially-enlarged portion 540' formed into the detonation housing 525'''' at the end portion 526*a'*. The radially-enlarged portion 540' of the bore 530*a'* defines an axially-facing shoulder 541' in the detonation housing 525'''', and extends circumferentially from one side of the slot 535' to a latching feature 543' (proximate the other side of the slot 535'). The latching feature 543' extends axially from the detonation housing 525'''' (in the direction 155*b'*). In one or more embodiments, the latching feature 543' is located along, or proximate, a circumference of the radially-enlarged portion 540'. In one or more embodiments, the latching feature 543' is radially-inwardly-facing. The bore 530*b'* may be shorter than the bore 530*a'*, extending from the end portion 526*b'* of the detonation housing 525'''' toward the end portion 526*a'*. In one or more embodiments, as most clearly shown in FIG. 15D, the bore 530*b'* is tapered (or drafted) from a reduced-diameter portion 612*a* proximate the end portion 526*b'* to an enlarged-diameter portion 612*b* proximate the end portion 526*a'*.

The detonation housing 525'''' further includes a semi-annular recess 615 (visible in FIGS. 15C and 15D) associated with the bore 530*a'* at or near the end portion 526*b'*. A pair of detents 620*a-b*, to which the cover 605 is adapted to be hingedly connected, are formed into the detonation housing 525'''' proximate the end portions 526*a-b'*, respectively. Finally, in one or more embodiments, the detonation housing 525'''' includes a receptacle 625 for receiving and retaining the switch (not shown; e.g., the addressable switch) to which the detonator leads of the detonator 580 are adapted to be connected.

Referring to FIGS. 16A through 16D, in an embodiment, the ballistic interrupter 545'''' includes various features/components that are substantially identical (or at least similar) to corresponding features/components of the ballistic interrupter 545, which substantially identical (or at least similar) features/components are given the same reference numerals, except that a suffix "'" has been added to the corresponding features/components of the ballistic interrupter 545''''. The ballistic interrupter 545'''' defines opposing end portions 546*a-b'* and an exterior surface 548' extending from the end portion 546*b'* toward the end portion 546*a'*. In one or more embodiments, the exterior surface 548' is tapered (or drafted) from an enlarged-diameter portion 626*a* proximate the end portion 546*b'* to a reduced-diameter portion 626*b* proximate the end portion 546*a'*. A bore 550' extends through the ballistic interrupter 545'''' from the end portion 546*b'* toward the end portion 546*a'*, intersecting the exterior surface 548' to define a slot 555' therealong in the ballistic interrupter 545''''. In one or more embodiments, as in FIGS. 16A-16D, the bore 550' extends along a central axis that is offset from a corresponding central axis of the ballistic interrupter 545'''' (e.g., a central axis of the exterior surface 548'). The ballistic interrupter 545'''' includes an angled (e.g., frustoconical or otherwise tapered) surface 630 at the end portion 546*a'*, adjacent an end face 571' of the ballistic interrupter 545''''.

The ballistic interrupter 545'''' also includes a radially-reduced portion (or "recess") 565' proximate the end portion 546*a'*. The angled surface 630 extends between the end face 571' and the radially-reduced portion 565'. As most clearly shown in FIG. 16B, the radially-reduced portion 565' defines an axially-facing shoulder 566' in the ballistic interrupter 545'''', extending circumferentially from a circumferentially-facing shoulder 567' to a circumferentially-facing shoulder 568'. Likewise, an opposing axially-facing shoulder 635

(visible in FIGS. 16A and 16D) is also formed in the ballistic interrupter 545"" by the radially-reduced portion 565'. A radial recess 570' is formed into the ballistic interrupter 545"", adjacent the circumferentially-facing shoulder 567'. In one or more embodiments, the radial recess extends axially from the axially-facing shoulder 566' to the axially-facing shoulder 635 of the ballistic interrupter 545"". The radial recess 570' defines an (at least partially) circumferentially-facing shoulder 572' in the ballistic interrupter 545"", adjacent the radially-reduced portion 565' and opposite the circumferentially-facing shoulder 567'. Likewise, a radial recess 575' is formed into the ballistic interrupter 545"", adjacent the circumferentially-facing shoulder 568'. In one or more embodiments, the radial recess 575' extends axially from the axially-facing shoulder 566' to the axially-facing shoulder 625 of the ballistic interrupter 545"". The radial recess 570' defines an (at least partially) circumferentially-facing shoulder 640 in the ballistic interrupter 545"", adjacent the radially-reduced portion 565' and opposite the circumferentially-facing shoulder 568'.

The ballistic interrupter 545"" also includes a receptacle 645 for receiving and retaining the key 610 (shown in FIG. 14) used to rotate the ballistic interrupter 545"" between the disarmed state or configuration and the armed state or configuration. The receptacle 645 is formed into the ballistic interrupter 545"" circumferentially between the circumferentially-facing shoulders 567' and 568', and circumferentially opposite the radially-reduced portion 565'. Finally, the ballistic interrupter 545"" includes a retaining feature 650 associated with the exterior surface 548' at or near the end portion 546*b'* and adapted to be received by the semi-annular recess 615 of the detonation housing 525"".

Figure 17A:
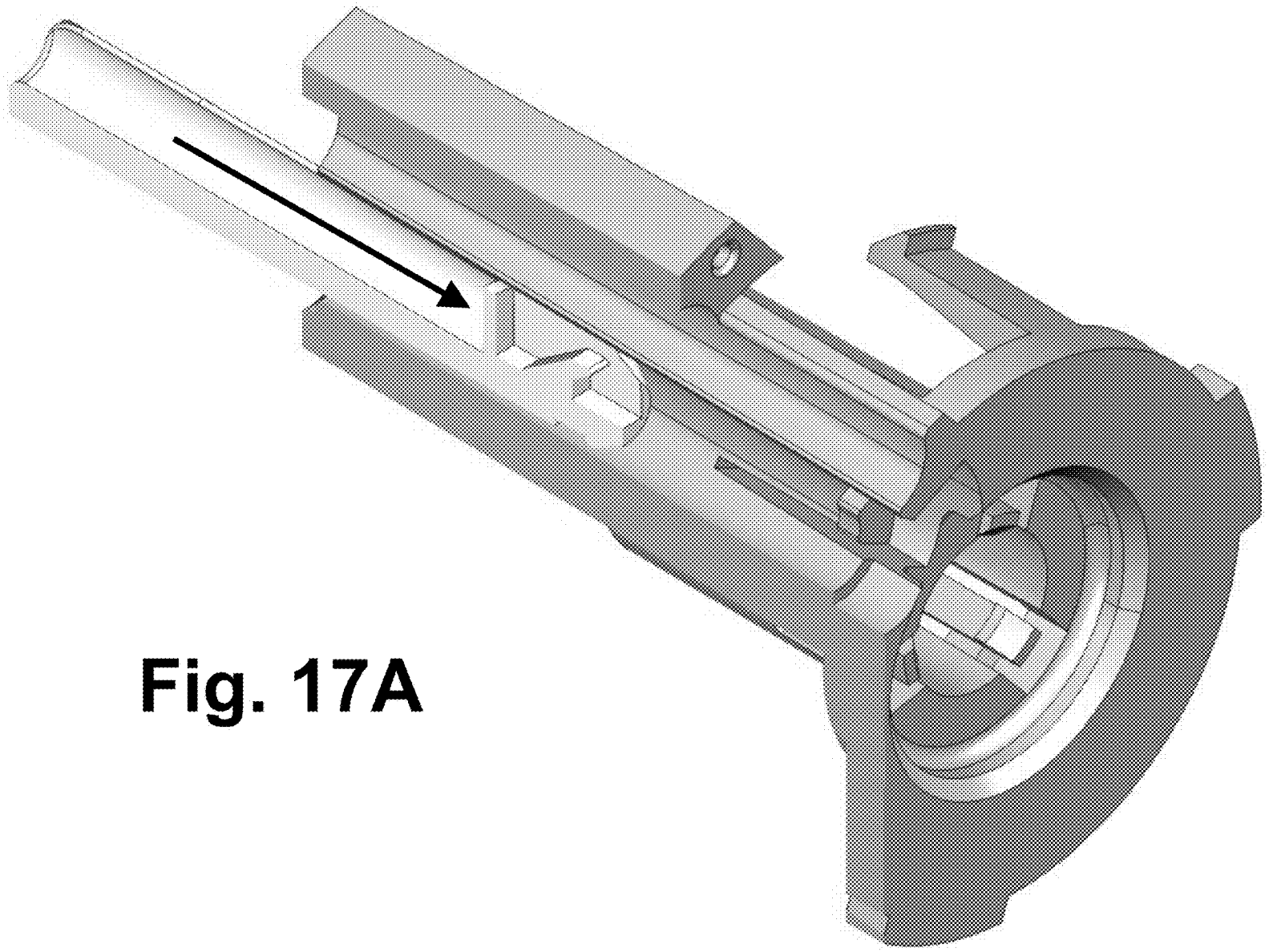
FIG. 17A is a cross-sectional view of the ballistic interrupter and the end cap including the detonation housing of FIG. 14 in a first state or configuration, according to one or more embodiments of the present disclosure.
Figures 1, 17B:
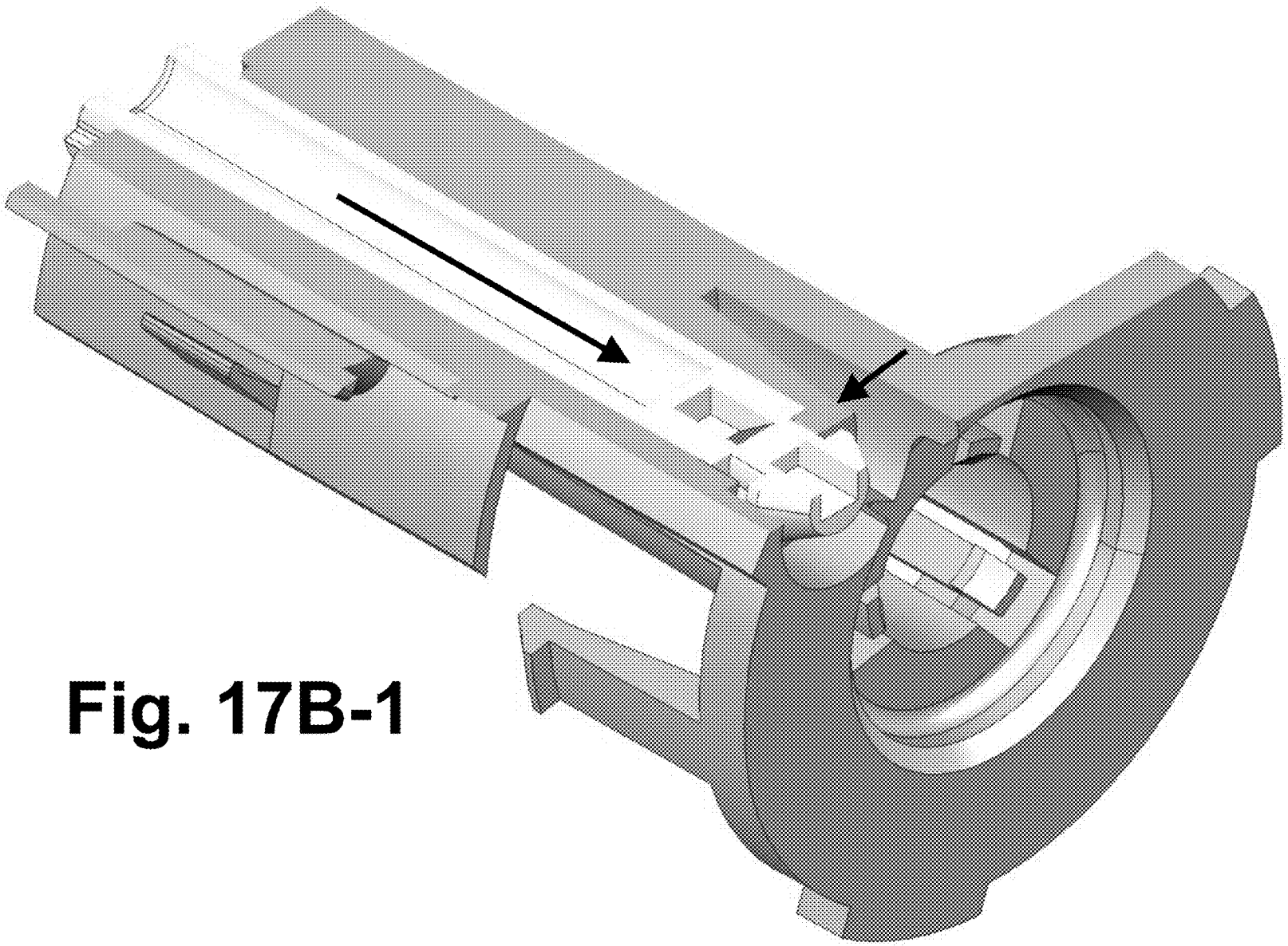
Figures 2, 17B:
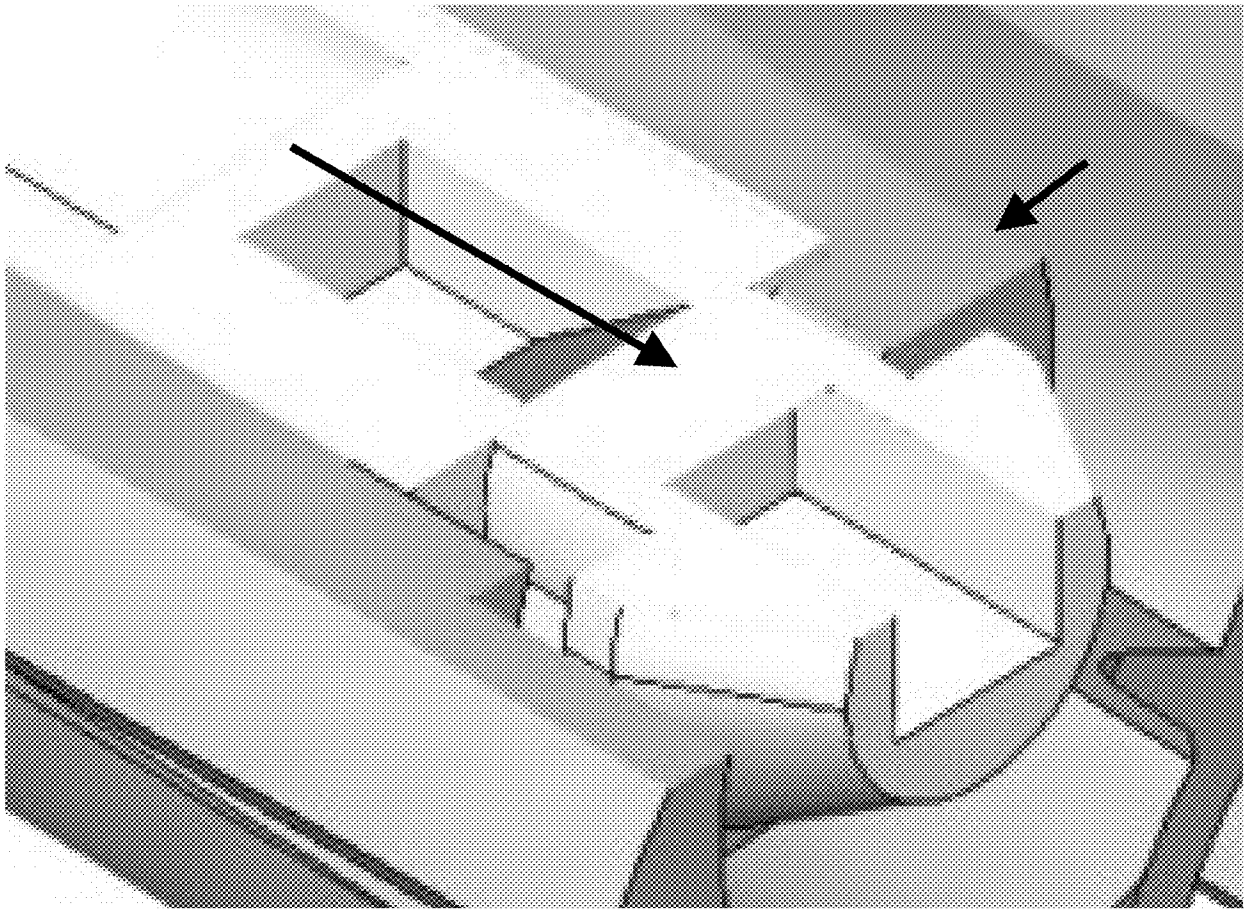
Figures 1, 17C:
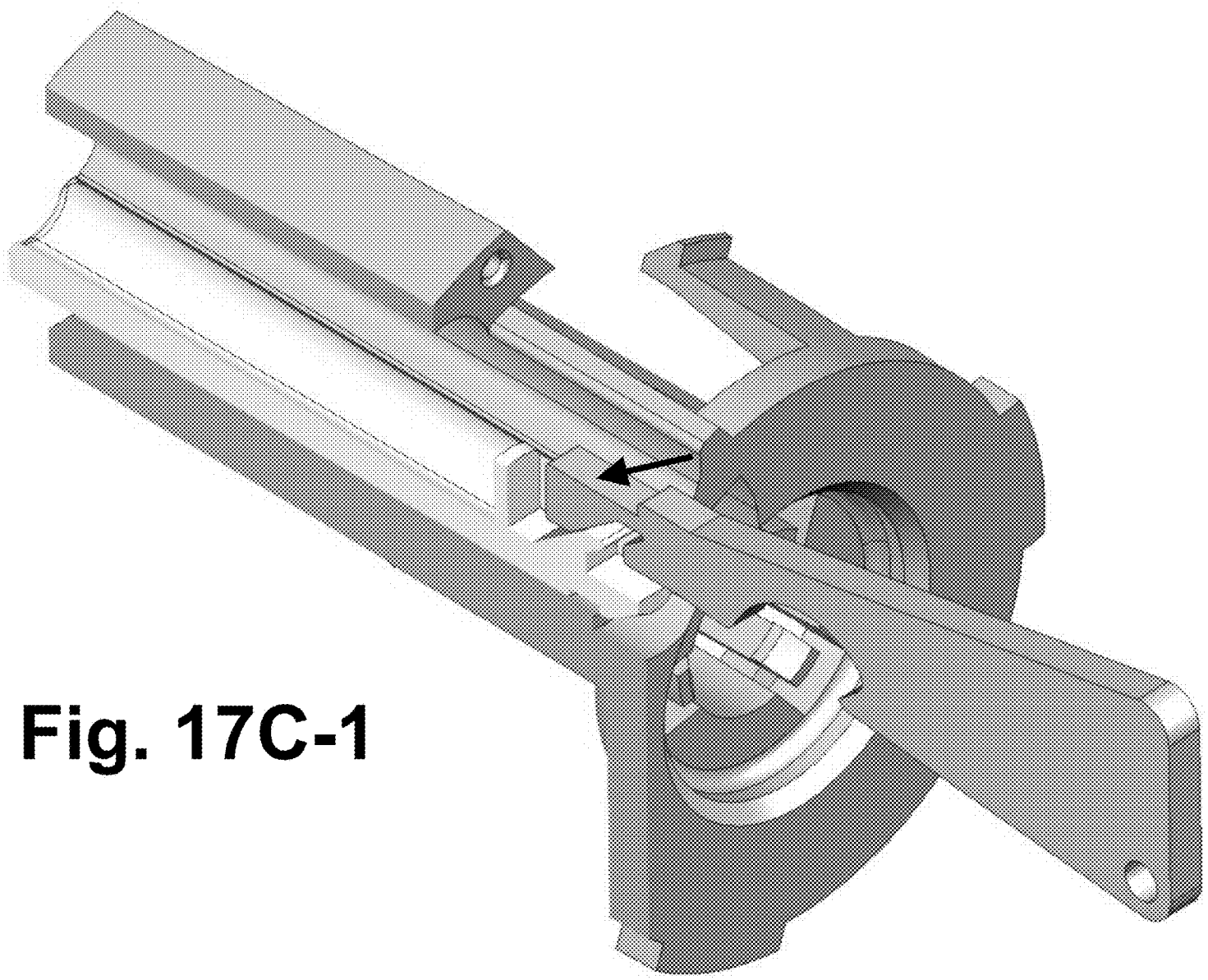
Figures 2, 17C:
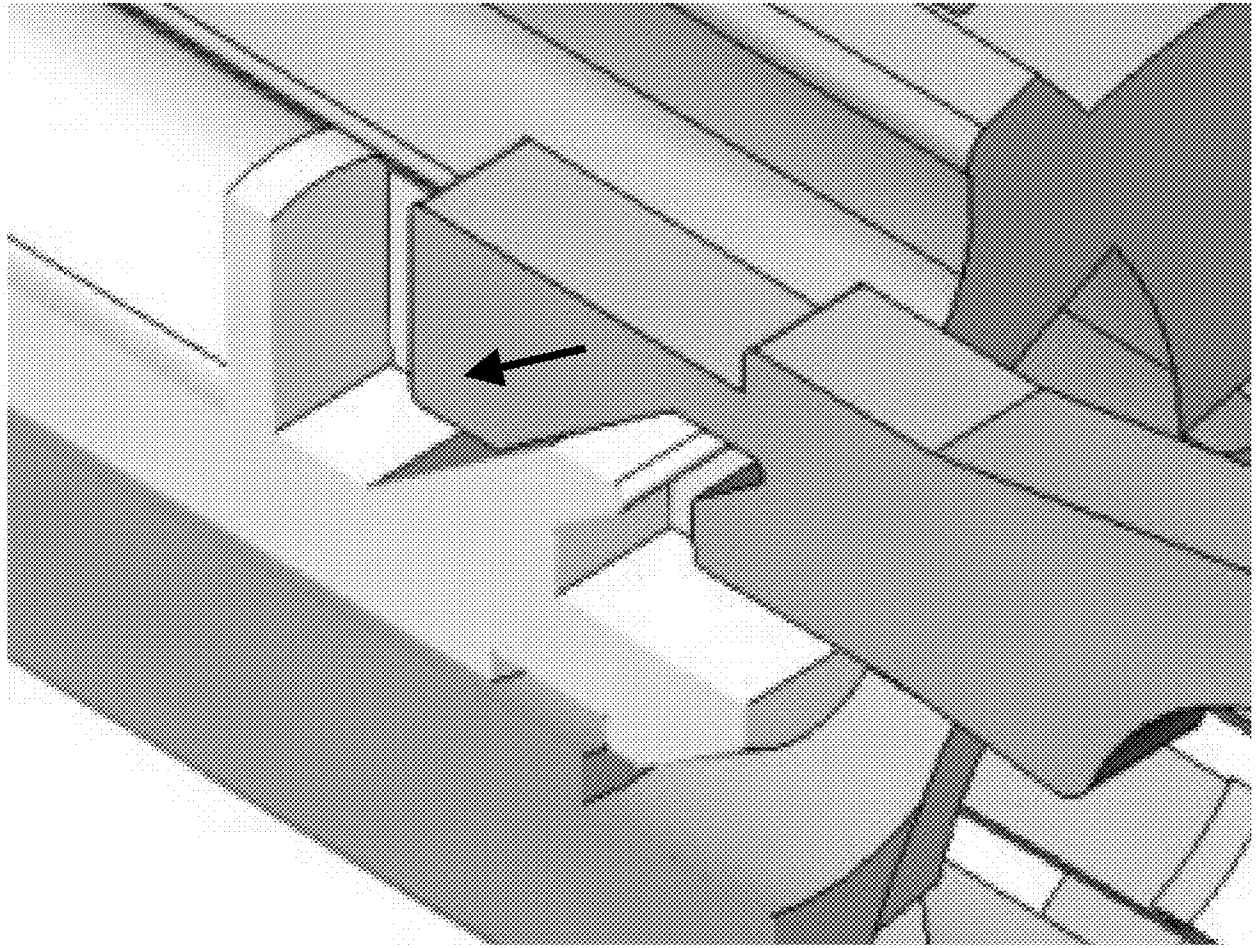
Figures 1, 17D:
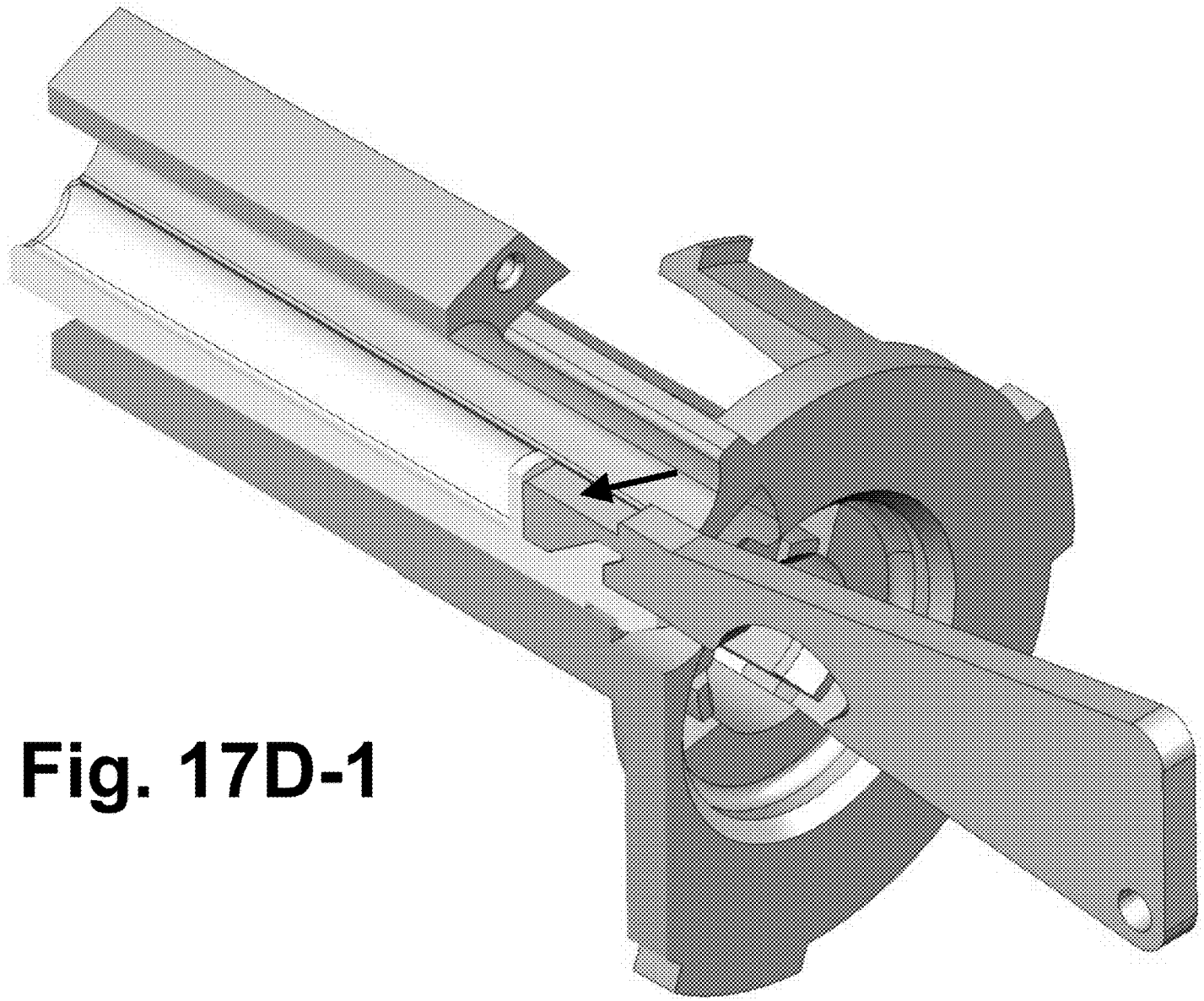
Figures 2, 17D:
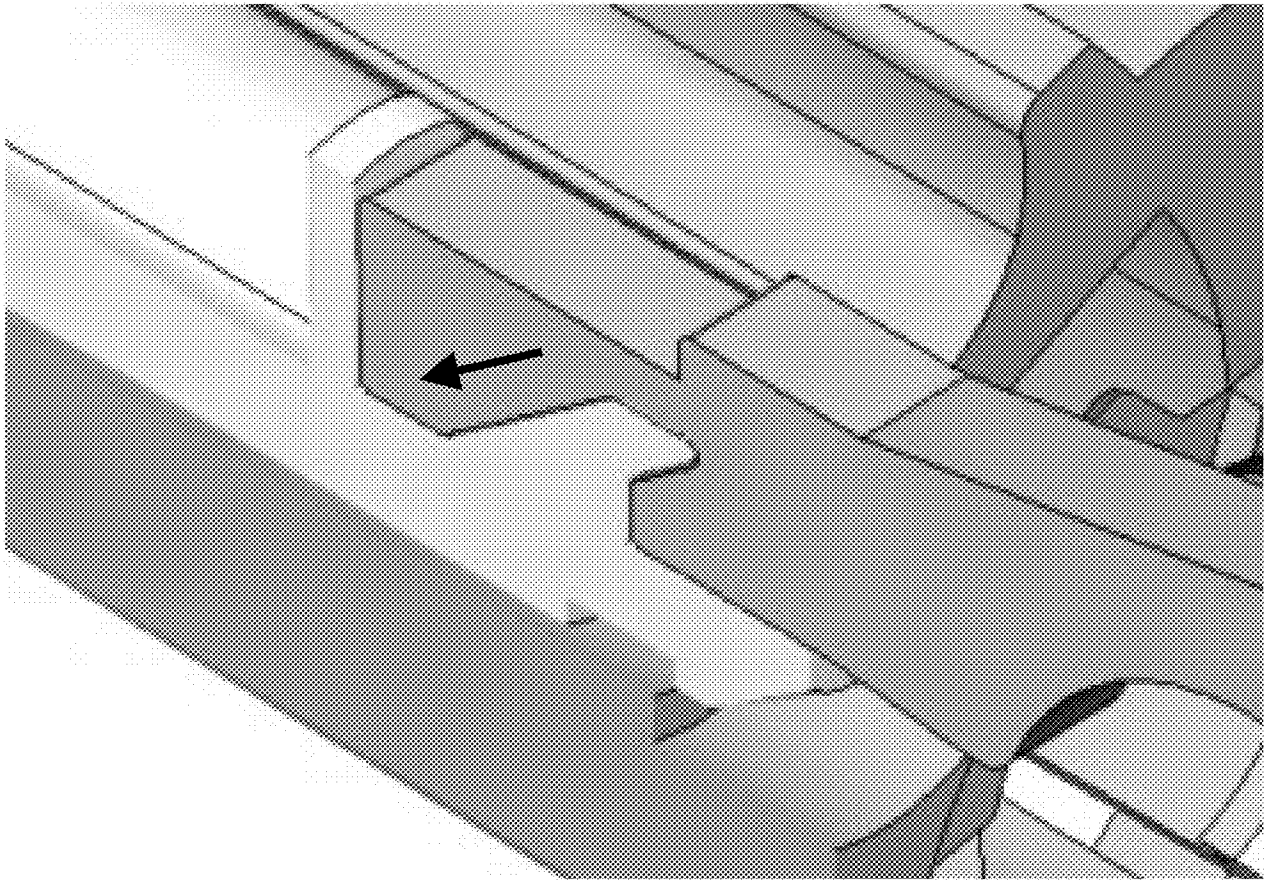
Figures 1, 17E:
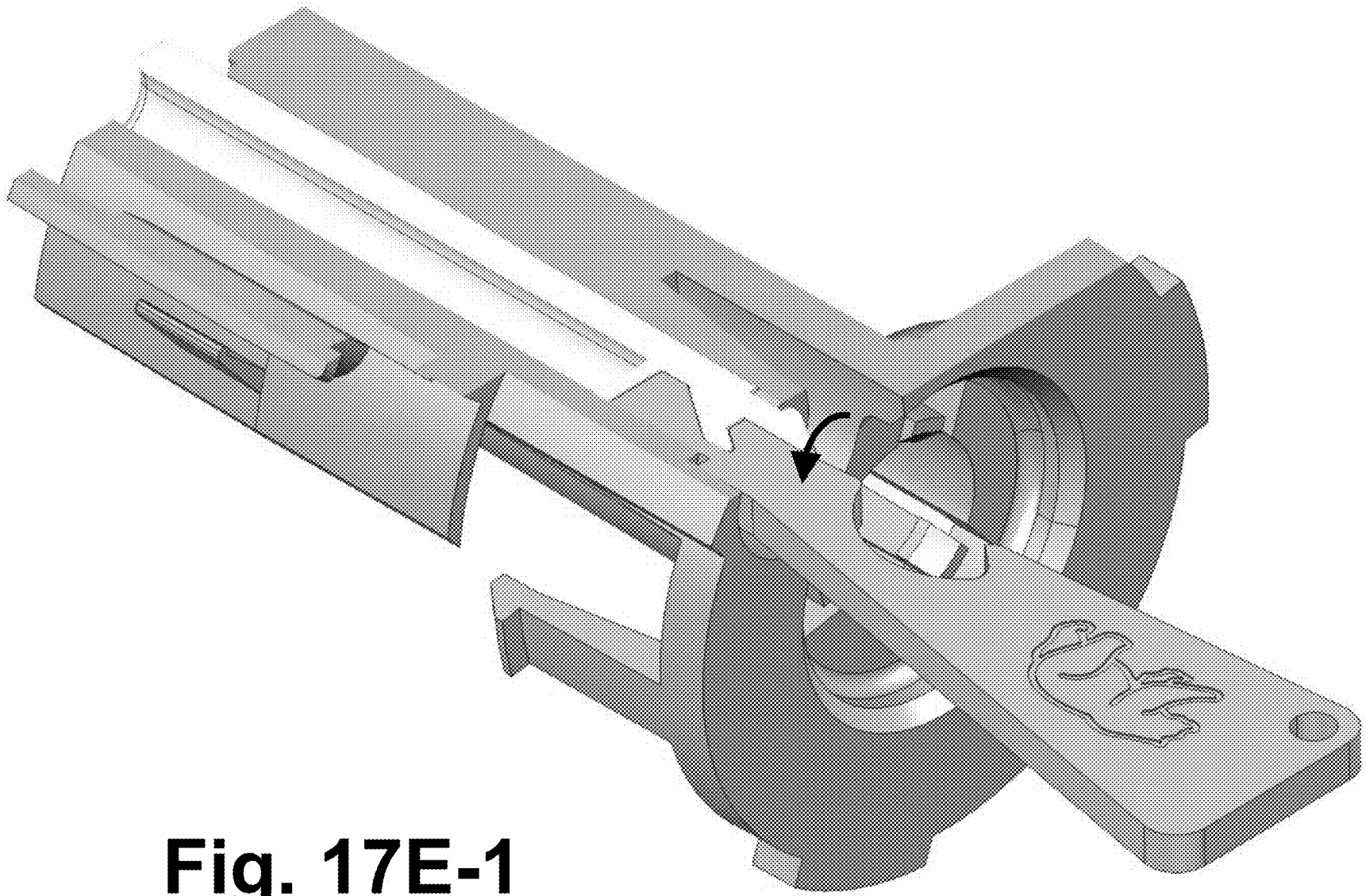
Figures 2, 17E:
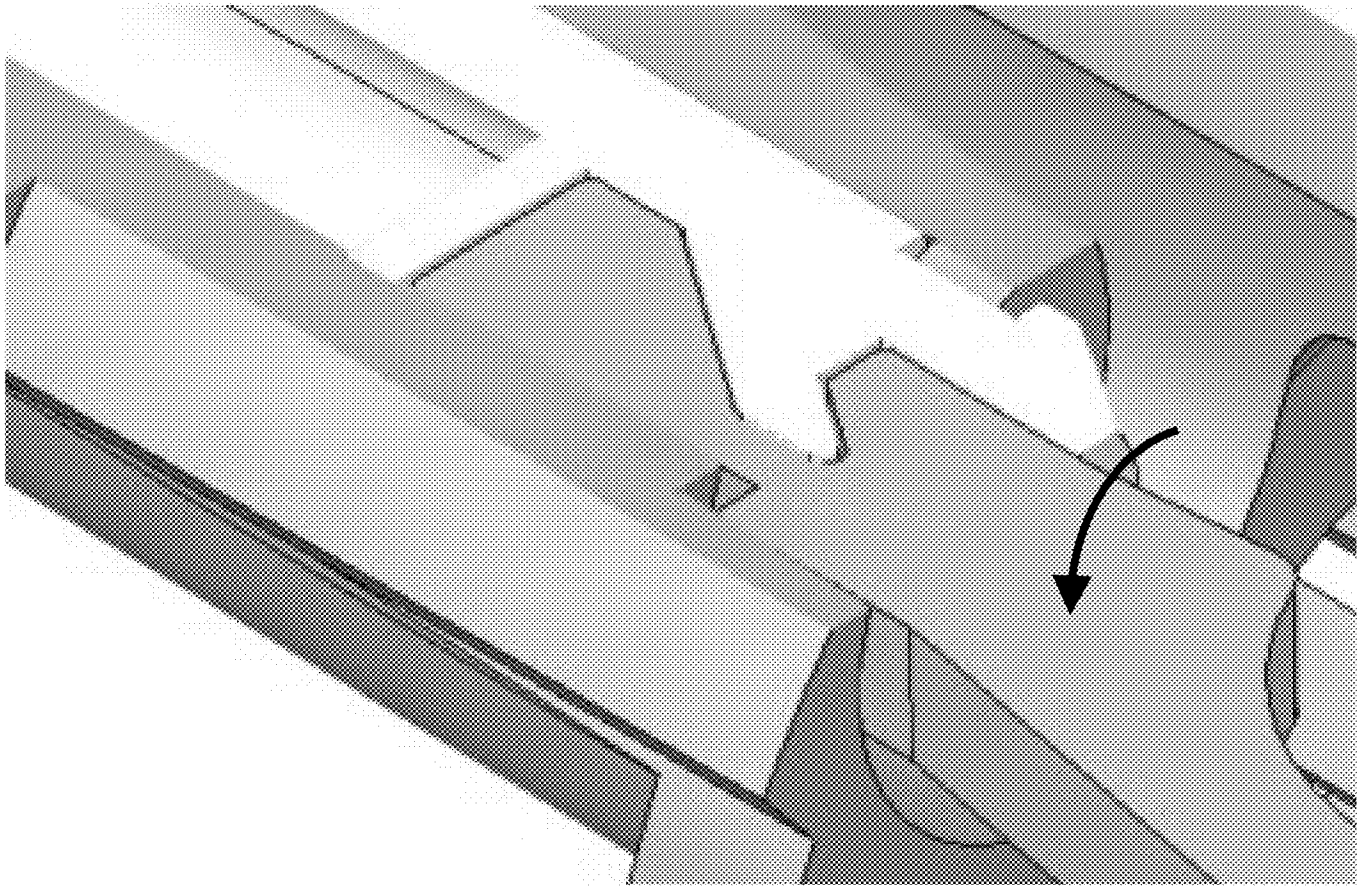
Figures 1, 17F:
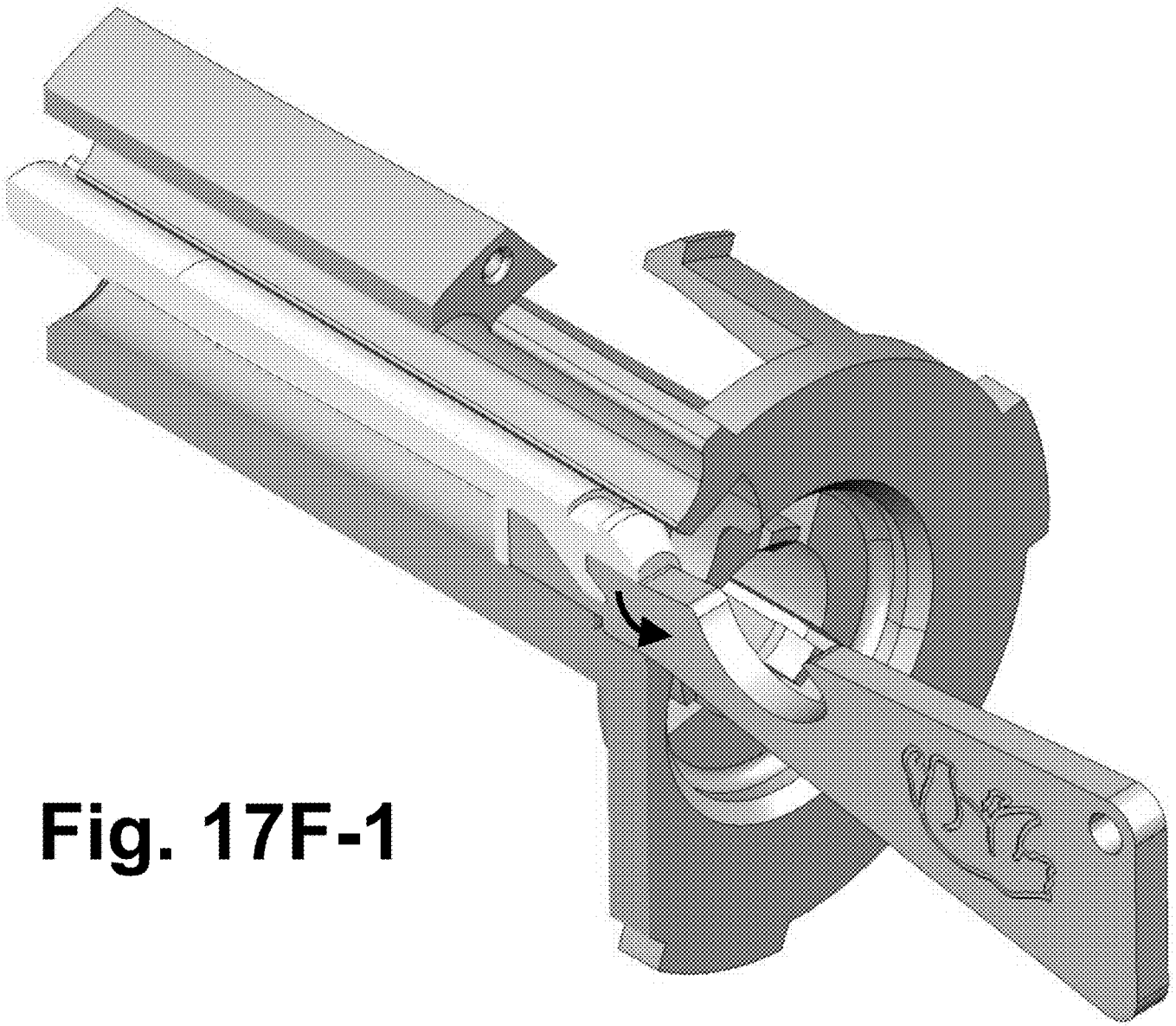
Figures 2, 17F:
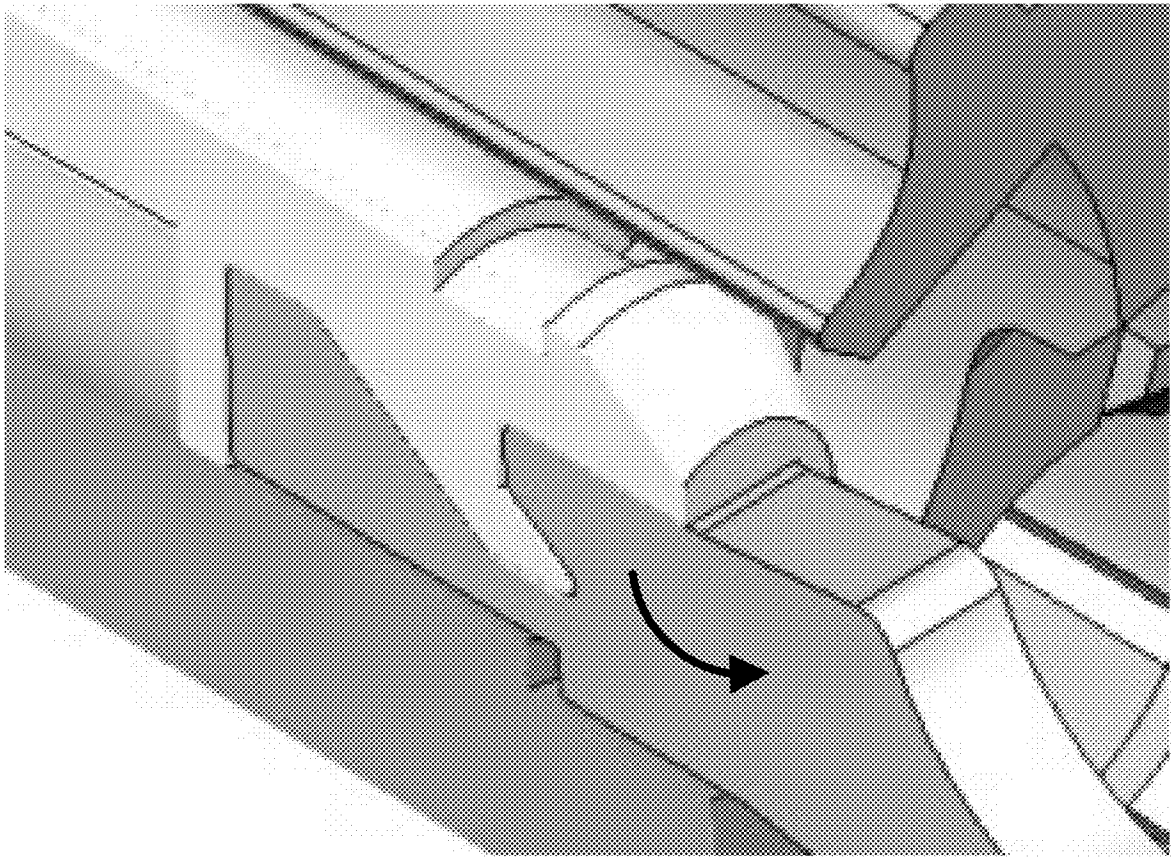
Figure 17G:
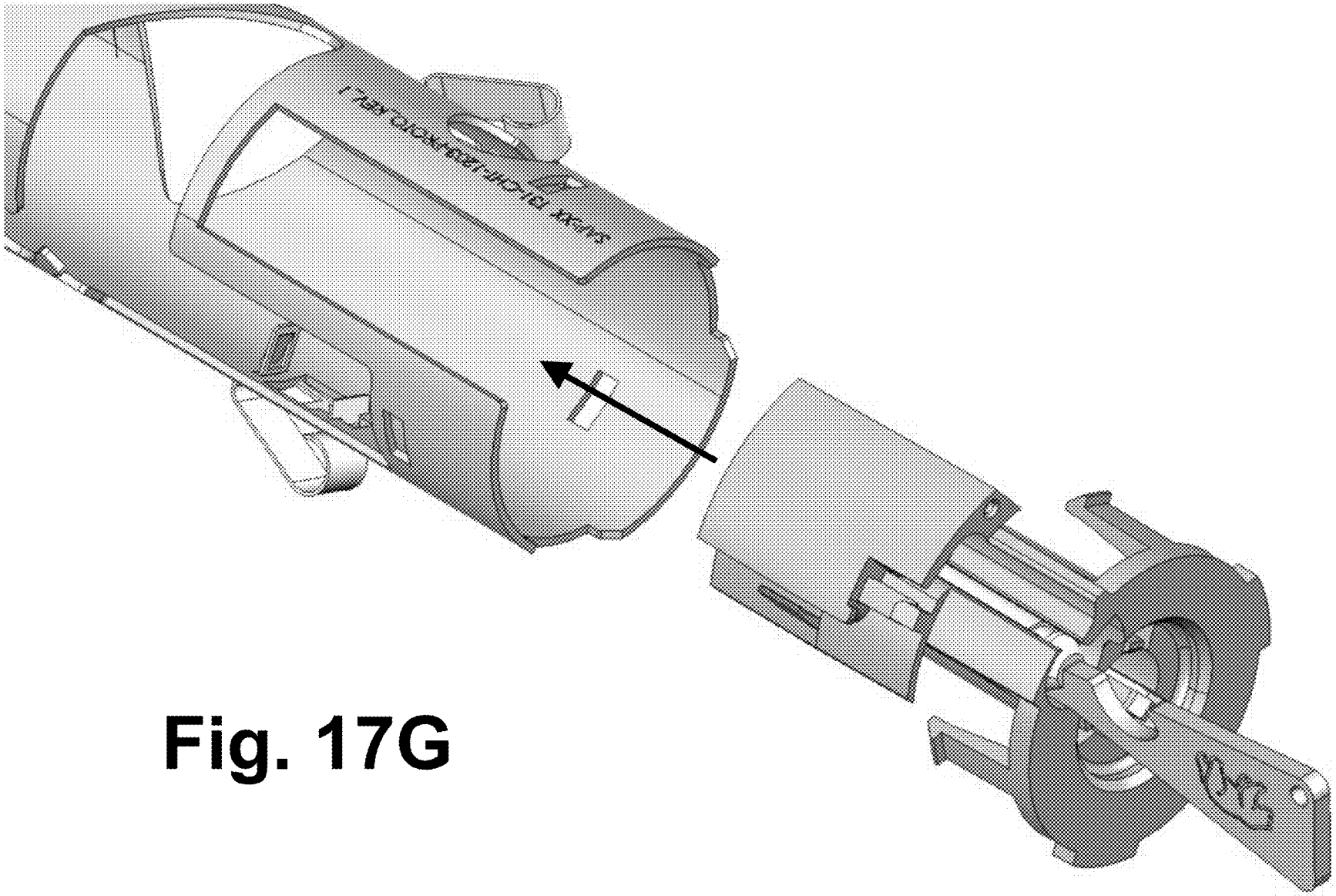
FIG. 17G is a partially-exploded perspective view of the ballistic interrupter including the key and the end cap including the detonation housing of FIG. 14, together with a charge tube of a perforating gun, in a seventh state or configuration, according to one or more embodiments of the present disclosure.
Figure 17H:
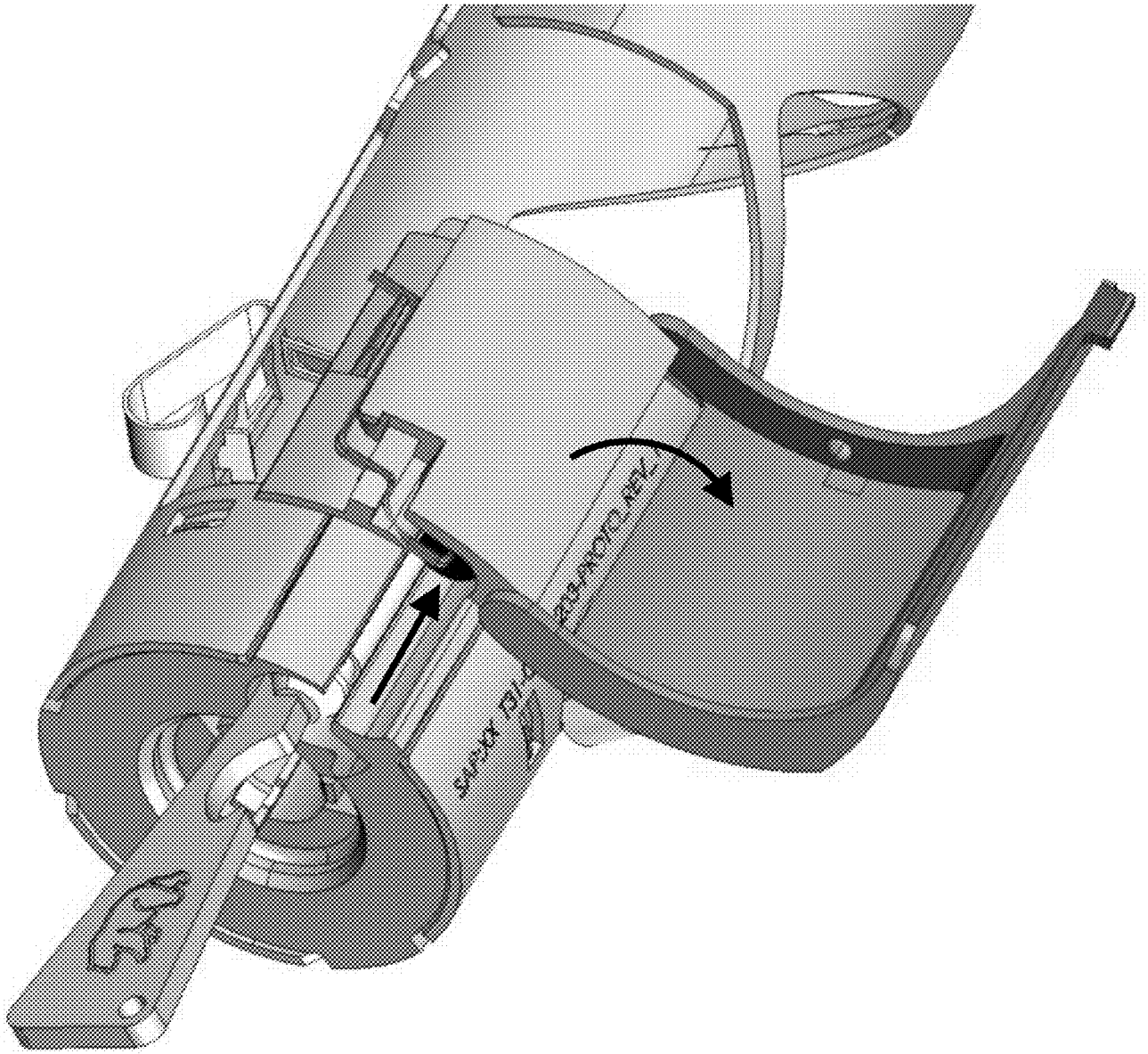
FIG. 17H is a perspective view of the ballistic interrupter including the key, the end cap including the detonation housing, and the charge tube of the perforating gun, together with a cover, in an eighth state or configuration, according to one or more embodiments of the present disclosure.
Figure 17I:
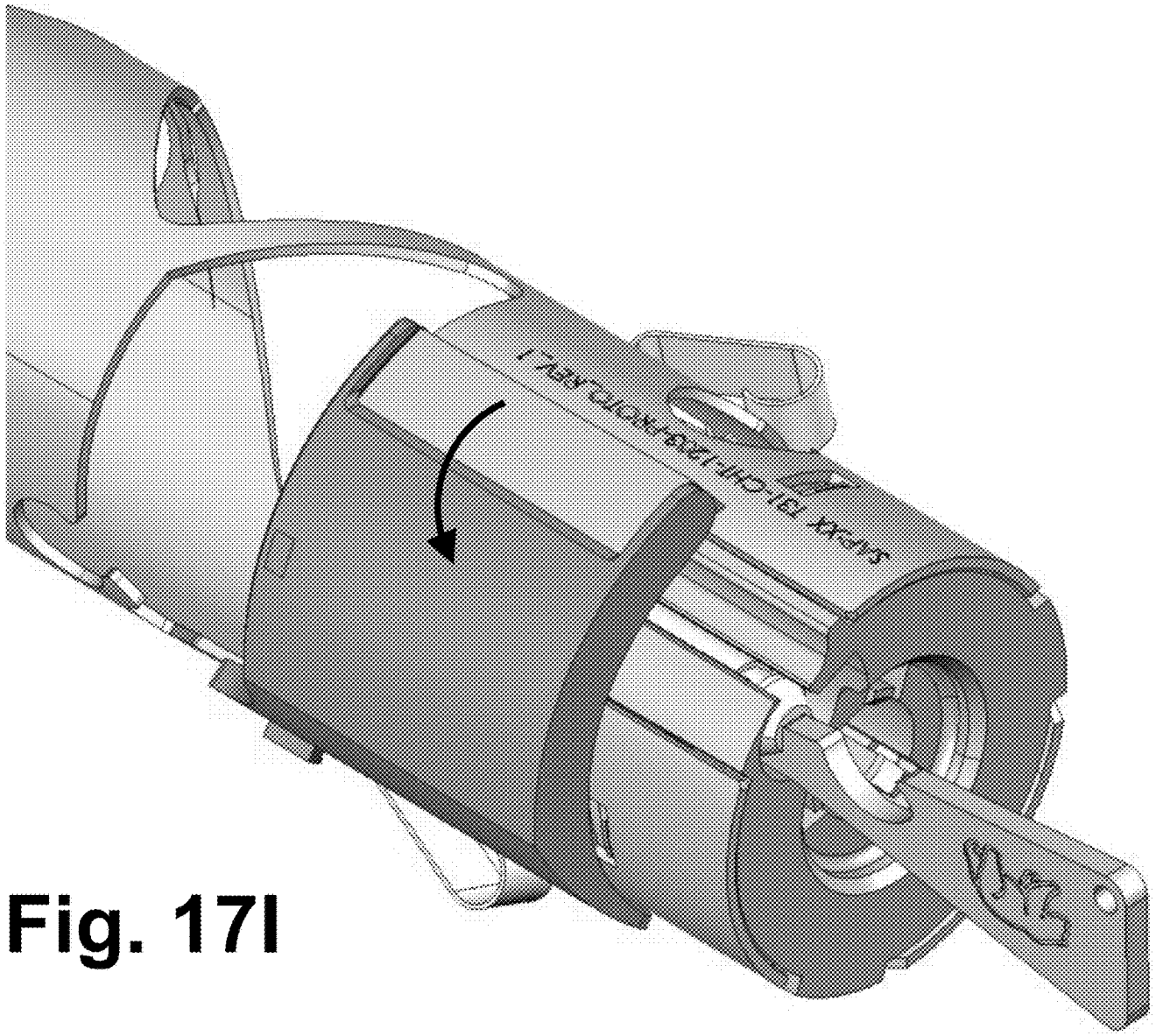
FIG. 17I is a perspective view of the ballistic interrupter including the key, the end cap including the detonation housing, and the charge tube of the perforating gun, together with the cover, in a ninth state or configuration, according to one or more embodiments of the present disclosure.

FIGS. 17A through 17I illustrate the end cap assembly of FIG. 14 in various states (or configurations) of assembly, according to one or more embodiments of the present disclosure. For ease of illustration, the detonating cord 585 extending within the bore 550' of the ballistic interrupter 545"" is omitted from view in FIGS. 17A through 17I. Likewise, for ease of illustration, the cover 605 hingedly connected to the detonation housing 525"" is omitted from view in FIGS. 17A through 17G (but is shown in FIGS. 17H and 17I). To assembly the end cap assembly of FIG. 14, the ballistic interrupter 545"" is first received into the bore 530*a'* at the end portion 526*b'* of the detonation housing 525"" (as shown in FIG. 17A) until the latching feature 543' snaps into the recess 565' of the ballistic interrupter 545"" (as shown in FIGS. 17B-1 and 17B-2) and the retaining feature 650 of the ballistic interrupter 545"" is received into the semi-annular recess 615 of the detonation housing 525"". Once the ballistic interrupter 545"" is so secured by the latching feature 543', the key 610 is received into the receptacle 645 in the end portion 546*a'* of the ballistic interrupter 545"" (as shown in FIGS. 17C-1 through 17D-2), and the ballistic interrupter 545"" is rotated (as shown in FIGS. 17E-1 and 17E-2) to the disarmed state or configuration (as shown in FIGS. 17F-1 and 17F-2). The geometry of the key 610 matingly engages the receptacle 645 of the ballistic interrupter 545"" so that, once so rotated toward the disarmed state or configuration, the detonation housing 525"" locks the key 610 into engagement with the ballistic interrupter 545"" until the ballistic interrupter 545"" is rotated back to the armed state or configuration. The disarmed end cap assembly is then received and secured into a charge tube of a perforating gun (as shown in FIGS. 17G and 17H). Once the disarmed end cap assembly is received and secured into the charge tube of the perforating gun, the cover 605 is hinged open and the detonator 580 is received into the bore 530*b'* at the end portion 526*a'* of the detonation housing 525"". Once the detonator 580 is received into the bore 530*b'* and the detonator leads are attached to the switch (not shown; e.g., the addressable switch retained by the receptacle 625), the cover 605 is hinged closed to retain the detonator 580 (and to protect any exposed wires; as shown in FIG. 17I). The ballistic interrupter 545"" is then rotatable back to the armed state or configuration, thus releasing the key 610, so that the perforating gun may be run downhole for detonation.

In several embodiments, one or more of the embodiments described and illustrated in the Appendix are combined in whole or in part with one or more of the embodiments described above and/or one or more of the other embodiments described and illustrated in the Appendix.

A perforating gun has been disclosed according to one or more embodiments of the present disclosure. The perforating gun generally includes: a ballistic interrupter adapted to accommodate one of a detonating cord or a detonator; and a detonation housing adapted to accommodate the ballistic interrupter and the other one of the detonating cord or the detonator so that the ballistic interrupter is actuable from: a disarmed state or configuration, in which the ballistic interrupter is oriented so as to provide a mechanical barrier impeding ballistic communication between: the one of the detonating cord or the detonator accommodated within the ballistic interrupter, which ballistic interrupter is accommodated within the detonation housing; and the other one of the detonating cord or the detonator accommodated within the detonation housing; to an armed state or configuration, in which the ballistic interrupter is oriented so as to permit ballistic communication between: the one of the detonating cord or the detonator accommodated within the ballistic interrupter, which ballistic interrupter is accommodated within the detonation housing; and the other one of the detonating cord or the detonator accommodated within the detonation housing. In one or more embodiments, the ballistic interrupter includes an exterior surface and a first bore adapted to accommodate the one of the detonating cord or the detonator. In one or more embodiments, the ballistic interrupter defines a receptacle matingly engageable by a key to rotationally orient the ballistic interrupter between the disarmed state or configuration and the armed state or configuration. In one or more embodiments, the key is not disengageable from the ballistic interrupter in the disarmed state or configuration, and the key is disengageable from the ballistic interrupter in the armed state or configuration. In one or more embodiments, the ballistic interrupter is rotationally oriented so as to provide the mechanical barrier impeding the ballistic communication in the disarmed state or configuration, the ballistic interrupter is rotationally oriented so as the permit the ballistic communication in the armed state or configuration, and the detonation housing includes: a second bore adapted to accommodate the ballistic interrupter, which ballistic interrupter is adapted to accommodate the one of the detonating cord or the detonator; and a third bore adapted to accommodate the other one of the detonating cord or the detonator. In one or more embodiments, both the exterior surface of the ballistic interrupter and the second bore of the detonation housing are tapered. In one or more embodiments, the detonation housing further comprises a cover openable for reception of the detonator and closeable for retention of the detonator. In one or more embodiments, the first bore of the ballistic interrupter intersects the exterior surface to form a first slot therealong; and the second and third bores of the detonation housing intersect to form a second slot therebetween. In one or more embodiments, in the disarmed state or configuration, the first slot in the exterior surface of the ballistic interrupter is rotationally oriented away from the second slot formed between the second and third bores of the detonation housing; and, in the armed state or configuration, the first slot in the exterior surface of the ballistic interrupter is rotationally oriented toward the second slot formed between the second and third bores of the detonation housing. In one or more embodiments, the perforating gun further includes a charge cartridge containing one or more perforating charges, said charge cartridge including an end cap, and said end cap including the detonation housing. In one or more embodiments, the perforating gun further includes a carrier tube in which the charge cartridge extends. In one or more embodiments, the perforating gun further includes a conductor sub containing the charge cartridge within the carrier tube.

A ballistic interrupter for a perforating gun has also been disclosed according to one or more embodiments of the present disclosure. The ballistic interrupter generally includes: an elongated body defining an exterior surface; and a first bore formed in the elongated body and adapted to accommodate one of a detonating cord or a detonator so that the ballistic interrupter is actuable from: a disarmed state or configuration, in which the ballistic interrupter is rotationally oriented so as to provide a mechanical barrier impeding ballistic communication between: the one of the detonating cord or the detonator accommodated within the first bore of the ballistic interrupter; and the other one of the detonating cord or the detonator; to an armed state or configuration, in which the ballistic interrupter is rotationally oriented so as to permit ballistic communication between: the one of the detonating cord or the detonator accommodated within the first bore of the ballistic interrupter; and the other one of the detonating cord or the detonator. In one or more embodiments, the elongated body defines a receptacle matingly engageable by a key to rotationally orient the elongated body between the disarmed state or configuration and the armed state or configuration. In one or more embodiments, the key is not disengageable from the elongated body in the disarmed state or configuration, and the key is disengageable from the elongated body in the armed state or configuration. In one or more embodiments, the perforating gun includes a detonation housing, said detonation housing including: a second bore adapted to accommodate the ballistic interrupter, which ballistic interrupter is adapted to accommodate the one of the detonating cord or the detonator; and a third bore adapted to accommodate the other one of the detonating cord or the detonator. In one or more embodiments, the exterior surface of the elongated body is tapered. In one or more embodiments, the detonation housing further comprises a cover openable for reception of the detonator and closeable for retention of the detonator. In one or more embodiments, the first bore of the ballistic interrupter intersects the exterior surface to form a first slot therealong; and the second and third bores of the detonation housing intersect to form a second slot therebetween. In one or more embodiments, in the disarmed state or configuration, the first slot in the exterior surface of the ballistic interrupter is rotationally oriented away from the second slot formed between the second and third bores of the detonation housing; and, in the armed state or configuration, the first slot in the exterior surface of the ballistic interrupter is rotationally oriented toward the second slot formed between the second and third bores of the detonation housing. In one or more embodiments, the perforating gun further includes a charge cartridge containing one or more perforating charges, said charge cartridge including an end cap, and said end cap including the detonation housing. In one or more embodiments, the perforating gun further includes: a carrier tube in which the charge cartridge extends; and a conductor sub containing the charge cartridge within the carrier tube.

A detonation housing for a perforating gun has also been disclosed according to one or more embodiments of the present disclosure. The detonation housing generally includes: a first bore defined by the body portion and adapted to accommodate a ballistic interrupter, which ballistic interrupter is adapted to accommodate one of a detonating cord or a detonator; and a second bore defined by the body portion and adapted to accommodate the other one of the detonating cord or the detonator so that the ballistic interrupter is actuable from: a disarmed state or configuration, in which the ballistic interrupter is rotationally oriented so as to provide a mechanical barrier impeding ballistic communication between: the one of the detonating cord or the detonator accommodated within the ballistic interrupter, which ballistic interrupter is accommodated within the first bore of the detonation housing; and the other one of the detonating cord or the detonator accommodated within the second bore of the detonation housing; to an armed state or configuration, in which the ballistic interrupter is rotationally oriented so as to permit ballistic communication between: the one of the detonating cord or the detonator accommodated within the ballistic interrupter, which ballistic interrupter is accommodated within the first bore of the detonation housing; and the other one of the detonating cord or the detonator accommodated within the second bore of the detonation housing. In one or more embodiments, the detonation housing further comprises a cover openable for reception of the detonator and closeable for retention of the detonator. In one or more embodiments, the ballistic interrupter includes an exterior surface and a third bore adapted to accommodate the one of the detonating cord or the detonator. In one or more embodiments, the first bore of the body portion is tapered. In one or more embodiments, the first and second bores of the detonation housing intersect to form a first slot therebetween; and the third bore of the ballistic interrupter intersects the exterior surface to form a second slot therealong. In one or more embodiments, in the disarmed state or configuration, the second slot in the exterior surface of the ballistic interrupter is rotationally oriented away from the first slot formed between the first and second bores of the detonation housing; and, in the armed state or configuration, the second slot in the exterior surface of the ballistic interrupter is rotationally oriented toward the first slot formed between the first and second bores of the detonation housing. In one or more embodiments, the perforating gun includes a charge cartridge containing one or more perforating charges, said charge cartridge including an end cap, and said end cap including the detonation housing. In one or more embodiments, the perforating gun further includes: a carrier tube in which the charge cartridge extends; and a conductor sub containing the charge cartridge within the carrier tube.

Another perforating gun has also been disclosed, according to one or more embodiments of the present disclosure.

A charge cartridge has also been disclosed, according to one or more embodiments of the present disclosure.

A carrier tube has also been disclosed, according to one or more embodiments of the present disclosure.

A conductor sub has also been disclosed, according to one or more embodiments of the present disclosure.

A charge tube has also been disclosed, according to one or more embodiments of the present disclosure.

A cap assembly has also been disclosed, according to one or more embodiments of the present disclosure.

An end cap has also been disclosed, according to one or more embodiments of the present disclosure.

Another detonation housing has also been disclosed, according to one or more embodiments of the present disclosure.

Another ballistic interrupter has also been disclosed, according to one or more embodiments of the present disclosure, wherein said ballistic interrupter is rotatably actuable between a disarmed state or configuration, in which the interrupter acts as a mechanical barrier that impedes a detonator's output, thereby preventing initiation/detonation of a detonating cord, and an armed state or configuration, in which the ballistic interrupter is adapted to permit ballistic communication between the detonator and the detonating cord.

An assembly has also been disclosed, according to one or more embodiments of the present disclosure. In one or more embodiments, the assembly comprises a detonation housing, a ballistic interrupter, a detonator, and a detonating cord.

A centralizing insert has also been disclosed, according to one or more embodiments of the present disclosure.

An orienting centralizer has also been disclosed, according to one or more embodiments of the present disclosure.

A gun string has also been disclosed, according to one or more embodiments of the present disclosure.

An apparatus has also been disclosed, according to one or more embodiments of the present disclosure.

A system has also been disclosed, according to one or more embodiments of the present disclosure.

A method has also been disclosed, according to one or more embodiments of the present disclosure.

A kit has also been disclosed, according to one or more embodiments of the present disclosure.

It is understood that variations may be made in the foregoing without departing from the scope of the disclosure.

In several embodiments, the elements and teachings of the various illustrative embodiments may be combined in whole or in part in some or all of the illustrative embodiments. In addition, one or more of the elements and teachings of the various illustrative embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, or one or more of the procedures may also be performed in different orders, simultaneously or sequentially. In several embodiments, the steps, processes or procedures may be merged into one or more steps, processes or procedures. In several embodiments, one or more of the operational steps in each embodiment may be omitted. Moreover, in some instances, some features of the present disclosure may be employed without a corresponding use of the other features. Moreover, one or more of the embodiments disclosed above and the Appendix, or variations thereof, may be combined in whole or in part with any one or more of the other embodiments described above and in the Appendix, or variations thereof.

Although several embodiments have been disclosed in detail above and in the Appendix, the embodiments disclosed are exemplary only and are not limiting, and those skilled in the art will readily appreciate that many other modifications, changes, and substitutions are possible in the embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112 (f) for any limitations of any of the claims herein, except for those in which the claim expressly uses the word "means" together with an associated function.

What is claimed is:

1. A perforating gun, comprising:

a detonator;

a detonating cord; and a ballistic interrupter actuable from:

a disarmed state or configuration, in which:

the ballistic interrupter is oriented so as to provide a mechanical barrier impeding ballistic communication between the detonator and the detonating cord; and the detonating cord is longitudinally overlapped by both the detonator and the mechanical barrier impeding said ballistic communication between the detonator and the detonating cord;

to an armed state or configuration, in which:

the ballistic interrupter is oriented so as to permit ballistic communication between the detonator and the detonating cord; and the perforating gun, including the detonator, the detonating cord, and the ballistic interrupter, is adapted to be run downhole for detonation;

wherein the ballistic interrupter defines an exterior surface and a first bore adapted to accommodate one of the detonator or the detonating cord.

2. The perforating gun of claim 1, wherein the ballistic interrupter further defines a receptacle matingly engageable by a key to orient the ballistic interrupter between the disarmed state or configuration and the armed state or configuration.

3. The perforating gun of claim 2, wherein the key is not disengageable from the ballistic interrupter in the disarmed state or configuration; and wherein the key is disengageable from the ballistic interrupter in the armed state or configuration.

4. The perforating gun of claim 1, further comprising:

a detonation housing adapted to accommodate the ballistic interrupter and the other one of the detonator or the detonating cord wherein the detonation housing comprises:

a second bore adapted to accommodate the ballistic interrupter, which ballistic interrupter is adapted to accommodate the one of the detonator or the detonating cord; and a third bore adapted to accommodate the other one of the detonator or the detonating cord.

5. The perforating gun of claim 4, wherein both the exterior surface of the ballistic interrupter and the second bore of the detonation housing are tapered.

6. The perforating gun of claim 4, wherein the detonation housing further comprises a cover openable for reception of the detonator and closeable for retention of the detonator.

7. The perforating gun of claim 4, wherein the first bore of the ballistic interrupter intersects the exterior surface to form a first slot therealong; and wherein the second and third bores of the detonation housing intersect to form a second slot therebetween.

8. The perforating gun of claim 7, wherein:

in the disarmed state or configuration, the first slot in the exterior surface of the ballistic interrupter is oriented away from the second slot formed between the second and third bores of the detonation housing;

and in the armed state or configuration, the first slot in the exterior surface of the ballistic interrupter is oriented toward the second slot formed between the second and third bores of the detonation housing.

9. The perforating gun of claim 4, further comprising:

a charge cartridge containing one or more perforating charges, said charge cartridge comprising an end cap, and said end cap comprising the detonation housing.

10. The perforating gun of claim 9, further comprising:

a carrier tube in which the charge cartridge extends.

11. The perforating gun of claim 10, further comprising:

a conductor sub containing the charge cartridge within the carrier tube.

12. A ballistic interrupter for a perforating gun, the ballistic interrupter comprising:

an elongated body defining an exterior surface; and a first bore formed in the elongated body and adapted to accommodate one of a detonator or a detonating cord so that the ballistic interrupter is actuable from:

a disarmed state or configuration, in which:

the ballistic interrupter is oriented so as to provide a mechanical barrier impeding ballistic communication between the detonator and the detonating cord; and the detonating cord is longitudinally overlapped by both the detonator and the mechanical barrier impeding said ballistic communication between the detonator and the detonating cord;

to an armed state or configuration, in which:

the ballistic interrupter is oriented so as to permit ballistic communication between the detonator and the detonating cord; and the perforating gun, including the detonator, the detonating cord, and the ballistic interrupter, is adapted to be run downhole for detonation.

13. The ballistic interrupter of claim 12, wherein the elongated body defines a receptacle matingly engageable by a key to orient the elongated body between the disarmed state or configuration and the armed state or configuration.

14. The ballistic interrupter of claim 13, wherein the key is not disengageable from the elongated body in the disarmed state or configuration; and wherein the key is disengageable from the elongated body in the armed state or configuration.

15. The ballistic interrupter of claim 12, wherein the perforating gun comprises a detonation housing, said detonation housing comprising:

a second bore adapted to accommodate the ballistic interrupter, which ballistic interrupter is adapted to accommodate the one of the detonator or the detonating cord; and a third bore adapted to accommodate the other one of the detonator or the detonating cord.

16. The ballistic interrupter of claim 15, wherein the exterior surface of the elongated body is tapered.

17. The ballistic interrupter of claim 15, wherein the detonation housing further comprises a cover openable for reception of the detonator and closeable for retention of the detonator.

18. The ballistic interrupter of claim 15, wherein the first bore of the ballistic interrupter intersects the exterior surface to form a first slot therealong; and wherein the second and third bores of the detonation housing intersect to form a second slot therebetween.

19. The ballistic interrupter of claim 18, wherein:

in the disarmed state or configuration, the first slot in the exterior surface of the ballistic interrupter is oriented away from the second slot formed between the second and third bores of the detonation housing;

and in the armed state or configuration, the first slot in the exterior surface of the ballistic interrupter is oriented toward the second slot formed between the second and third bores of the detonation housing.

20. The ballistic interrupter of claim 15, wherein the perforating gun further comprises a charged cartridge containing one or more perforating charges, said charge cartridge comprising an end cap, and said end cap comprising the detonation housing.

21. The ballistic interrupter of claim 20, wherein the perforating gun further comprises:

a carrier tube in which the charge cartridge extends; and a conductor sub containing the charge cartridge within the carrier tube.

22. A detonation housing for a perforating gun, the detonation housing comprising:

a body portion;

a first bore defined by the body portion and adapted to accommodate a ballistic interrupter, which ballistic interrupter is adapted to accommodate one of a detonator or a detonating cord; and a second bore defined by the body portion and adapted to accommodate the other one of the detonator or the detonating cord so that the ballistic interrupter is actuable from:

a disarmed state or configuration, in which:

the ballistic interrupter is oriented so as to provide a mechanical barrier impeding ballistic communication between the detonator and the detonating cord; and the detonating cord is longitudinally overlapped by both the detonator and the mechanical barrier impeding said ballistic communication between the detonator and the detonating cord;

to an armed state or configuration, in which:

the ballistic interrupter is oriented so as to permit ballistic communication between the detonator and the detonating cord; and the perforating gun, including the detonator, the detonating cord, and the ballistic interrupter, is adapted to be run downhole for detonation.

23. The detonation housing of claim 22, further comprising a cover openable for reception of the detonator and closeable for retention of the detonator.

24. The detonation housing of claim 22, wherein the ballistic interrupter comprises an exterior surface and a third bore adapted to accommodate the one of the detonator or the detonating cord.

25. The detonation housing of claim 24, wherein the first bore of the body portion is tapered.

26. The detonation housing of claim 24, wherein the first and second bores of the detonation housing intersect to form a first slot therebetween; and wherein the third bore of the ballistic interrupter intersects the exterior surface to form a second slot therealong.

27. The detonation housing of claim 26, wherein:

in the disarmed state or configuration, the second slot in the exterior surface of the ballistic interrupter is oriented away from the first slot formed between the first and second bores of the detonation housing; and in the armed state or configuration, the second slot in the exterior surface of the ballistic interrupter is oriented toward the first slot formed between the first and second bores of the detonation housing.

28. The detonation housing of claim 22, wherein the perforating gun comprises a charge cartridge containing one or more perforating charges, said charge cartridge comprising an end cap, and said end cap comprising the detonation housing.

29. The detonation housing of claim 28, wherein the perforating gun further comprises:

a carrier tube in which the charge cartridge extends; and a conductor sub containing the charge cartridge within the carrier tube.

* * * * *